United States Patent [19]

Kashio

[11] 4,348,932

[45] Sep. 14, 1982

[54] MUSICAL INSTRUMENT TYPE-SELECTING SYSTEM FOR AN ELECTRONIC MUSICAL INSTRUMENT

[75] Inventor: Toshio Kashio, Tokyo, Japan

[73] Assignee: Casio Computer Co., Ltd., Tokyo, Japan

[21] Appl. No.: 210,286

[22] Filed: Nov. 25, 1980

Related U.S. Application Data

[63] Continuation of Ser. No. 15,748, Feb. 27, 1979, abandoned.

[30] Foreign Application Priority Data

Mar. 14, 1978 [JP] Japan ..... 53/29378

[51] Int. Cl.[3] ..... G10H 1/057; G10H 1/12

[52] U.S. Cl. ..... 84/1.19; 84/1.26; 84/DIG. 7

[58] Field of Search ..... 84/1.01, 1.03, 1.11, 84/1.12, 1.13, 1.19, 1.21, 1.24, 1.26, DIG. 9

[56] References Cited

U.S. PATENT DOCUMENTS

| | | | |
|---|---|---|---|
| 3,882,751 | 5/1975 | Tomisawa et al. . | |
| 4,006,658 | 2/1977 | Kappes et al. . | |
| 4,099,438 | 7/1978 | Hiyoshi et al. . | |
| 4,108,036 | 8/1978 | Slaymaker | 84/1.01 |
| 4,114,498 | 9/1978 | Chibana et al. | 84/1.19 |
| 4,128,032 | 12/1978 | Wada et al. | 84/1.01 |
| 4,133,244 | 1/1979 | Hiyoshi et al. | 84/1.26 |
| 4,176,577 | 12/1979 | Yamada et al. | 84/1.01 |

FOREIGN PATENT DOCUMENTS

| | | |
|---|---|---|
| 2202658 | 1/1972 | Fed. Rep. of Germany . |
| 2641432 | 9/1976 | Fed. Rep. of Germany . |
| 2738358 | 8/1977 | Fed. Rep. of Germany . |

OTHER PUBLICATIONS

WERSI-Katalog "Die Elektronenorgal", II, Auflage, 1976, pp. 66 and 67.

*Primary Examiner*—Stanley J. Witkowski
*Attorney, Agent, or Firm*—Frishauf, Holtz, Goodman and Woodward

[57] ABSTRACT

An electronic musical instrument of simple arrangement wherein a plurality of musical tones of different musical instrument types are preset; musical tones of a desired musical instrument type is first selected; musical tones belonging to the selected one of the plural musical instrument types are played by performance keys; the performance keys are concurrently used for selection of musical tones of the desired musical instrument type, and which comprises a changeover switch for determining the application of the performance keys for the original purpose or for selection of a desired musical instrument type, thereby eliminating the necessity of providing separate musical instrument type-selecting key or keys in addition to the performance keys.

8 Claims, 45 Drawing Figures

| (KEY) | (HZ) | (DATA) | (KEY) | (HZ) | (DATA) | (KEY) | (HZ) | (DATA) | (KEY) | (HZ) | (DATA) | (KEY) | (HZ) | (DATA) |
|---|---|---|---|---|---|---|---|---|---|---|---|---|---|---|
| | | | C4 | 261.53 | 101100 | C5 | 523.25 | 101110 | C6 | 1046.5 | 101101 | C7 | 2093.0 | 101111 |
| C3# | 138.59 | 000000 | C4# | 277.18 | 000010 | C5# | 554.37 | 000001 | C6# | 1108.7 | 000011 | | | |
| D3 | 146.83 | 100000 | D4 | 293.66 | 100010 | D5 | 587.33 | 100001 | D6 | 1174.7 | 100011 | | | |
| D3# | 155.56 | 010000 | D4# | 311.13 | 010010 | D5# | 622.25 | 010001 | D6# | 1244.5 | 010011 | | | |
| E3 | 164.81 | 110000 | E4 | 329.63 | 110010 | E5 | 659.26 | 110001 | E6 | 1318.5 | 110011 | | | |
| F3 | 174.61 | 001000 | F4 | 349.23 | 001010 | F5 | 698.46 | 001001 | F6 | 1396.9 | 001011 | | | |
| F3# | 185.00 | 101000 | F4# | 369.99 | 101010 | F5# | 739.99 | 101001 | F6# | 1480.0 | 101011 | | | |
| G3 | 196.00 | 000100 | G4 | 392.00 | 000110 | G5 | 783.99 | 000101 | G6 | 1568.0 | 000111 | | | |
| G3# | 207.65 | 100100 | G4# | 415.30 | 100110 | G5# | 830.61 | 100101 | G6# | 1661.2 | 10011 | | | |
| A3 | 220.00 | 010100 | A4 | 440.00 | 010110 | A5 | 880.00 | 010101 | A6 | 1760.0 | 010111 | | | |
| A3# | 233.08 | 110100 | A4# | 466.16 | 110110 | A5# | 932.33 | 110101 | A6# | 1864.7 | 110100 | | | |
| B3 | 246.94 | 001100 | B4 | 493.88 | 001110 | B5 | 987.77 | 001101 | B6 | 1975.5 | 001111 | | | |

WEIGHT
(1, 2, 4, 8, 16, 32)

FIG. 3

FIG. 5A

| PITCH DATA | | | | | | CODED SIGNAL OF ELEMENTS OF MUSICAL TONE | | | | | | | | | | | | | WAVEFORM NUMBER | | SW 13 |
|---|---|---|---|---|---|---|---|---|---|---|---|---|---|---|---|---|---|---|---|---|---|
| | | | | | | FILTER | | ENVELOPE | | | OCTAVE SHIFT | | WAVEFORM | | | | | | | | |
| ① | ② | ③ | ④ | ⑤ | ⑥ | A1 | A2 | B1 | B2 | B4 | D1 | D2 | C1 | C2 | C4 | C8 | C16 | | | | ⑦ |
| 0 | 0 | 0 | 0 | 0 | 0 | 0 | 0 | 0 | 0 | 0 | 0 | 0 | 0 | 1 | 0 | 0 | 0 | 0 | 2 | | X |
| | | | | | | | | | | | | | 0 | 0 | 0 | 0 | 1 | 2 | 0 | | ○ |
| 1 | 0 | 0 | 0 | 0 | 0 | 1 | 0 | 0 | 0 | 0 | 1 | 0 | 0 | 0 | 0 | 1 | 0 | 1 | 0 | | X |
| | | | | | | | | | | | | | 0 | 1 | 0 | 0 | 0 | 0 | 2 | | ○ |
| 0 | 1 | 0 | 0 | 0 | 0 | 0 | 1 | 0 | 0 | 0 | 0 | 1 | 0 | 0 | 0 | 0 | 1 | 2 | 0 | | X |
| | | | | | | | | | | | | | 0 | 0 | 0 | 1 | 0 | 1 | 0 | | ○ |
| 1 | 1 | 0 | 0 | 0 | 0 | 0 | 0 | 1 | 0 | 0 | 1 | 0 | 0 | 1 | 0 | 0 | 0 | 0 | 2 | | X |
| | | | | | | | | | | | | | 0 | 0 | 0 | 0 | 1 | 2 | 0 | | ○ |
| 0 | 0 | 1 | 0 | 0 | 0 | 1 | 0 | 1 | 0 | 0 | 0 | 1 | 0 | 0 | 1 | 1 | 0 | 1 | 4 | | X |
| | | | | | | | | | | | | | 0 | 1 | 0 | 0 | 0 | 0 | 2 | | ○ |
| 1 | 0 | 1 | 0 | 0 | 0 | 0 | 1 | 1 | 0 | 0 | 0 | 0 | 0 | 1 | 0 | 0 | 1 | 2 | 2 | | X |
| | | | | | | | | | | | | | 0 | 0 | 0 | 1 | 0 | 1 | 0 | | ○ |
| 0 | 0 | 0 | 1 | 0 | 0 | 0 | 0 | 0 | 1 | 0 | 0 | 1 | 0 | 0 | 1 | 0 | 0 | 0 | 4 | | X |
| | | | | | | | | | | | | | 0 | 0 | 0 | 0 | 1 | 2 | 0 | | ○ |
| 1 | 0 | 0 | 1 | 0 | 0 | 1 | 0 | 0 | 1 | 0 | 0 | 0 | 1 | 0 | 0 | 1 | 0 | 1 | 1 | | X |
| | | | | | | | | | | | | | 1 | 1 | 0 | 0 | 1 | 2 | 3 | | ○ |
| 0 | 1 | 0 | 1 | 0 | 0 | 0 | 1 | 0 | 1 | 0 | 1 | 0 | 0 | 0 | 0 | 0 | 1 | 2 | 0 | | X |
| | | | | | | | | | | | | | 0 | 0 | 1 | 0 | 0 | 0 | 4 | | ○ |
| 1 | 1 | 0 | 1 | 0 | 0 | 0 | 0 | 1 | 1 | 0 | 0 | 0 | 1 | 1 | 0 | 0 | 1 | 2 | 3 | | X |
| | | | | | | | | | | | | | 1 | 0 | 0 | 1 | 0 | 1 | 1 | | ○ |

| | | | | | | | | | | | | | | | | | | | | | | |
|---|---|---|---|---|---|---|---|---|---|---|---|---|---|---|---|---|---|---|---|---|---|---|
| 0 | 0 | 1 | 0 | 1 | 1 | 1 | 0 | 1 | 1 | 0 | 0 | 1 | 1 | 0 | 0 | 0 | 1 | 2 | 1 | X |
| | | | | | | | | | | | | | 1 | 0 | 1 | 0 | 0 | 0 | 5 | ○ |
| 1 | 0 | 1 | 0 | 1 | 1 | 0 | 1 | 1 | 1 | 0 | 0 | 0 | 1 | 1 | 0 | 0 | 0 | 0 | 3 | X |
| | | | | | | | | | | | | | 1 | 0 | 1 | 1 | 0 | 1 | 5 | ○ |
| 0 | 0 | 0 | 1 | 1 | 1 | 0 | 0 | 0 | 0 | 1 | 0 | 1 | 0 | 0 | 0 | 0 | 0 | 0 | 0 | X |
| | | | | | | | | | | | | | 1 | 0 | 1 | 0 | 1 | 2 | 5 | ○ |
| 1 | 0 | 0 | 1 | 1 | 1 | 1 | 0 | 0 | 0 | 1 | 0 | 0 | 1 | 0 | 0 | 0 | 0 | 0 | 1 | X |
| | | | | | | | | | | | | | 0 | 0 | 1 | 0 | 1 | 2 | 4 | ○ |
| 0 | 1 | 0 | 1 | 1 | 1 | 0 | 1 | 0 | 0 | 1 | 1 | 0 | 0 | 1 | 0 | 1 | 0 | 1 | 2 | X |
| | | | | | | | | | | | | | 1 | 1 | 0 | 1 | 0 | 1 | 3 | ○ |
| 1 | 1 | 0 | 1 | 0 | 0 | 0 | 0 | 0 | 0 | 0 | 0 | 0 | 1 | 1 | 0 | 1 | 0 | 1 | 3 | X |
| | | | | | | | | | | | | | 0 | 1 | 0 | 1 | 0 | 1 | 2 | ○ |
| 0 | 0 | 1 | 1 | 1 | 1 | 1 | 0 | 0 | 0 | 0 | 1 | 0 | 0 | 0 | 1 | 0 | 1 | 2 | 4 | X |
| | | | | | | | | | | | | | 1 | 0 | 0 | 0 | 0 | 0 | 1 | ○ |
| 1 | 0 | 1 | 1 | 1 | 1 | 0 | 1 | 0 | 0 | 0 | 0 | 1 | 1 | 0 | 1 | 0 | 1 | 2 | 5 | X |
| | | | | | | | | | | | | | 0 | 0 | 0 | 0 | 0 | 0 | 0 | ○ |

FIG. 5B

| WAVE-FORM NO. | DECREASE WAVEFORM | | INCREASE WAVEFORM | | FIXED FLOATING |
|---|---|---|---|---|---|
| | C16 | C8 | C4 | C2 | C1 |
| 00 | 0 | 0 | 0 | 0 | 0 |
| 01 | 0 | 0 | 0 | 0 | 1 |
| 02 | 0 | 0 | 0 | 1 | 0 |
| 03 | 0 | 0 | 0 | 1 | 1 |
| 04 | 0 | 0 | 1 | 0 | 0 |
| 05 | 0 | 0 | 1 | 0 | 1 |
| 10 | 0 | 1 | 0 | 0 | 0 |
| 11 | 0 | 1 | 0 | 0 | 1 |

| WAVE-FORM NO. | DECREASE WAVEFORM | | INCREASE WAVEFORM | | FIXED FLOATING |
|---|---|---|---|---|---|
| | C16 | C8 | C4 | C2 | C1 |
| 12 | 0 | 1 | 0 | 1 | 0 |
| 13 | 0 | 1 | 0 | 1 | 1 |
| 14 | 0 | 1 | 1 | 0 | 0 |
| 15 | 0 | 1 | 1 | 0 | 1 |
| 20 | 1 | 0 | 0 | 0 | 0 |
| 21 | 1 | 0 | 0 | 0 | 1 |
| 22 | 1 | 0 | 0 | 1 | 0 |
| 23 | 1 | 0 | 0 | 1 | 1 |
| 24 | 1 | 0 | 1 | 0 | 0 |
| 25 | 1 | 0 | 1 | 0 | 1 |

35-1
A=31
A=17-31
A=16
A=1-15
PERIOD DETECTION CIRCUIT
E>A'
E≧A'
COMPARATOR
39-1
39-2
39-3
39-4
39-5
35-4
35-3
BC
35-2
DOWN INSTRUCTION
E1 E2 E4 E8
AMPLITUDE COUNTER
34a
A1 A2 A4 A8 A16
ADDRESS COUNTER
30a
INCREASE CLOCK OR TRANSFORM CLOCK PULSE
PITCH CLOCK PULSE

FIG. 15

| | WAVEFORM DESIGNATING CODE | | | | RISE → START → TRANSFORM PERIOD → END |
|---|---|---|---|---|---|
| | START | | END | | |
| RECTANGULAR WAVE → SAWTOOTH WAVE | 0 | 1 | 0 | 0 | |
| RECTANGULAR WAVE → TRIANGULAR WAVE | 0 | 1 | 1 | 0 | |
| SAWTOOTH WAVE → RECTANGULAR WAVE | 0 | 0 | 0 | 1 | |
| SAWTOOTH WAVE → TRIANGULAR WAVE | 0 | 0 | 1 | 0 | |
| TRIANGULAR WAVE → RECTANGULAR WAVE | 1 | 0 | 0 | 1 | |
| TRIANGULAR WAVE → SAWTOOTH WAVE | 1 | 0 | 0 | 0 | |

35-50
A=31
A=17~31
A=16
A=1~15
PERIOD DETECTION CIRCUIT
39-54
E=A'
E>A'
E≦A'
E≧A'
COMPA-RATOR
39-50
39-51
39-52
39-53
35-62
34b
E1 E2 E4 E8
AMPLITUDE COUNTER
DOWN INSTRUCTION
DECREASE CLOCK PULSE
30b
A1 A2 A4 A8 A16
ADDRESS COUNTER
PITCH CLOCK PULSE

FIG. 26

| | |
|---|---|
| FIG.25C-1 | FIG.25D-1 |
| FIG.25C-2 | FIG.25D-2 |
| FIG.25D-1 | FIG.25D-1 |
| FIG.25D-2 | FIG.25D-2 |

FIG. 28A

| OUTPUT OF MATRIX 192 | | WAVEFORM NO. | 00 | 01 | 02 | 03 | 04 | 05 |
|---|---|---|---|---|---|---|---|---|
| INCREASE (I) | s | TRIANGLE | | | | | ○ | ○ |
| | t | RECTANGLE | | | ○ | ○ | | |
| | u | TRIANGLE, SAWTOOTH | ○ | ○ | | | ○ | ○ |
| | v | RECTANGLE, SAWTOOTH | ○ | ○ | ○ | ○ | | |
| TRANSFORM (T) | f | RECTANGLE→SAWTOOTH | | | ○ | ○ | | |
| | g | SAWTOOTH→RECTANGLE | | | | | | |
| | h | SAWTOOTH→TRIANGLE | | | | | | |
| | i | TRIANGLE→SAWTOOTH | | | | | ○ | ○ |
| | j | INITIAL WAVE IS RECTANGLE | | | ○ | ○ | | |
| | k | FINAL WAVE IS RECTANGLE | | | | | | |
| | ℓ | INITIAL WAVE IS TRIANGLE | | | | | ○ | ○ |
| | m | FINAL WAVE IS TRIANGLE | | | | | | |
| DECREASE (D) | n | TRIANGLE, FLOATING | | | | | | |
| | o | TRIANGLE, FIXED | | | | | | |
| | p | RECTANGLE, FIXED | | | | | | |
| | q | (TRIANGLE + SAWTOOTH), FIXED | ○ | | ○ | | ○ | |
| | r | (SAWTOOTH + RECTANGLE), (FIXED + FLOATING) | ○ | ○ | ○ | ○ | ○ | ○ |
| | w | RECTANGLE, FLOATING | | | | | | |
| | x | (TRIANGLE + SAWTOOTH), FLOATING | | ○ | | ○ | | ○ |

FIG. 28B

| 10 | 11 | 12 | 13 | 14 | 15 | 20 | 21 | 22 | 23 | 24 | 25 | OUTPUT OF MATRIX |
|---|---|---|---|---|---|---|---|---|---|---|---|---|
| | | | | O | O | | | | | O | O | y3 |
| | | O | O | | | | | O | O | | | y2 |
| O | O | | | O | O | O | O | | | O | O | y6 |
| O | O | O | O | | | O | O | O | O | | | y1 |
| | | | | | | | | | | | | y9 |
| O | O | | | | | | | | | | | y9 |
| | | | | | | O | O | | | | | y8 |
| | | | | | | | | | | | | y8 |
| | | | | | | | | O | O | | | y6+y7 |
| O | O | | | O | O | | | | | | | y6+y7 |
| | | | | O | O | | | | | | | y4+y5 |
| | | | | | | O | O | O | O | | | y4+y5 |
| | | | | | | | O | | O | | O | y4 |
| | | | | | | O | | O | | O | | y3 |
| O | | O | | O | | | | | | | | y2 |
| | | | | | | O | | O | | O | | y6 |
| O | O | O | O | O | O | | | | | | | y1 |
| | O | | O | | O | | | | | | | |
| | | | | | | | O | | O | | O | |

MUSICAL INSTRUMENT TYPE-SELECTING SYSTEM FOR AN ELECTRONIC MUSICAL INSTRUMENT

This is a continuation of application Ser. No. 15,748, filed Feb. 27, 1979, and now abandoned.

BACKGROUND OF THE INVENTION

This invention relates to an electronic musical instrument capable of playing the tones of a musical instrument selected from among a plurality of musical instrument types and more particularly to a system for selecting a musical instrument type being played.

A widely disseminated electronic organ is the type which comprises a large number of tablets or drawbars, and gives forth the tones of any desired type of musical instrument by the "ON" or "OFF" setting of said tablets or drawbars or the extent to which the drawbars are pulled out. However, combination of the tablets or drawbars to play the tones of a selected type of musical instrument involved complicated operations. Provision of numerous tablets or drawbars required a large space in an electronic musical organ. Though it may be regarded as possible to select a type of musical instrument over a seemingly infinite range by combination of the tablets or drawbars, yet said combination is actually restricted due to the particular tone-producing mechanism of an electronic organ. Therefore, combinations of the tablets or drawbars allowing for practical application have naturally been defined within a limited range.

In recent years, therefore, an electric organ or synthesizer is put to practical use, in which the types of musical instrument specified by frequently applied combinations of tablets or drawbars or special types of musical instrument, such as the cembalo, piano, flute and clarinet are preset, and the tones of a musical instrument selected from the preset types are given forth by one of the stop switches corresponding to said types of musical instrument. An electronic organ in which the types of musical instruments are thus preset is indeed saved from the complicated operations accompanying the aforesaid tablet- or drawbar-type electronic organ. But it is still necessary to provide a large number of stop switches occupying a considerable space in an electronic organ.

As mentioned above, the prior art electronic organ or synthesizer which comprises not only performance keys but also numerous switches such as tablets, drawbars or stopswitches used to specify a particular type of musical instrument has the drawbacks that said switches occupy a large space, unavoidably rendering an electronic organ bulky; and the known electronic organ is handicapped, for example, by complicated construction, low operability and high cost and is unadapted to be rendered portably compact and inexpensive.

This invention has been accomplished in view of the above-mentioned circumstances and is intended to provide a simple system for selecting a desired type of musical instrument from among those which are preset in an electronic musical instrument.

SUMMARY OF THE INVENTION

To attain the above-mentioned object with respect to an electronic musical instrument having performance keys for generating coded signals, means for selecting a particular type of musical instrument and means for producing tones belonging to said selected type of musical instrument, the system of this invention for selecting a particular type of musical instrument comprises means causing coded signals produced by the performance keys to conform to a type of musical instrument selected from those which are preset in the electronic musical instrument; means for letting the performance keys concurrently act to select a particular type of musical instrument from those which are preset in the electronic musical instrument; and switching means for changing over the operation of the performance keys for performance itself or selection of a particular type of musical instrument. Where the switching means is used to select a particular type of musical instrument, then that type of music instrument is specified which corresponds to the coded signals produced by performance keys operated.

This invention enables performance keys to be selectively used either for the original performance or for selection of a particular type of musical instrument by means of switching means, thus making it possible to omit the greater part of the switches which have hitherto been exclusively used to select a desired type of musical instrument. Therefore, an electronic musical instrument provided with a musical instrument type-selecting system embodying this invention has fewer parts than used with the prior art type, consequently requires a smaller inner space, and is rendered portably compact, thus proving to have great practical use.

BRIEF DESCRIPTION OF THE DRAWINGS

FIG. 3 indicates the frequencies of tone signals produced by the performance keys of FIG. 1C and the logic data denoting the pitches of said tone signals;

FIGS. 5A and 5B show the logic data on the pitches used to describe the operation of the code converter of FIGS. 4A and 4B;

FIG. 15 indicates changes with time in the waveforms of signals used in the circuit of FIGS. 10A and 10B which occur during the respective periods;

FIG. 26 indicates the manner in which the circuits 25A-1 to 25D-2 are to be connected in illustration;

FIGS. 28A and 28B illustrate a functional chart of waveform-specifying signals used in FIGS. 25A-1 to 25D-2.

DETAILED DESCRIPTION

Figure 1A:
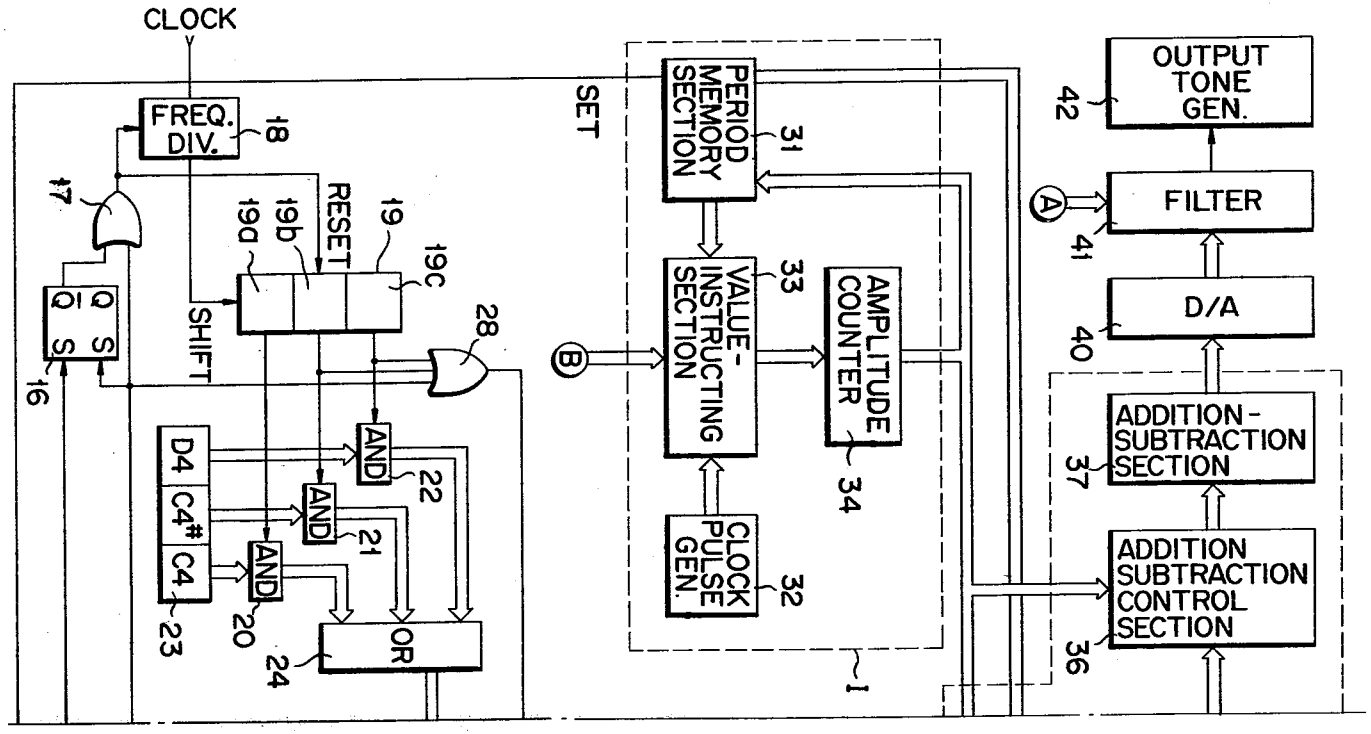
FIGS. 1A–1C schematically show the circuit arrangement of an electronic musical instrument provided with a musical instrument type-selecting system embodying this invention.
Figure 1B:
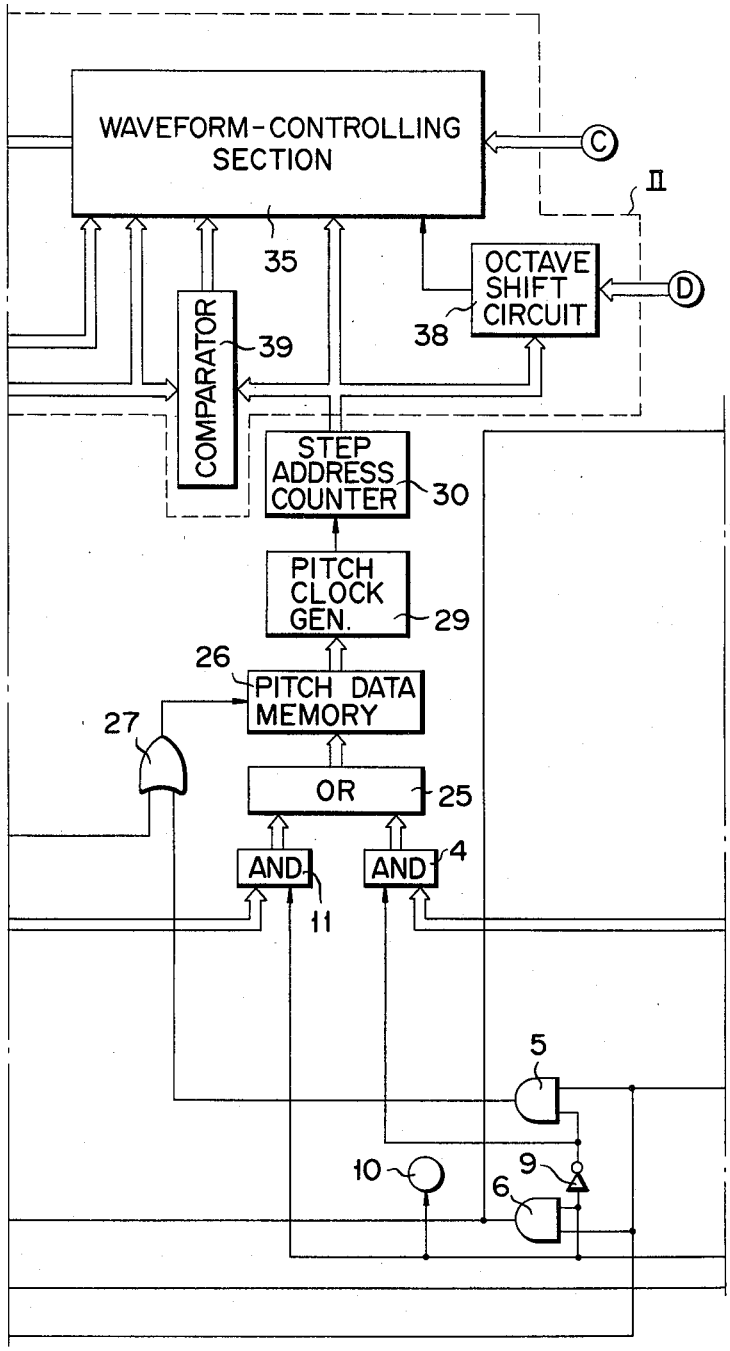
Figure 1C:
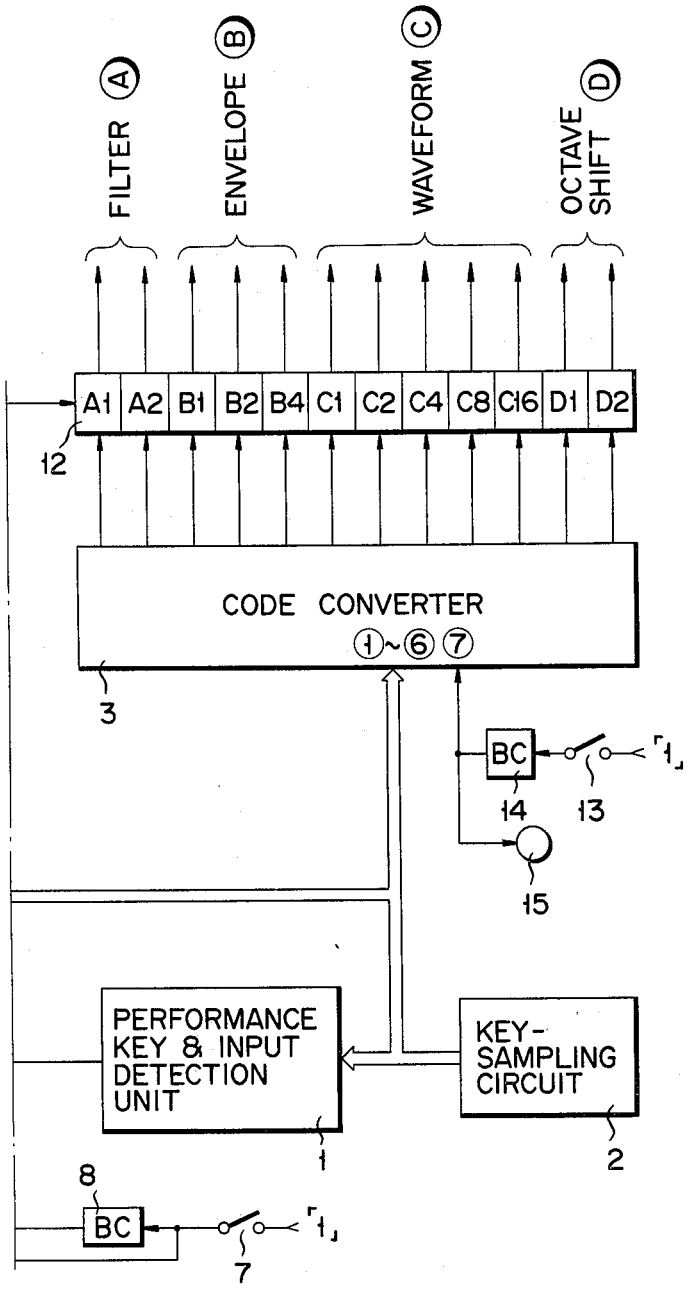
Figure 2A:
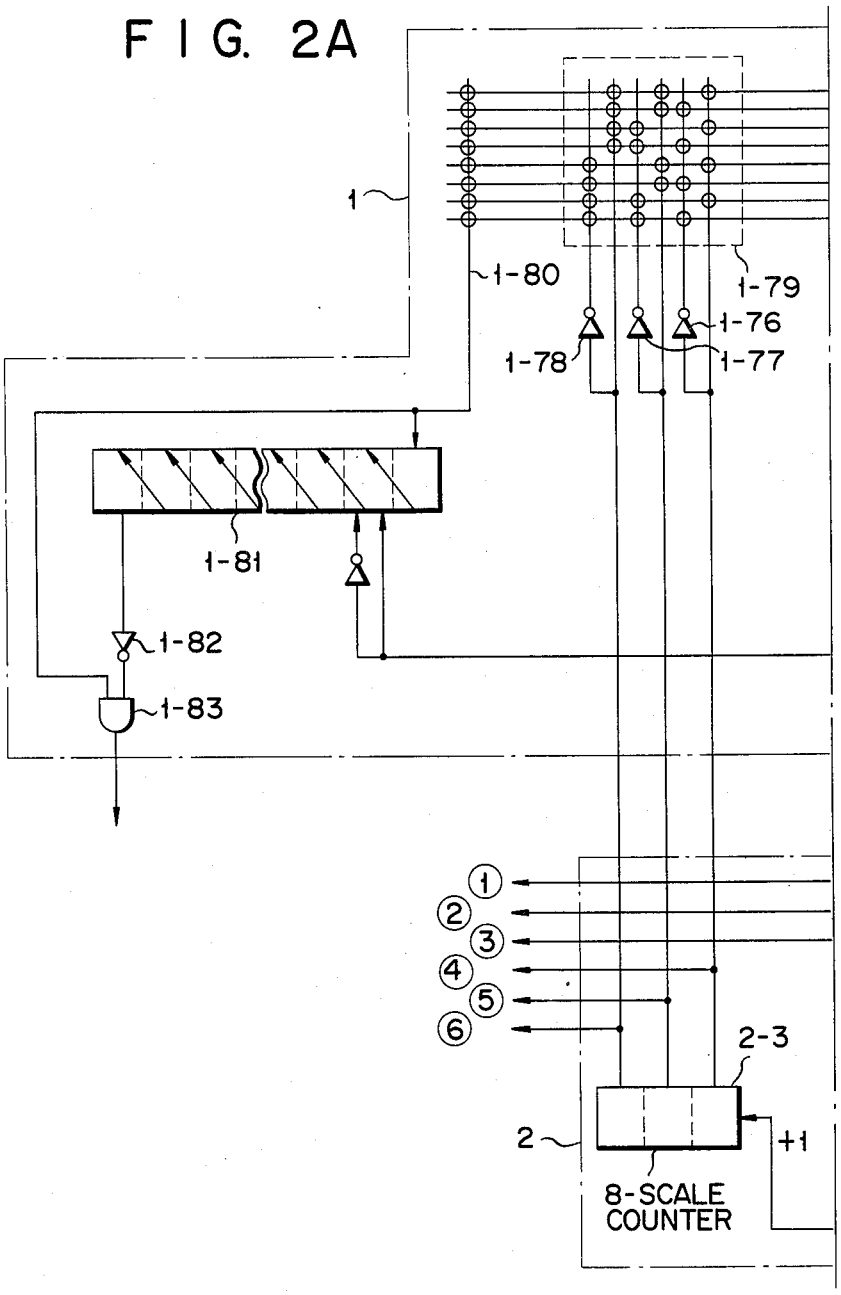
FIGS. 2A and 2B show the detailed arrangement of the performance keys and the input detection circuit of FIG. 1C.
Figure 2B:
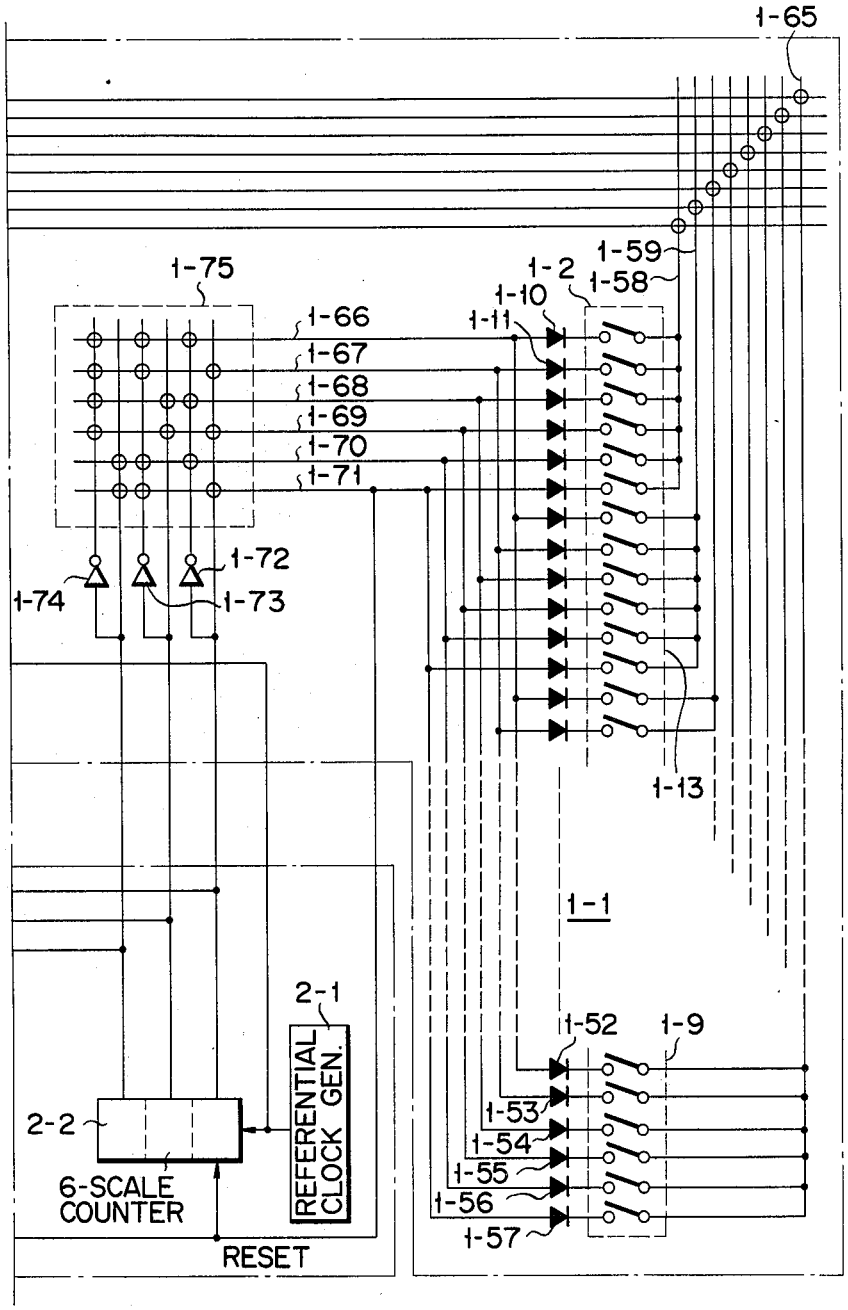

Referring to FIGS. 1A–1C, a reference numeral 1 denotes a circuit of performance keys and input detection. A key operation signal is drawn out in synchronization with a sampling signal supplied from a key-sampling circuit 2. The key sampling signal is also delivered to a code converter 3 for producing coded signals representing the elements of the respective musical instrument types preset in an electronic musical instrument, and a group of AND gates 4. The details of the performance key-input detection circuit 1 and key-sampling circuit 2 are shown in FIGS. 2A and 2B. The performance key section 1-1 comprises 48 pitch keys. These 48 pitch keys are connected in the so-called matrix form by dividing them into eight 6-key groups as 1-2 to 1-9. The performance keys are connected at one end to the corresponding diodes 1-10 to 1-57. The eight key groups 1-2 to 1-9 are connected at the other end to the corresponding output lines 1-58 to 1-65. On the input side of the diodes 1-10 to 1-57, the corresponding 6 keys (every seventh key) of the eight key groups 1-2 to 1-9 are jointly connected to constitute input lines 1-66 to 1-71.

Referential 3-bit clock pulses issued from a referential clock pulse generator 2-1 are conducted to a 6-scale counter 2-2 which counts a number of said clock pulses expressed as "000" to "101" of the binary codes. Every bit output is supplied to a decoder 1-75 directly and through inverters 1-72 to 1-74. The decoder 1-75 issues a timing signal to the input lines 1-66 to 1-71 in succession, each time a count made by the 6-scale counter 2-2 is advanced. The timing signal samples the tones generated by the six keys constituting the respective key groups 1-2 to 1-9. A timing signal sent forth from the decoder 1-75 to the input line 1-71 resets the 6-scale counter 2-2 when it makes a binary count "101". This timing signal is further supplied to an 8-scale 3-bit binary counter 2-3 as a signal instructing an advance of [+1]. Every bit output from said 8-scale counter is conducted to a decoder 1-79 directly and through inverters 1-76 to 1-78. Key operation signals are generated by a combination of a timing signal supplied from the 6-scale counter 2-2 and a timing signal delivered from the 8-scale counter 2-3. 48 different timing signals corresponding the number of performance keys are supplied to an OR output line 1-80. The key operation signals sent forth to the OR output line are further carried to the initial input side of a shift register 1-81 having 48 bit position corresponding to the number of the performance keys. The key operation signals are shifted upon receipt of a referential clock pulse from the referential clock pulse generator 2-1. An output signal from the final output side of the shift register 1-81 and a signal inverted from said output signal by an inverter 1-82 are delivered from the OR output line 1-80 to an AND gate 1-83. A timing signal for an operated key is produced once through the AND gate 1-83, regardless of how long the key is operated.

A 3-bit output signal from the 6-scale counter 2-2 and a 3-bit output signal from the 8-scale counter 2-3 are supplied in parallel to the code converter 3 and the AND gate group 4 as logic pitch data corresponding to the respective pitch keys. FIG. 3 indicates relationship between the respective pitch keys, the logic pitch data and the frequencies of the corresponding clock pulses.

A signal produced by the operation of a performance key and a key timing signal issued from the AND gate 1-83 of the input detection circuit 1 are supplied to one of the input terminals of AND gates 5, 6 respectively. The other input terminal of the AND gate 6 is supplied with an output signal from a binary counter 8 which generates an inverted output signal, each time a musical instrument type-selecting key 7 is operated. An output signal from the binary counter 8 which has passed through an inverter 9 is conducted to the other input terminal of the AND gate 5. The musical instrument type-selecting key 7 acts as a switch for causing the pitch key to be used as the original performance key or a key for selecting the musical instrument type being played. A key timing signal is issued from the AND gate 5, where the binary counter 8 produces an output signal having a logic level of "0" due to the nonselecting condition of the musical instrument type-selecting key 7. A key timing signal is sent forth from the AND gate 9, where the binary counter 8 generates an output signal having a logic level of "1" due to the selecting condition of the musical instrument type-selecting key 7. Where the musical instrument type is to be selected, the binary counter 8 is made to produce an output signal having a logic level of "1" by operating the musical instrument type-selecting key 7. At this time a lamp 10 is lighted. An output signal from the binary counter 8 is supplied as a gate signal to the AND gate group 11. An output signal from the inverter 9 is delivered as a gate signal to the AND gate group 4. A key timing signal issued from the AND gate 6 is supplied as a write-synchronization signal to a memory circuit 12 for storing coded signals representing the elements of a musical tone, that is, for storing in parallel output coded signals from the code converter 3. The code converter 3 converts into a 12-bit coded signal representing the elements of a musical tone ($A_1$, $A_2$, $B_1$, $B_2$, $B_4$, $C_1$, $C_2$, $C_4$, $C_8$, $C_{16}$, $D_1$, $D_2$) a 7-bit input code consisting of 6-bit output signals from the respective stages of the 6-scale and 8-scale counters 2-2, 2-3 of the key sampling circuit 2 and a 1-bit output signal from a binary counter 14 whose operation is reversed upon receipt of a signal denoting the operation of a switch 13 for selecting a musical tone. The 12 bit coded output signal controls a fundamental waveform, tone volume envelope, filter and octave shift all constituting the element of a musical tone. Of the above-mentioned twelve bit codes, the two bit codes $A_1$, $A_2$ are used as signals (A) for instructing the later described three different filters. The three bit codes $B_1$, $B_2$, $B_4$ act as signals (B) for instructing the later described five different envelopes. The five bit codes $C_1$, $C_2$, $C_4$, $C_8$, $C_{16}$ constitute signals (C) for instructing the later described eight different changes in the waveform of a musical tone. The two bit codes $D_1$, $D_2$ are used to instruct the later described three different octables of the high, medium and low levels. Where twelve bit codes are supplied in parallel to the respective circuits, then it is possible to make a selection from among 810 ($3\times5\times18\times3$) different musical tones at maximum. An output signal from the binary counter 14 is also supplied to a lamp 15, which is lighted when said output signal has a logic level of "1". Where the musical tone-selecting switch 13 is out of operation, and the binary counter 14 generates an output signal having a logic level of "0", then 48 different musical tones are selected by 6-bit output signals (1) to (6) supplied from the key sampling circuit 2 which correspond to the operation of the 48 pitch keys. Where the binary counter 14 produces an output having a logic level of "1" due to the operation of the musical tone-selecting switch 13, then a 7-bit output signal is generated which consists of the 6-bit output signals (1) to (6) and a 1-bit output signal from the binary counter 14 which produces an output signal having a logic level of "1", thereby making it possible to select 48 different musical tones. Application of the musical tone-selecting switch 13 enables 96 different musical tones to be selected by operation of 48 pitch keys.

Figure 4A:
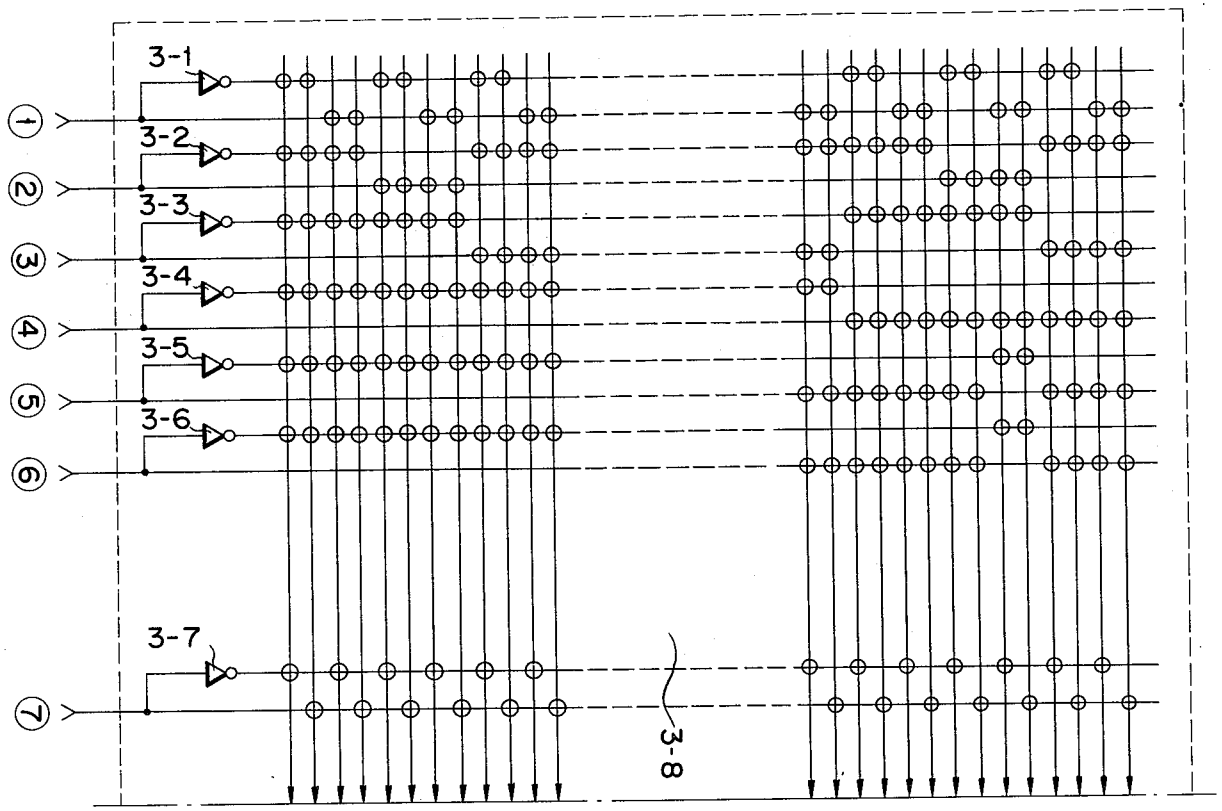
FIGS. 4A and 4B show the detailed circuit arrangement of a code converter of FIG. 1C.
Figure 4B:
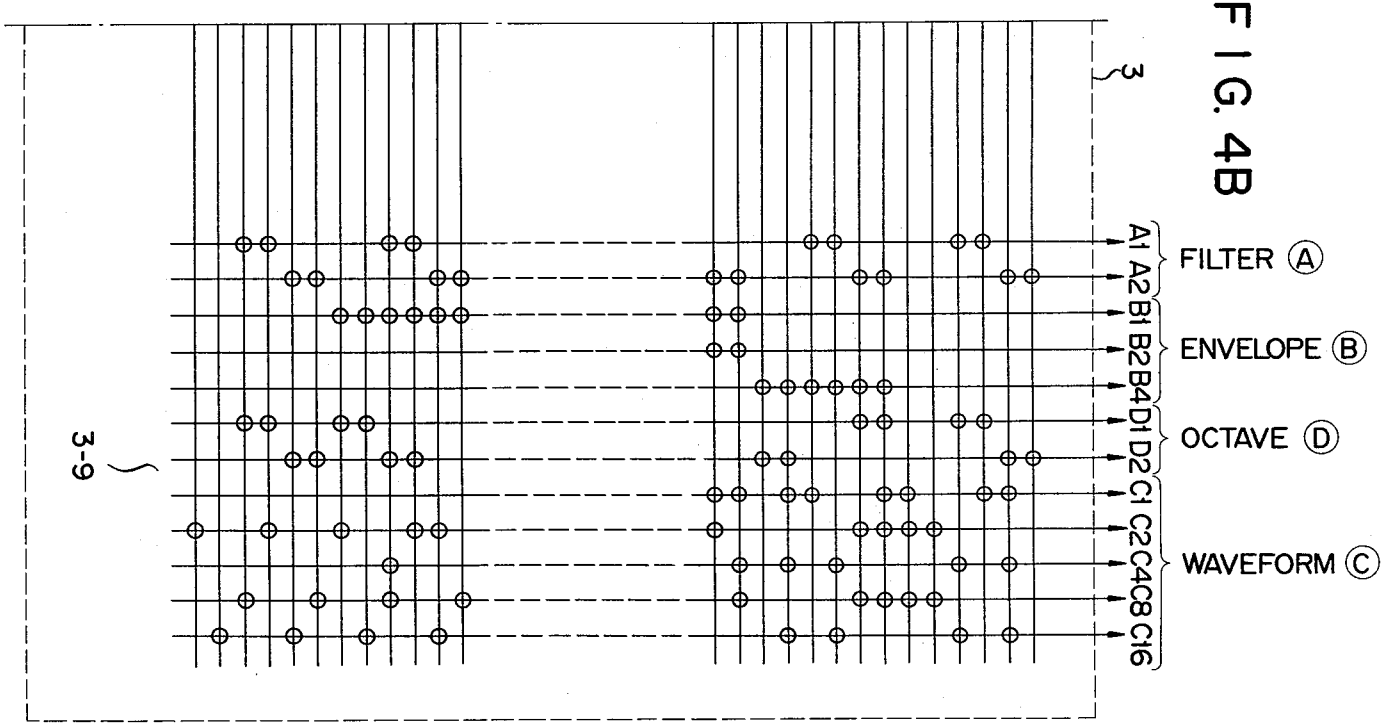

FIGS. 4A and 4B show the detailed circuit arrangement of the code converter 3. Of the aforesaid 810 different musical tones, 96 different musical tones are preset in an electronic musical instrument. 6-bit output signals (1) to (6) from the respective stages of the 6-scale counter 2-2 and 8-scale counter 2-3 of the key-sampling circuit 2 are supplied to a matrix circuit 3-8 of the AND array type. This matrix circuit 3-8 comprises 96 output lines. An output signal from each output line is conducted to a matrix circuit 3-9 of the OR array type. The respective output lines of the AND array type matrix circuit 3-8 issue different coded signals representing the elements of a musical tone.

A coded signal denoting the elements of a musical tone is designed to consist of different codes as shown in FIGS. 5A and 5B in accordance with the logic pitch data and the operation of the musical tone-selecting switch 13.

A signal produced by the operation of a musical tone-selecting key 7 is conducted to the reset terminal of an S/R flip-flop circuit 16. A $\overline{Q}$ output signal from this flip-flop circuit 16 is delivered as a reset signal through an OR gate 17 to a frequency divider 18 supplied with a clock pulse and a 3-bit shift circuit 19 to set these elements to an initial condition. The OR gate 17 is also supplied with an output signal from the AND gate 9. When said output signal rises, the frequency divider 18 and shift circuit 19 are reset. An output signal from the AND gate 9 is conducted to the set terminal of the S/R flip-flop circuit 16. When released from the reset condition, the frequency divider 18 issues an output signal, for example, at an interval of one second. This output signal is delivered as a shift instruction to the shift circuit 19. While the shift circuit 19 remains reset, an output signal having a logic level of "1" is produced from the initial bit stage **19*a*. Said output signal is successively shifted to the succeeding bit stages 19*b*, 19*c* upon receipt of a shift instruction. Output signals from the respective bit stages 19*a*, 19*b*, 19*c* of the shift circuit 19 are supplied as a gate signal to one of the input terminals of the AND gates constituting the groups 20, 21, 22. The other input terminal of the AND gates belonging said groups 20, 21, 22 are supplied with output logic pitch data from a memory circuit 23 which stores logic codes "101100", "000010" and "100010" corresponding to the pitch rotations $C_4$, $C_4^{\#}$, $D_4$. Accordingly, logic pitch data are sent forth from the AND gates of the groups 20, 21, 22 in synchronization with shifting occurring in the shift circuit 19. The output logic pitch data are supplied to the AND gate group 11 through the OR gate group 24. Output pitch data from the AND gate groups 4, 11 are written in a pitch data memory 26 through the OR gate group 25 in synchronization with an output timing signal from an OR gate 27. One of the input terminals of this OR gate 27 is supplied with an output key timing signal from the AND gate 5. The other input terminal of said OR gate 27 is supplied with an output signal from an OR gate 28 which receives an output key timing signal from the AND gate 6 and timing signals issued from the bit stages 19*b*, 19*c* of the shift circuit 19. Where a pitch key is used for performance with the musical tone-selecting key 7 left inoperative, a timing signal for the operated pitch key causes the corresponding pitch data supplied from the key sampling circuit 2 to be written in the pitch data memory 26 through the AND gate group 4 and OR gate group 25 in synchronization with an output timing signal from the AND gate 5. Where a pitch is used for selection of a musical tone with the musical tone selecting key 7 operated, then a timing signal for the pitch key operated is sent forth from the AND gates 5 and 6 and supplied as a write-synchronization signal to the pitch data memory 26 through the OR gates 27, 28. As a result, a logic code of, for example, the "$C_4$" pitch stored in the memory circuit 23 is written in the pitch data memory 26 through the AND gate group 20, OR gate group 24, AND gate group 11 and OR gate group 25 in turn. Each time shifting takes place in the shift circuit 19 upon receipt of a shift instruction from the frequency divider 18, a write-synchronization signal is produced through the OR gate 28. Accordingly, the logical codes of the pitches "$C_4^{\#}$" and "$D_4$" stored in the memory circuit 23 are written in the pitch data memory 26. Pitch tones represented by the "$C_4$", "$C_4^{\#}$", "$D_4$" are successively issued as sample tones in accordance with the musical tone elements read out of the memory circuit 12** for storing the coded signals of musical tone elements.

Logic pitch data read out of the logic pitch data memory 26 controls a pitch clock pulse generator 29, which selectively sends forth a pitch clock pulse having a frequency corresponding to the logic pitch data read out of the memory 26. The output pitch clock pulse is supplied to a step address counter 30 which advances a counted number of pitch clock pulse signals having various frequencies. According to the embodiment of this invention, the step address counter 30 is formed of a 5-bit 32-scale binary counter, which can count 32 steps of [0] to [−] of the decimal scale (expressed by binary codes of "00000" to "11111"). The respective counted numbers of the 32 steps correspond to the addresses constituting one cycle of a musical tone wave.

The character I of FIG. 1A is a tone volume control section. This section increases or decreases an amplitude over a range of [0] to [15] upon receipt of a clock pulse representing any of three periods shown in FIG. 6, namely, an increase period (hereinafter simply referred to as "an increase"), a transform period (hereinafter simply referred to as "a transform") and a decrease period (hereinafter simply referred to as "a decrease").

Figure 6:
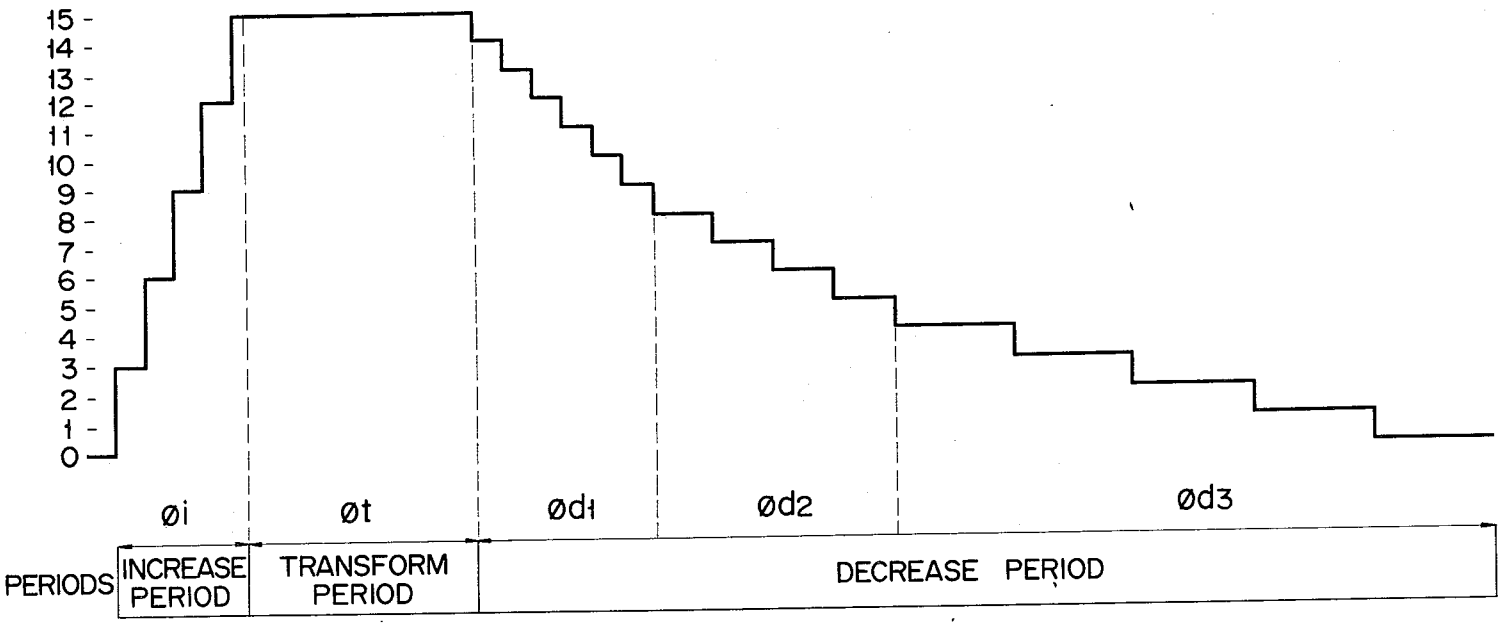
FIGS. 6, 7 and 8 indicate the envelope forms used in FIGS. 1A–1C.
Figure 7:
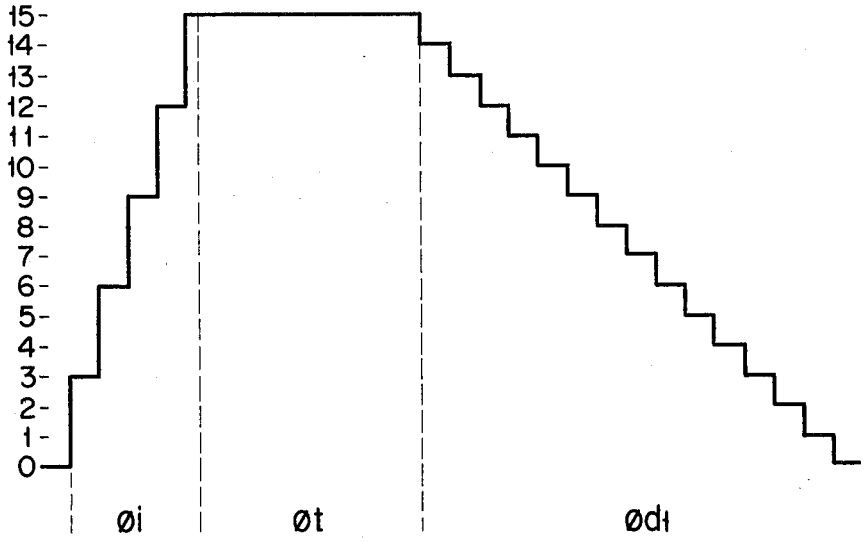
Figure 8:
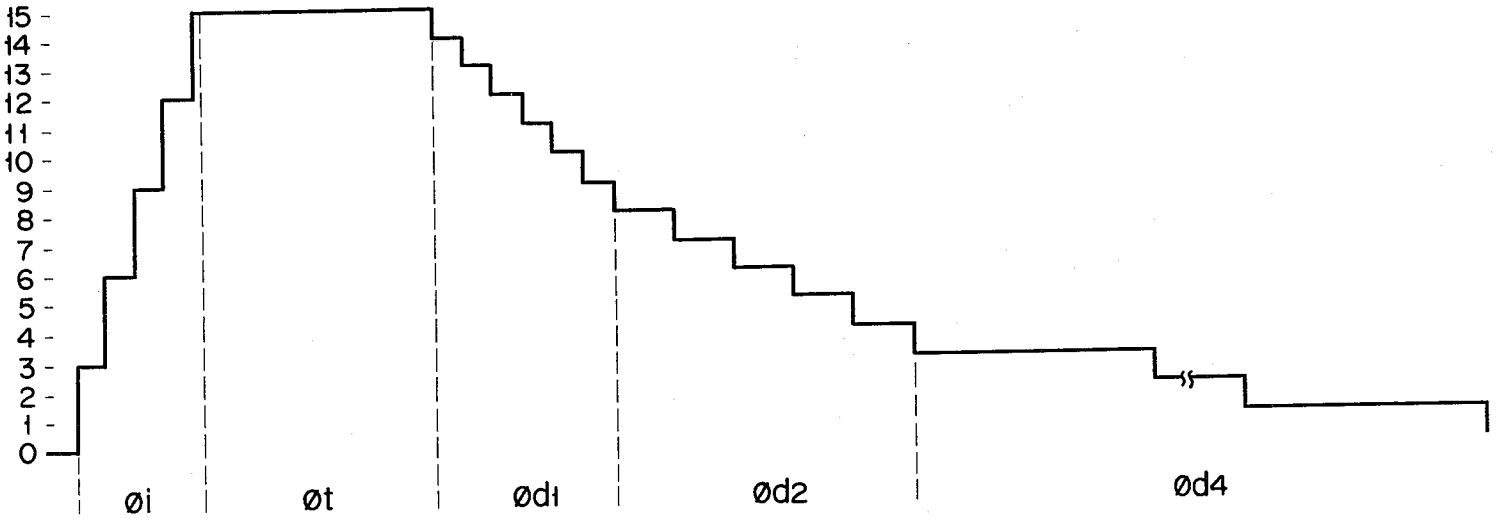

A memory section 31 for storing the above-mentioned three periods is set to the state of the increase when a pitch key is operated in the performance key-input detection circuit 1. During the increase state, an increase clock pulse $\phi i$ delivered from a period clock pulse generator 32 is supplied as a signal instructing an advance of [+3] to an amplitude value counter 34 through an amplitude value-instruction section 33. During the increase period, therefore, a value counted by the amplitude value counter 34 is increased up to [15] in five stages at the increment rate of 3 steps or levels. Where the amplitude value counter 34 counts a maximum number of [15], then the period memory section 31 is set to the transform state. As detailed later, the transform period is that during which one of two specified tone waveforms is slowly changed into the other mainly to produce a tone color. To effect said change of tone waveforms, the amplitude value-instructing section 33 conducts a transform clock pulse $\phi t$ issued from the period clock pulse generator 32 to the amplitude value counter 34. When the change of tone waveforms is brought to an end during the transform period, then the period memory section 31 is set to the decrease state. The amplitude value-instructing section 33 conducts, for example, three different decrease clock pulses $\phi d_1$, $\phi d_2$ $\phi d_3$ issued from the period clock pulse generator 32 to the amplitude value counter 34. Where, during the decrease period, the amplitude value-instructing section 33 sends forth a down-counting instruction, then down counting is effected for each step from [15] to [9] by a decrease clock pulse $\phi d_1$, from [8] to [5] by a decrease clock pulse $\phi d_2$, and from [4] to [0] by a decrease clock pulse $\phi d_3$. A pitch clock pulse obviously has a far higher frequency than the increase clock pulse $\phi i$, transform clock pulse $\phi t$ and decrease clock pulse $\phi d_1$, $\phi d_2$, $\phi d_3$. The amplitude value-instructing section 33 is supplied with an envelope-instructing signal (B) read out of the memory circuit 12 for storing the coded signals of tone elements. The envelope-instructing signal (B) is of the 3-bit type used to specify one of five different envelopes. FIGS. 6, 7 and 8 show three typical ones of said five different envelopes. An envelope-instructing signal having a logic code of "100" specifies the envelope pattern of FIG. 6. An envelope-instructing signal having a logic code of "000" designates the envelope pattern of FIG. 7. An envelope-instructing signal having a logic code of "110" specifics the envelope of FIG. 8. Obviously, envelope-instructing signals having logic codes of "110" and "001" (not shown) specify other types of envelope than those shown in FIGS. 6, 7 and 8. The frequencies of decrease clock pulse $\phi d_1$, $\phi d_2$, $\phi d_3$, $\phi d_4$ have the following relationship as indicated in the order of higher frequencies:

$$\phi d_1 > \phi d_2\ (=\phi d_1/2) > \phi d_3\ (=\phi d_1/4) > \phi d_3\ (=\phi d_1/8)$$

The character II of FIG. 1B represents a tone wave-generating section. Eighteen waveform-specifying codes are stored in the memory circuit 12 for storing the coded signals of tone elements. A waveform-controlling section 35 which is supplied with a tone wave change-instructing signal (C) corresponding to any of said eighteen waveform-specifying codes changes a tone waveform into a desired type. A tone signal whose waveform has thus been changed is issued from an addition-subtraction section 37 through an addition-subtraction-controlling section 36. The waveform-controlling section 35 is supplied with a count made by the step address counter 30, a count made by the amplitude value counter 34 of the tone volume-controlling section I, data stored in the period memory section 31, and an output signal from an octave shift circuit 38 which instructs a low, medium or high octave. A comparator 39 compares a step count made by the step address counter 30 with an amplitude value counted by the amplitude value counter 34 to determine a difference or coincidence between both counts. An output signal from this comparator which denotes the result of said comparison is also conducted to the waveform-controlling section 35. The octave shift circuit 38 is supplied with a count made by the step address counter 30 and eighteen tone waveform change-instructing signals (C) read out of the memory circuit 12 for storing the coded signals of tone elements, and sends forth an instruction for specifying a high, medium or low octave. A count made by the amplitude value counter 34 is also supplied to the addition-subtraction-controlling section 36. In the tone waveform generating section II, the fundamental tone waveform designated by the tone waveform change-instructing signal (C) is gradually changed into a prescribed type during any of the aforesaid increase, transform and decrease periods.

Figure 9A:
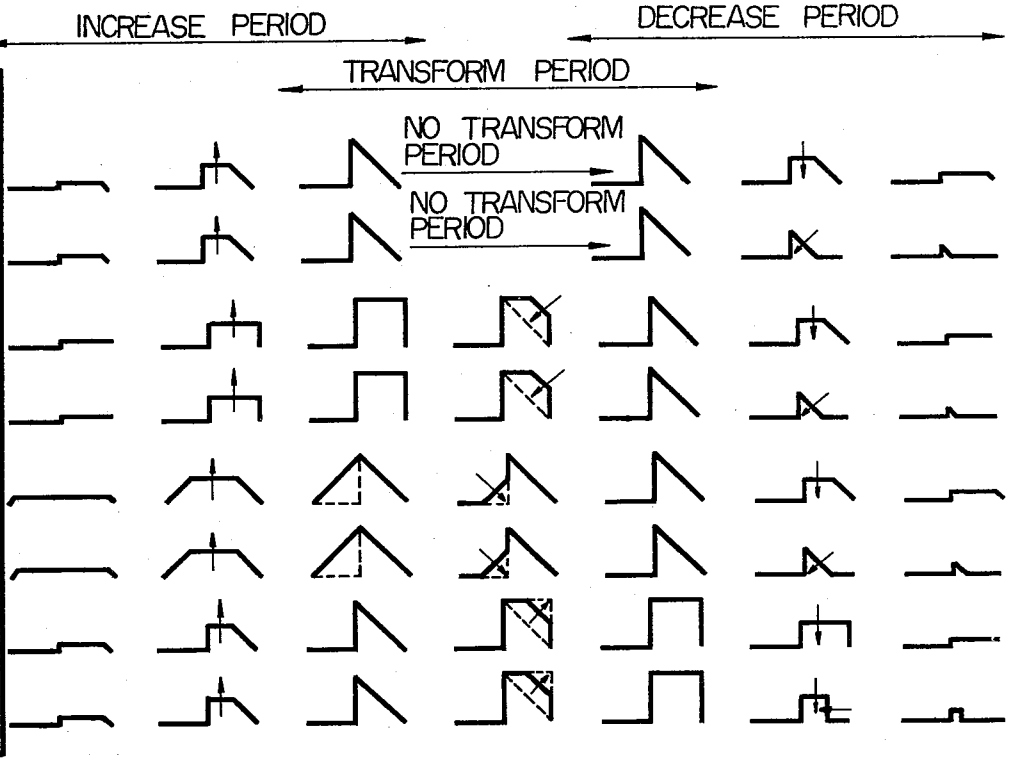
FIGS. 9A and 9B set forth the models of different waveforms used in this invention.
Figure 9B:
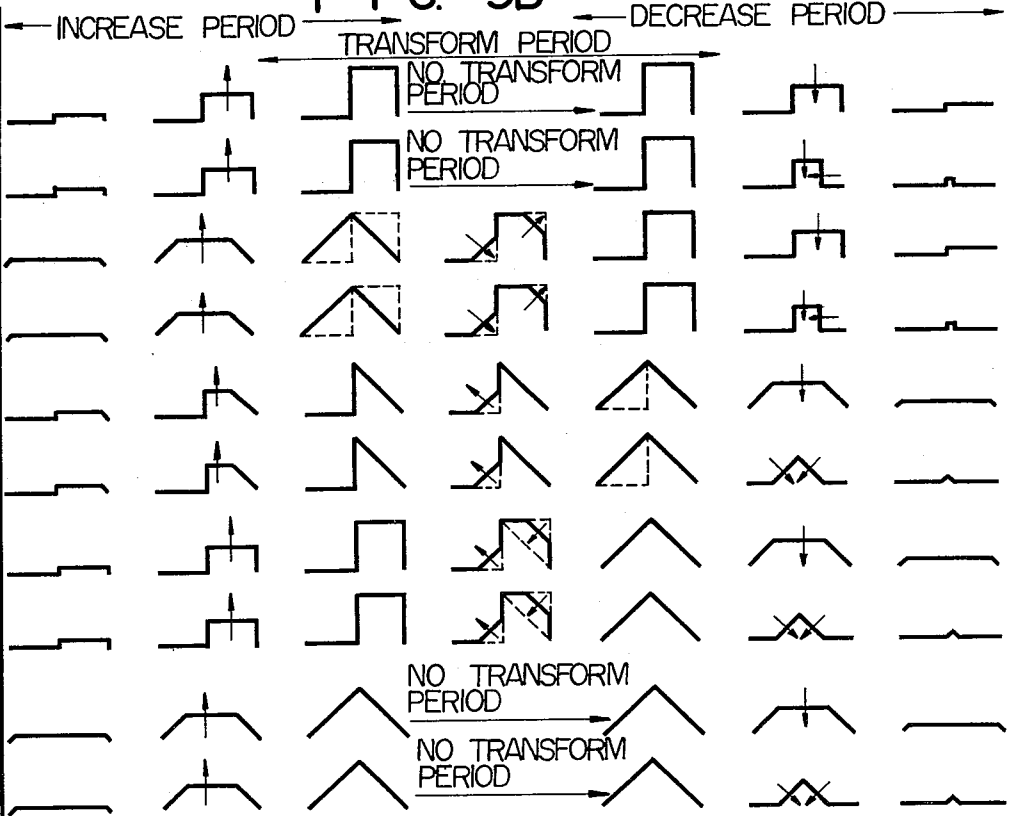

There will now be described by reference to FIGS. 9A and 9B the kinds of tone waveform changes and the manner in which the tone waveforms are changed. FIGS. 9A and 9B schematically indicate how the tone waveforms change upon receipt of a tone waveform change-instructing signal (C) during the increase, transform and decrease periods. Fundamentally, it is possible to specify eighteen distinct waveforms which are denoted by waveform numbers given in FIGS. 9A and 9B. These waveform numbers are expressed by the corresponding logic codes consisting of 5 bits (each bit being weighted by 1, 2, 4, 8, 16 respectively). A bit having a weight of [1] indicates a fixed waveform change or floating waveform change occurring during the decrease period. The fixed waveform change denotes a waveform whose top portion is cut during the initial stage of the decrease period in accordance with an amplitude value counted by the amplitude value counter 34. The floating waveform change represents a waveform which retains the form appearing in the initial stage of the decrease period and relatively decreases in amplitude and pulse width under control of the counted amplitude value. The bits having a weight of [2] (lower) and a weight of [4] (upper) denote waveforms in the final stage of the increase period (waveforms in the initial stage of the transform period). The bits having a weight of [8] (lower) and a weight of [16] (upper) show waveforms in the initial stage of the decrease period (waveforms in the final stage of the transform period). For the increase or decrease period, logic codes formed of combinations of two bits having upper and lower weights indicate the fundamental waveforms as shown in Table 1 below.

TABLE 1

| | Waveform-specifying code | |
|---|---|---|
| | Upper | Lower |
| Sawtooth wave | 0 | 0 |
| Rectangular wave | 0 | 1 |
| Triangular wave | 1 | 0 |

During the increase period, the specified forms of the sawtooth, rectangular and triangular waves undergo only the fixed change as a result of an increase in a counted amplitude value. In this case, a waveform gradually grows larger to define any of the above-mentioned fundamental waveforms when a counted amplitude value indicates a maximum number of [15]. A waveform appearing in the initial stage of the transform period is gradually changed in the direction of the indicated arrow into a waveform defined in the initial stage of the decrease period.

A waveform whose number is expressed as [00] grows larger in the direction of the indicated arrow, each time an amplitude value counted by the counted value counter 34 increases. When the counted amplitude value reaches a maximum number of [15], then a sawtooth wave is produced. Later, the increase period is immediately followed by the decrease period due to the absence of the transform period. The sawtooth wave is gradually changed in the fixed mode, each time the amplitude value counter 8 carries out down-counting. A waveform whose number is expressed as [01] differs from the waveform of [00] only in that during the decrease period the waveform of [01] is changed in the floating mode. A waveform whose number is expressed as [02] takes a rectangular pattern in the final stage of the increase period. Said rectangular waveform is converted into a sawtooth wave in the final stage of the transform period. Said sawtooth wave is changed in the fixed mode during the decrease period. The other waveforms whose numbers expresses as [03] to [05], [10] to [15], [20] to [25] are changed as illustrated in FIGS. 9A and 9B.

Waveforms produced by the tone wave-generating section II are sent forth as musical tones from an output tone-generating section 42 provided with a speaker through a D/A converter 40 and filter 41. The filter 41 is controlled by the filter-specifying bit codes $A_1$, $A_2$ read out of the memory circuit 12 to produce tones representing the characteristics of musical instruments provided with acoustics such as those of resonance, residual tones and transmission. One of those filters designed to generate such characteristic tones is selected by a filter-specifying signal (A) read out of the memory circuit 12 for storing the coded signals of tone elements.

Figure 10A:
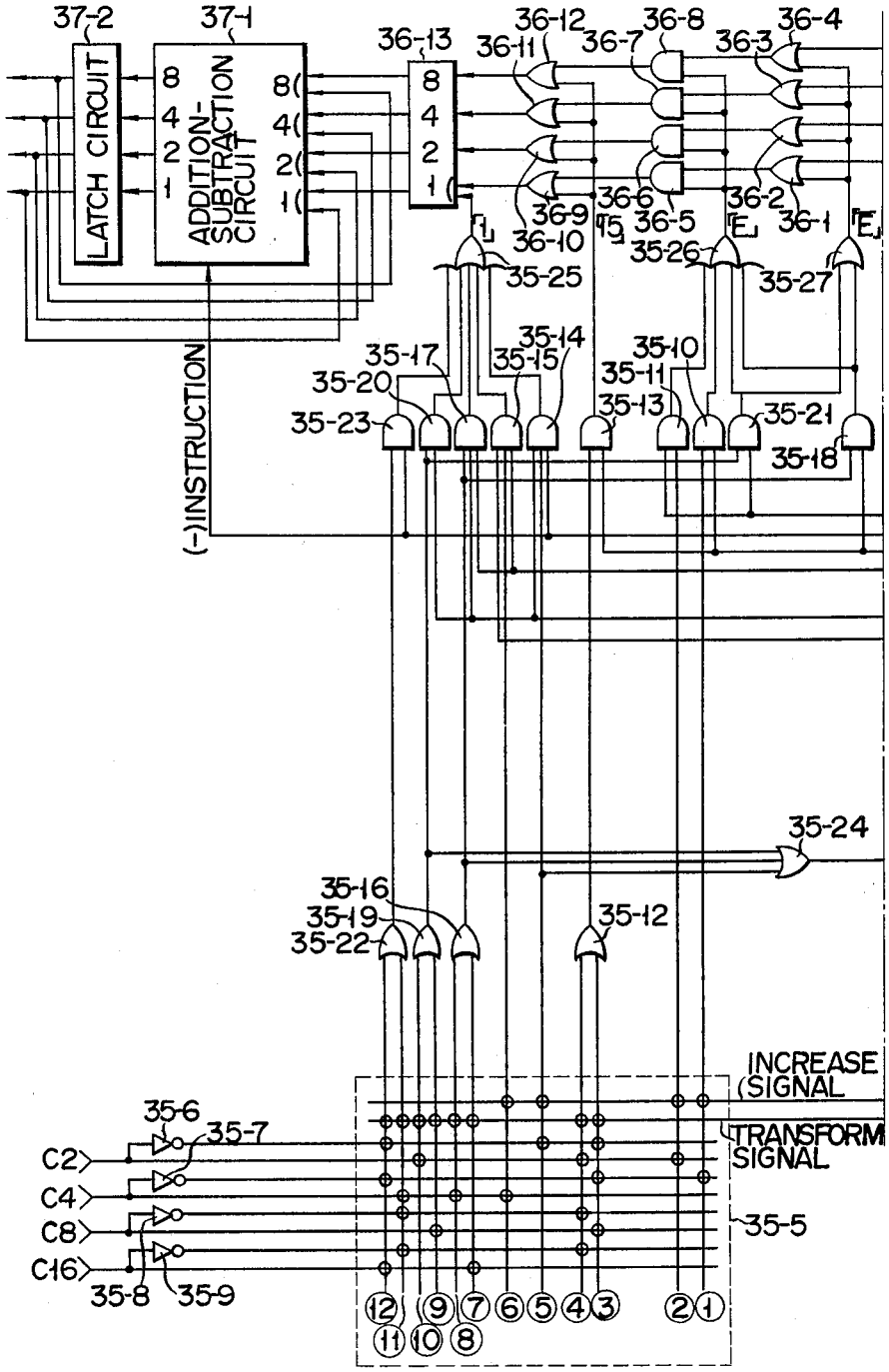
FIGS. 10A and 10B show the arrangement of a fundamental circuit for producing changes in the waveforms of signals during the increase and transform periods of FIGS. 9A and FIG. 9B.
Figure 10B:
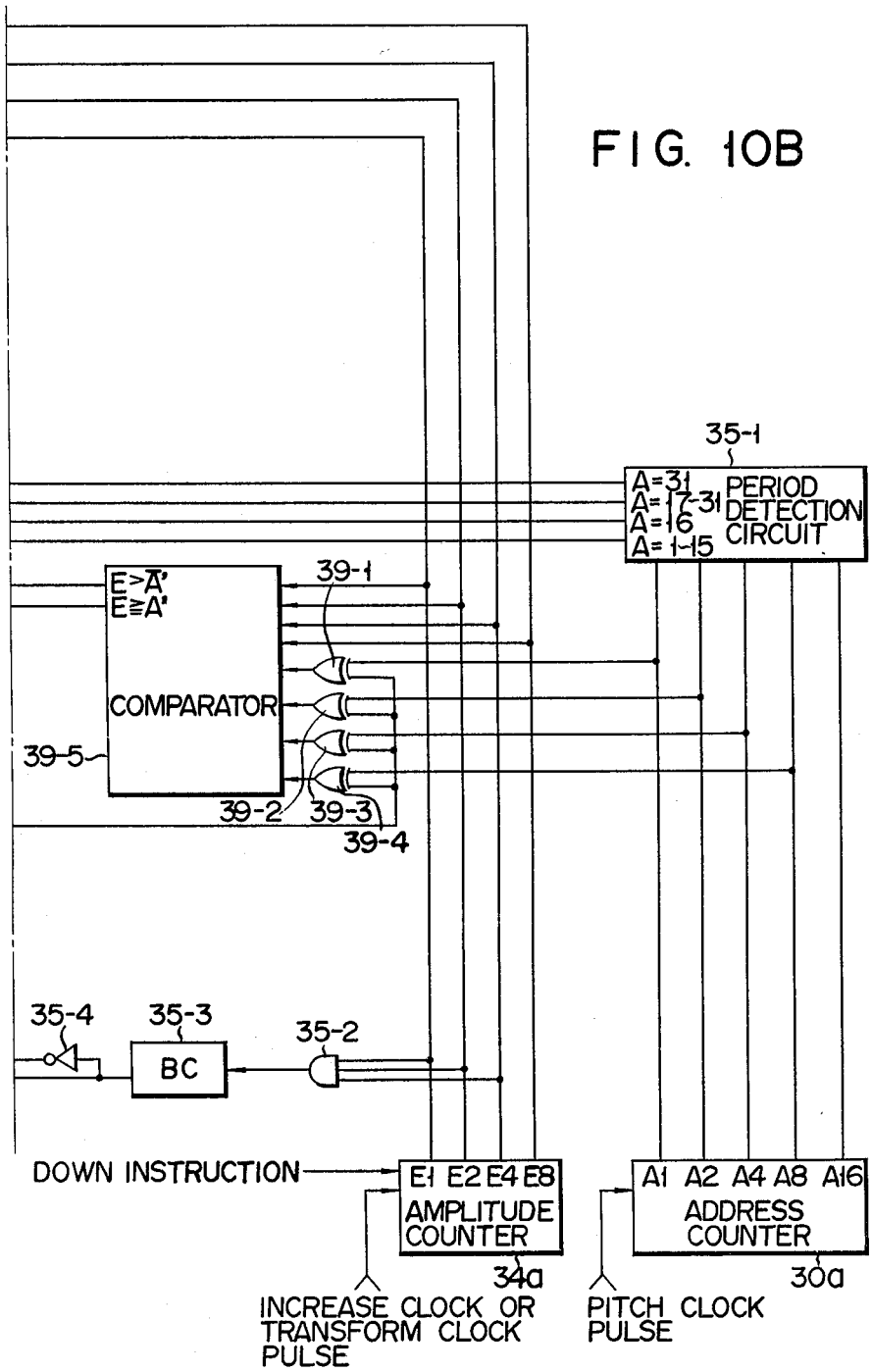

There will now be described a fundamental circuit arrangement for producing the tone waveforms of FIGS. 9A and 9B. FIGS. 10A and 10B show a fundamental circuit by which the waveforms are changed during the increase and transform periods. Reference numeral 30*a* denotes a step address counter (hereinafter referred to as "an address counter") which is supplied with a pitch clock pulse issued from the pitch clock pulse generator 29 of FIG. 1B whose frequency corresponds to a pitch key operated for performance. This address counter is a 32-scale binary counter for counting members of [0] to [31] which are expressed by 5-bit codes as "00000" to "11111" and which represent $A_1$, $A_2$, $A_4$, $A_8$, $A_{16}$. Tone waveforms are produced while the address counter 30*a* makes 32-scale counts. These counts represent a number of addresses (A) constituting one cycle of a tone waveform. A period detection circuit 35-1 sents forth a signal denoting a counted number of [31] (corresponding to the address 31), signals denoting counted numbers of [17] to [31] (corresponding to the addresses 17 to 31), a signal showing a counted number of [16] (corresponding to the address 16, and signals indicating counter numbers of [1] and [15] (corresponding to the addresses 1 to 15). A reference numeral 34*a* is a 16-scale binary amplitude value counter (hereinafter referred to as "an amplitude counter") designed to count a number of increase clock pulses $\phi_1$ issued during the increase period from the amplitude value-instructing section 33 of FIG. 1A and a number of transform clock pulses $\phi t$ delivered during the transform period from said amplitude value-instructing section 33, said numbers corresponding to $E_1$, $E_2$, $E_3$, $E_4$ and expressed by 4-bit codes as "0000" to "1111". A 4-bit parallel output signal from the amplitude counter 34*a* is supplied to an AND gate 35-2 for detecting an amplitude value of [15]. The resultant output detection signal from said AND gate 35-2 drives a binary counter 35-3, from the output terminal of which a signal having a logic level of "1" is read out. An output signal from the binary counter 35-3 initially has a logic level of "0". Accordingly, an inverter 35-4 generates a signal representing the increase period (hereinafter referred to as "an increase signal"). Where an output signal from the binary counter 35-3 has a logic level of "1", then the inverter 35-4 generates a signal denoting the transform period (hereinafter referred to as "a transform signal"0. Both increase and transform signals are supplied to a matrix circuit 35-5 having an AND function. The matrix circuit 35-5 selects the waveforms of the increase and transform signals. The waveform is specified by a tone wave change-instructing signal (C) issued from the memory circuit 12 of FIG. 1C for storing the coded signals of tone elements. The increase and transform signals are specified by the waveform-specifying bit codes $C_2$, $C_4$, $C_8$, $C_{16}$ having weights of 2, 4, 8, 16 respectively (FIGS. 9A and 9B). Of eighteen waveform changes, nine waveforms are specified by said bit codes $C_2$, $C_4$, $C_8$, $C_{16}$ (because no specification is made of the fixed and floating modes of waveform changes during the decrease period). Output signals from the memory circuit 12 for storing the coded signals of tone elements which represent the bit codes $C_2$, $C_4$, $C_8$, $C_{16}$ are supplied to the matrix circuit 35-5 directly and through inverters 35-6 to 35-9. Waveform signals are selectively produced from the output terminals (1) to (12) of the matrix circuit 35-5 during the increase and transform periods in accordance with the waveform-specifying codes, as shown in Table 2 below.

TABLE 2

| Waveform No. | Bit Codes $C_{16}$ | $C_8$ | $C_4$ | $C_2$ | Increase output | Waveform | Transform output | Waveform change |
|---|---|---|---|---|---|---|---|---|
| 00-01 | 0 | 0 | 0 | 0 | (1) (5) | sawtooth | | |
| 02-03 | 0 | 0 | 0 | 1 | (1)(2) | rectangular | (4)(10) | rectangular→sawtooth |
| 04-05 | 0 | 0 | 1 | 0 | (5)(6) | triangular | (8)(11) | triangular→sawtooth |
| 10- | | | | | | | | |

TABLE 2-continued

| Waveform No. | Bit Codes $C_{16}$ | $C_8$ | $C_4$ | $C_2$ | Increase output | Waveform | Transform output | Waveform change |
|---|---|---|---|---|---|---|---|---|
| 11 | 0 | 1 | 0 | 0 | (1) (5) | sawtooth | (2) (9) | sawtooth→rectangular |
| 12-13 | 0 | 1 | 0 | 1 | (1) (2) | rectangular | | |
| 14-15 | 0 | 1 | 1 | 0 | (5) (6) | triangular | (8) (9) | triangular→rectangular |
| 20-21 | 1 | 0 | 0 | 0 | (1) (5) | sawtooth | (7) (12) | sawtooth→triangular |
| 22-23 | 1 | 0 | 1 | 0 | (1) (2) | rectangular | (7) (10) | rectangular→triangular |
| 24-25 | 1 | 0 | 1 | 0 | (5) (6) | triangular | | |

The output terminal (1) of the matrix circuit 35-5 is connected to an AND gate 35-10; the output terminal (2) to an AND gate 11; the output terminals (3), (4) to an AND gate 35-13 through an OR gate 35-12; the output terminal (5) to an AND gate (14); the output terminal (6) to an AND gate 35-15; the output terminals (7), (8) to AND gates 35-17, 35-18 through an OR gate 35-16; the output terminals (9), (10) to an AND gate 35-20, 35-21 through an OR gate 35-19; and the output terminals (11), (12) to an AND gate 35-23 through an OR gate 35-22. An output signal from the output terminal (5) of the matrix circuit 35-5, and output signals from the OR gate 35-16, 35-19 are supplied through an OR gate 24 to one of the input terminals of exclusive OR gates (hereinafter referred to as "EX OR gates") 39-1 to 39-4. The other input terminals of said EX OR gates are supplied with output 4-bit codes $A_1$, $A_2$, $A_4$, $A_8$ of the address counter 30*a*. Output signals from the EX OR gates 39-1 to 39-4, together with output bit codes of $E_1$, $E_2$, $E_4$, $E_8$ from the amplitude counter 34*a*, are conducted to a comparator 39-5. This comparator compares an amplitude value E counted by the amplitude value counter 34*a* with a counted step number A' delivered from the address counter 30*a* which are expressed by the 4-bit codes $A_1$, $A_2$, $A_4$, $A_8$. Where the counted step number A' is smaller than or equal to the counted amplitude value E, then the comparator 39-5 produces a signal denoting [$E \geqq A'$]. Where a complementary number $\overline{A'}$ to a counted amplitude value A' of [15] is smaller than the counted amplitude value E, then the comparator 39-5 issues a signal showing [$E > \overline{A'}$]. An output signal of [$E \geqq A'$] from the comparator 39-5 is supplied to the input side of the AND gate 35-15. An output signal of [$E > \overline{A'}$] from the comparator 39-5 is conducted to the input side of the AND gates 35-14, 35-17, 35-20. An output signal from the period detection circuit 35-1 which denotes the address $A_{31}$ is sent forth to the input side of the AND gates 35-11, 35-21. An output signal from said period detection circuit 35-1 which represents the addresses 17 to 31 is supplied to the input side of the AND gates 35-14, 35-20, 35-23 and also as a subtraction-instructing signal to the addition-subtraction circuit 37-1 constituting the addition-subtraction section 37 of FIG. 1A. An output signal from said period detection circuit 35-1 which denotes the address $A_{16}$ is delivered to the input side of the AND gates 35-10, 35-13, 35-18. An output signal from said period detection circuit 35-1 which shows the addresses $A_1$ to $A_{15}$ is carried to the input side of the AND gates 35-15 and 35-17. Output signals from the AND gates 35-14, 35-15, 35-17, 35-20, 35-23 are supplied as a signal instructing the addition or subtraction of [1] through the OR circuit 35-25 to the addition-subtraction circuit 37-1. An output signal from the AND gate 35-13 is delivered as a signal instructing the addition or subtraction of [15] to said addition-subtraction circuit 37-1. Output signals from the AND gates 35-10, 35-11. 35-18, 35-21 are conducted through the OR gate 35-26 to be used as a signal instructing the counted amplitude value [E]. Output signals from the AND gates 35-18, 35-21 ae issued through the OR gate 35-27 to be used as a signal instructing the amplitude value [$\overline{E}$]. This value [$\overline{E}$] is taken to be a number complimentary to the counted amplitude value of [15]. Output bit codes $E_1$, $E_2$, $E_4$, $E_8$ from the amplitude counter 34*a* having weights of 1, 2, 4, 8 respectively are supplied to the one input side of the corresponding EX OR gates 36-1, 36-2, 36-3, 36-4, the other input side of which is supplied with an output signal from the OR gate 35-27 which instructs the counted amplitude value [$\overline{E}$]. Output signals from the EX OR gates 36-1 to 36-4 are conducted to the one input side of the OR gates 36-9, 36-10, 36-11, 36-12, the other input side of which is supplied with an output signal from the AND gate 35-13 which instructs the addition or subtraction of [15]. An output signal from the OR gate 36-9 and an output signal from the OR gate 35-25 which instructs the addition or subtraction of [1] are conducted to the "1" weight stage of an adder 36-13. Output signals from OR gates 36-10 to 36-12 are supplied to the "2", "4", and "8" weight stages of the adder 36-13. Output signals from the respective weight stages of the adder 36-13 are sent forth to the corresponding bit weight stages of the addition-subtraction circuit 37-1. A signal showing the result of addition or subtraction carried out by the addition-subtraction circuit 37-1 is fed back to the corresponding weight stage through a latch circuit 37-2. An output signal from the latch circuit 37-2 is conducted to the D/A converter 40 of FIG. 1A.

There will now be described the fixed mode of waveform changes occurring during the increase period in an electronic musical instrument having the above-mentioned arrangement. Now let it be assumed that the amplitude counter 34*a* and address counter 30*a* are in the initial stage in which no counting is made. At this time, the inverter 35-4 sends forth an increase signal, and the output terminal (1), (2), (5), (6) of the matrix circuit 35-5 are made ready to produce an output signal.

<A>

Figure 11:
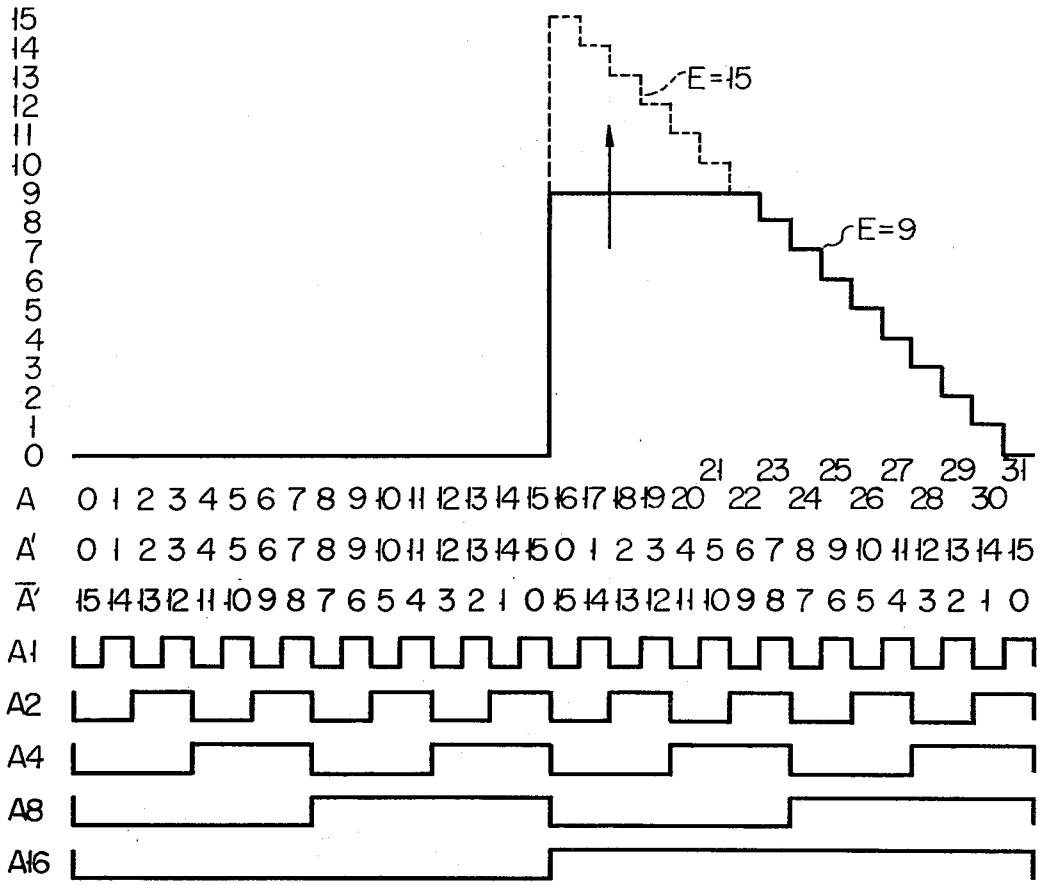
FIGS. 11, 12 and 13 respectively illustrate the processes by which a sawtooth wave, a rectangular wave and a triangular wave are formed during the increase period of FIGS. 10A and 10B.

This is an increase period in which the final waveform is the sawtooth type (refer to FIGS. 9A, 9B, Table 2, and FIG. 11).

In this case, a code of "00" is stored in the $C_2$ and $C_4$-storing sections of the memory circuit 12 for storing the coded signals of tone elements. As seen from Table 2, an output signal is sent forth from the output terminals (1), (5) of the matrix circuit 35-5. Accordingly, a gate signal is issued to the AND gates 35-10, 35-14. Where the amplitude counter 34*a* makes no counting, an amplitude-instructing signal is not produced, even if a count made by the address counter 30*a* is advanced. Now let it be assumed that the amplitude counter 34*a* counts up increase clock pulses $\phi i$ from [1], and the amplitude value E indicates [9] (bit weights $E_1$, $E_2$, $E_4$, $E_8$ are respectively represented by logic codes "1", "0", "0", "1").

<A-1>E=9

At the time of E=9, a tone waveform is progressively produced, as the address counter 30*a* counts up pitch clock pulses having a prescribed frequency. There will now be described the manner in which an output signal having a waveform indicated in solid lines in FIG. 11 is generated. While the address counter 30*a* counts a number of steps from [0] to [15], the operation of the addition-subtraction circuit 37-1 is not affected. When a step number of [16] is counted, then the period detection circuit 35-1 generates a signal denoting the detection of a counted step number of [16] representing the address $A_{16}$. An [E] instructing signal is issued to the AND gates 36-5 to 36-8 through the AND gate 35-10 and OR gate 35-26. Accordingly, an output 4-bit signal (coded as "1001") from the amplitude counter 34*a* which represents [E=9] passes in parallel through the EX OR gates 36-1 to 36-4, AND gates 36-5 to 36-8, OR gates 36-9 to 36-12 and is supplied as an instruction of addition of [9] to the addition-subtraction circuit 37-1. When the address counter 30*a* counts a number corresponding to the addresses A[17] to [22], then the AND gate 35-10 is closed. Though, at this time, a subtraction-instructing signal is generated, the AND gate 35-14 still remains closed, and consequently the output terminal of the addition-subtraction circuit 37-1 still holds an addition value of [9]. Where, as seen from FIG. 11, [E=9] denotes [$\overline{A}'$=8 to 0] which has a larger value than $\overline{A}'$, then the comparator 39-5 generates a signal representing E>$\overline{A}'$, which in turn is conducted to the AND gate 35-14. Where the address counter 30*a* counts a number corresponding to the addresses 17 to 31, then the AND gate 35-14 is opened, allowing an instruction for the subtraction of [1] to be supplied to the addition-subtraction circuit 37-1 through the OR gate 35-25 and adder 36-13. While, therefore, the address counter 30*a* counts a number corresponding to the addresses A[23] to [31], the addition value of [9] is subtracted by [1] for each step down to [0] when the addition-subtraction circuit 37-1 receives a subtraction instruction. As a result, a solid line waveform of FIG. 11 is produced.

<A-2>E=15

There will now be described the process by which the dotted line sawtooth wave of FIG. 11 is produced when the amplitude counter 34*a* counts increase clock pulses $\phi i$ up to [E=15]. As previously described, no addition is made, until the address counter 30*a* counts a number corresponding to the addresses A[0] to [15]. When the address counter 30*a* counts a number corresponding to the address 16, then the AND gate 35-10 is opened, allowing an [E] instructing signal to be delivered to the AND gates 36-5 to 36-8 through the OR gate 35-26. Thus, an amplitude value of [E=15] coded as "1111" is supplied as a signal instructing the addition of [15] to the addition-subtraction circuit 37-1 through the EX OR gates 36-1 to 36-4, AND gates 36-5 to 36-8, OR gates 36-9 to 36-12, and adder 36-13. Where the address counter 30*a* counts a number corresponding to the addresses A[17] to [31], then the AND gate 35-10 remains closed. Since, however, [E=15] becomes larger than $\overline{A}'$ (=14 to 0), the comparator 39-5 produces a signal representing [E>$\overline{A}'$], which in turn is supplied to the AND gate 35-14. Where the address counter counts a number corresponding to the addresses A[17] to [31], then the AND gate 35-14 is opened, causing an instruction for subtraction of [1] to be supplied to the addition-subtraction circuit 37-1 through the OR gate 35-25 and 36-13. Where the addresses A[17] to [31] are counted by the address counter 30*a*, then the addition value of [15] is subtracted by [1] for each step down to [0], producing a sawtooth wave shown in dotted lines in FIG. 11.

Under the items (A-3) over (A-1) and (A-2), description was made of two factors of [E=9] and [E=15]. Obviously, the same operation as mentioned above is carried out with respect to the other cases of E=1, 2, 3, 4, 5 . . . . As the amplitude value E grows larger, the waveform gradually grows larger up to a maximum amplitude value of [E=15] in the direction of the arrow indicated in FIG. 11 with the cut-off top portion of a waveform left fixed. When the maximum amplitude value of [E=15] is reached, then the initially instructed sawtooth wave is produced. In the case of FIGS. 6, 7 and 8, counts made by the amplitude counter 34*a* are advanced at the rate of [+3], each time an increase clock pulse $\phi i$ is received. Therefore, a waveform is quickly grown into a sawtooth wave in the sharp stepwise form.

<B>

Figure 12:
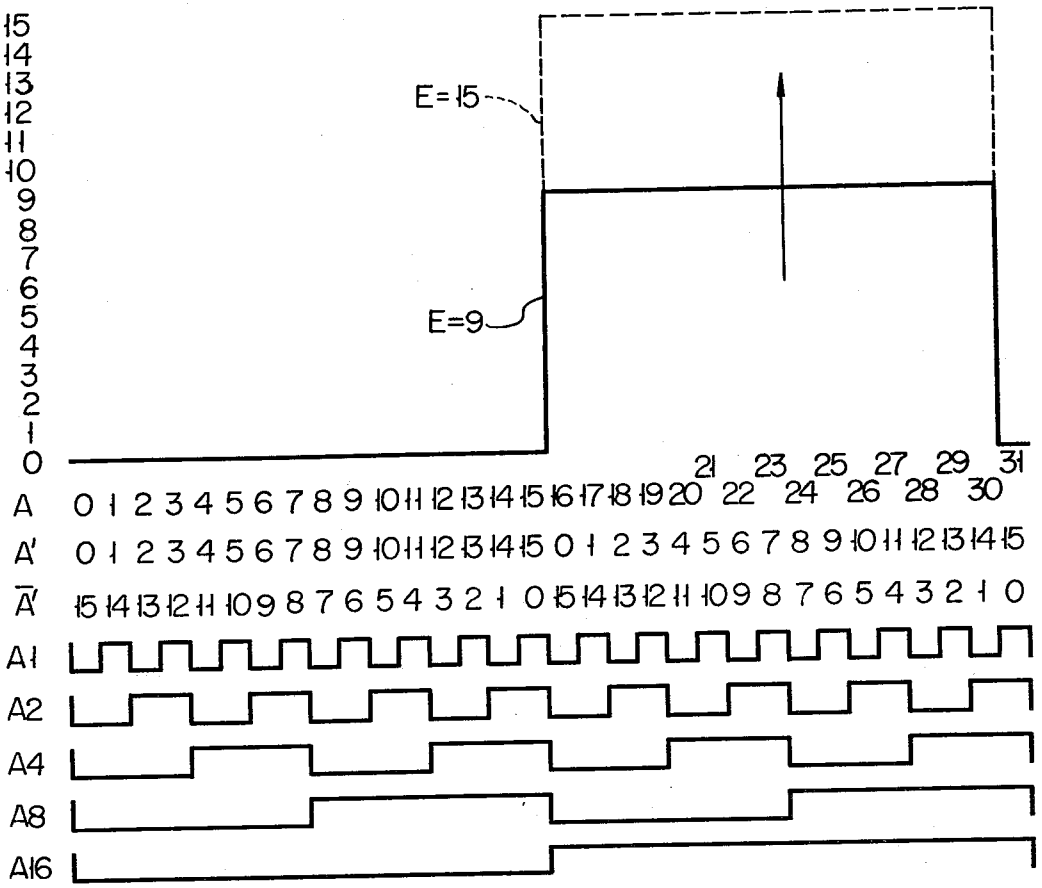

This is the case where a waveform in the last stage of the increase period is specified to be rectangular (refer to FIGS. 9A, 9B, Table 2 and FIG. 12).

A code expressed as "10" is stored in the $C_2$ and $C_4$-storing sections of the memory circuit 12 for storing the coded signals of the tone elements. Where, as seen from Table 2, output signals issued from the output terminals (1), (2) of the matrix circuit 35-5 are supplied as gate signals to the AND gates 35-10, 35-11. There will now be described the waveform-changing operation illustrated in FIG. 12 with respect to [E=9] and [E=15] as in the case of the sawtooth wave referred to under the item (A).

<B-1>E=9

Where the address counter 30*a* counts a number of [0] to [15], the operation of the addition-subtraction circuit 37-1 remains inoperative and maintains the state where no addition is made. Where the address counter 30*a* counts 16 steps corresponding to the address A[16], then the period detection circuit 35-1 issues a signal showing the detection of a step number corresponding to the address A[16]. At this time, the AND circuit 35-10 is opened, causing a 4-bit signal (coded as "1001") representing [E=9] to be supplied as an instruction for addition of [9] to the addition-subtration circuit 37-1. Where the address counter 30*a* counts a number corresponding to the addresses A[17] to [31], then a subtraction instruction is delivered to the addition-subtraction circuit. No AND gate is opened, before the address counter 30*a* counts a number corresponding to the addresses A[17] to [31], but holds an addition value of [9]. When the address counter 30*a* counts a number corresponding to the address A[31], then the AND gate 35-11 is opened, causing a [E] instructing signal issued through the OR gate 35-26 to be supplied to the input side of the AND gates 36-5 to 36-8. Accordingly, an amplitude value [E=9] is conducted to the addition-instruction circuit 37-1 through the EX OR gates 36-1 to 36-4, AND gates 36-5 to 36-8, OR gates 36-9 to 36-12 and adder 36-13. An addition value of [9] is reduced to [0] all at once upon receipt of a subtruction instruction, producing a rectangular wave indicated in solid lines in FIG. 12.

<B-2>E=15

Where the address counter 30*a* counts a number corresponding to the addresses A[0] to [15], then no addition is made. Where the address counter 30*a* counts a number corresponding to the address A[16], then the AND gate 35-10 is opened. An [E]-instructing signal is sent forth from the OR gate 35-26 to the AND gates 36-5 to 36-8. A counted number of [E=15] coded as "1111" is supplied as an addition value to the addition-subtraction circuit 37-1. While the address counter 30*a* counts a number corresponding to the addresses A[17] to [30], an addition value of [15] is held. When the address counter 30*a* counts a number corresponding to the address A[31], then the AND gate 35-11 is opened. A counted amplitude value of [E=9] delivered from the amplitude counter 34*a* is immediately reduced to [0] upon receipt of a subtraction instruction. As a result, a rectangular wave indicated in dotted lines in FIG. 12 is produced.

<B-3>

Obviously, the same waveform-changing operation as described above is carried out with respect to other amplitude values than E=1, 2 . . . . As a counted amplitude value [E] increases, a waveform grows larger in the direction of the arrow indicated in FIG. 12 with the shape of the cut-off top portion of the waveform kept unchanged. When a counted amplitude value reaches a maximum number of [15], then a prescribed rectangular wave is produced.

<C>

Figure 13:
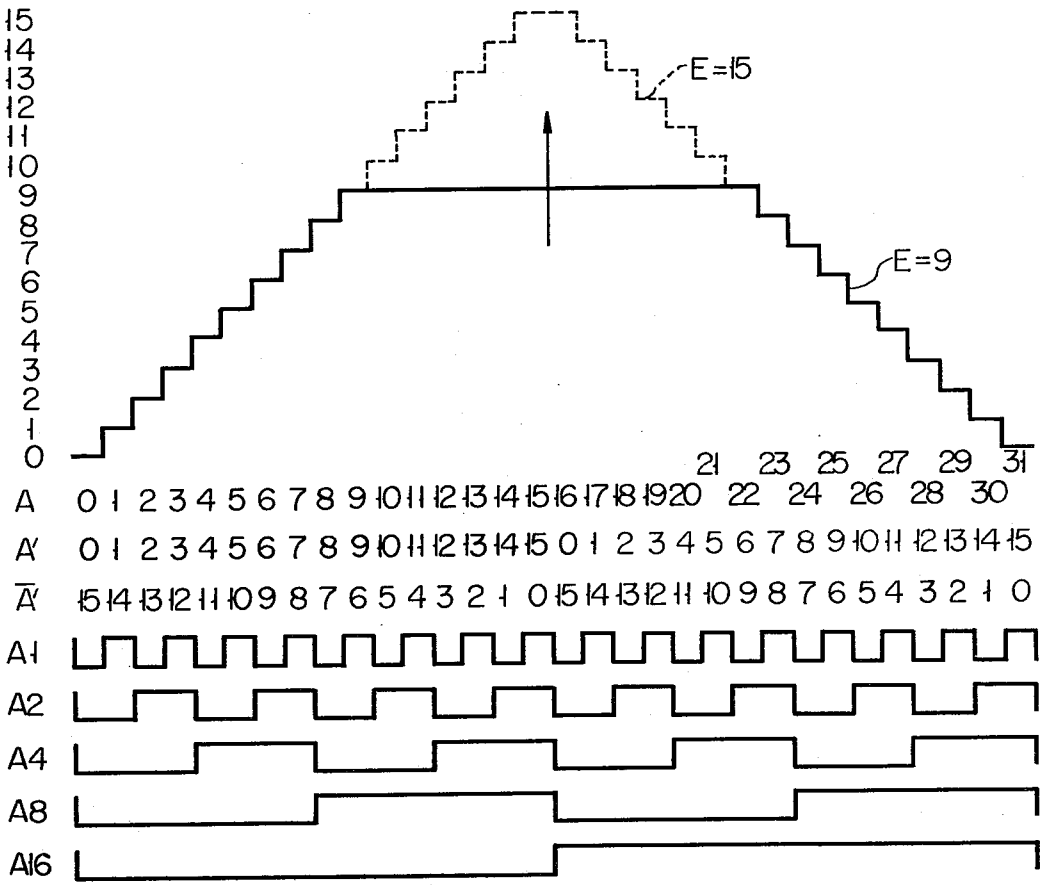

This is the case where a waveform is specified to be triangular in the final stage of the increase period (refer to FIGS. 9A, 9B, Table 2 and FIG. 13).

A code of "01" is stored in the $C_2$, $C_4$-storing sections of the memory circuit 12 for storing the coded signals of the tone elements. As apparent from Table 2, output signals issued from the output terminals (5), (6) are supplied as gate signals to the AND gates 35-14, 35-15. An output signal from the output terminal (5) is conducted to the input side of the EX OR gates 39-1 to 39-4 through the OR gate 35-24. The output terminals of said EX OR gates 39-1 to 39-4 send forth a signal denoting [$\overline{A'}$]. There will now be described the process of producing a triangular wave shown in FIG. 13 with respect to [E=9] and [E=15] as described under the items of <A> and <B>.

<C-1>E=9

Where the address counter 30*a* counts a step number of [1] to [15], the period detection circuit 35-1 sends forth a signal denoting the address A[1] to [15], which in turn is supplied to the AND gate 10-11. As a result, a signal instructing the addition of [1] which has passed through the OR gate 35-25 is supplied to the addition-subtraction circuit 37-1 through the adder 36-13. Since, at this time, a subtraction instruction is not issued, the comparator 39-5 detects the condition of [E≧A'] until the address counter 30*a* counts a number corresponding to the addresses A[1] to [9]. A count is increased by one for each step. When a counted number denotes the address A[10], then the AND gate 35-15 is closed. An addition value of [9] is held. Where the address counter 30*a* counts a number corresponding to the addresses A[17] to [31], then the comparator 39-5 detects the condition of [E>$\overline{A'}$]. At this time, the AND gate 35-14 is opened, allowing a signal instructing the addition of [1] issued through the OR gate 35-25 to be conducted to the addition-subtraction circuit 37-1 through the adder 36-13. Since, at this time, the addition-subtraction circuit 37-1 is supplied with a subtraction instruction, [1] is subtracted for each step, producing a triangular wave illustrated in FIG. 13.

<C-3>

Obviously, the same waveform-changing operation as described above is carried out with respect to the other amplitude values then E=1, 2 . . . . As the amplitude value E increases, a waveform grows larger in the direction of the arrow indicated in FIG. 13 with the cut-off top portion fixed. When the amplitude value reached a maximum number of [E=15], a specified triangular wave is obtained for the first time.

Where the amplitude counter 34*a* counts a maximum amplitude value of [15] by counting increase clock pulses $\phi_1$, then any of the sawtooth, rectangular and triangular waveforms is produced in the final stage of the increase period. There is now described the process of carrying out six waveform changes during the transform period following the increase period. Where the amplitude counter 34*a* counts a maximum amplitude value of [15], then the AND gate 10-2 sends forth an output signal. At the fall of said output signal, a transform signal is issued from the output terminal of the binary counter 35-3. At this time the output terminals (3), (4), (7), (8), (9), (10), (11), (12) are made ready to generate an output signal. The amplitude counter 34*a* counts an amplitude value by transform clock pulses $\phi t$ instead of by increase clock pulses. Where it is intended to change waveforms during the transform period such as rectangular→to sawtooth (with respect to waveforms [02], [03]), sawtooth→triangular (with respect to waveforms [20], [21]) and rectangular→triangular (with respect to waveforms [22], [23]), then a maximum amplitude value of [15] counted by the amplitude counter 34*a* is automatically reduced to [0]. Thereafter the amplitude value is counted up as [0]→[1]→[2]→ . . . [14], [15]. Where it is specified to change waveforms during the transform period such as triangular→sawtooth (with respect to waveforms [04], [05]), sawtooth→rectangular with respect to waveforms [10], [11]) and triangular→rectangular (with respect to waveforms [14], [15]), then a maximum amplitude value of [15] counted by the amplitude counter 34*a* is counted down as [15]→[14]→[13]→ . . . [1]→[0] upon receipt of a down-counting instruction.

<D>

There will now be described the process of changing a rectangular wave formed in the initial stage of the transform period (or the final stage of the increase period) into a sawtooth wave in the final stage of the transform period (refer to FIGS. 9A, 9B, Table 2 and FIG. 14).

In this case, the $C_2$, $C_4$, $C_8$, $C_{16}$-storing sections of the memory circuit 12 for storing the coded signals of the tone elements are supplied, as seen from Table 2, with a waveform-specifying code "1000", whose bits have weights of 2, 4, 8, 16 respectively. Output signals are read out of the two output terminals (4) (10) of the matrix circuits 35-5. An output signal from the output terminal (4) is always supplied as a gate signal to the AND gate 35-13 through the OR gate 35-12. An output signal from the output terminal (10) is always supplied as a gate signal to the AND gates 35-20, 35-21 through the OR gate 35-19. An output signal from the OR gate 35-19 is conducted to the EX OR gates 39-1 to 39-4 through the OR gate 35-24. A signal denoting $[\overline{A}']$ is read out of the output signals from said EX OR gates. There will now be described the cases where the amplitude counter 34*a* counts amplitude values of [E=9] and [E=15].

<D-1> (E=9)

Figure 14:
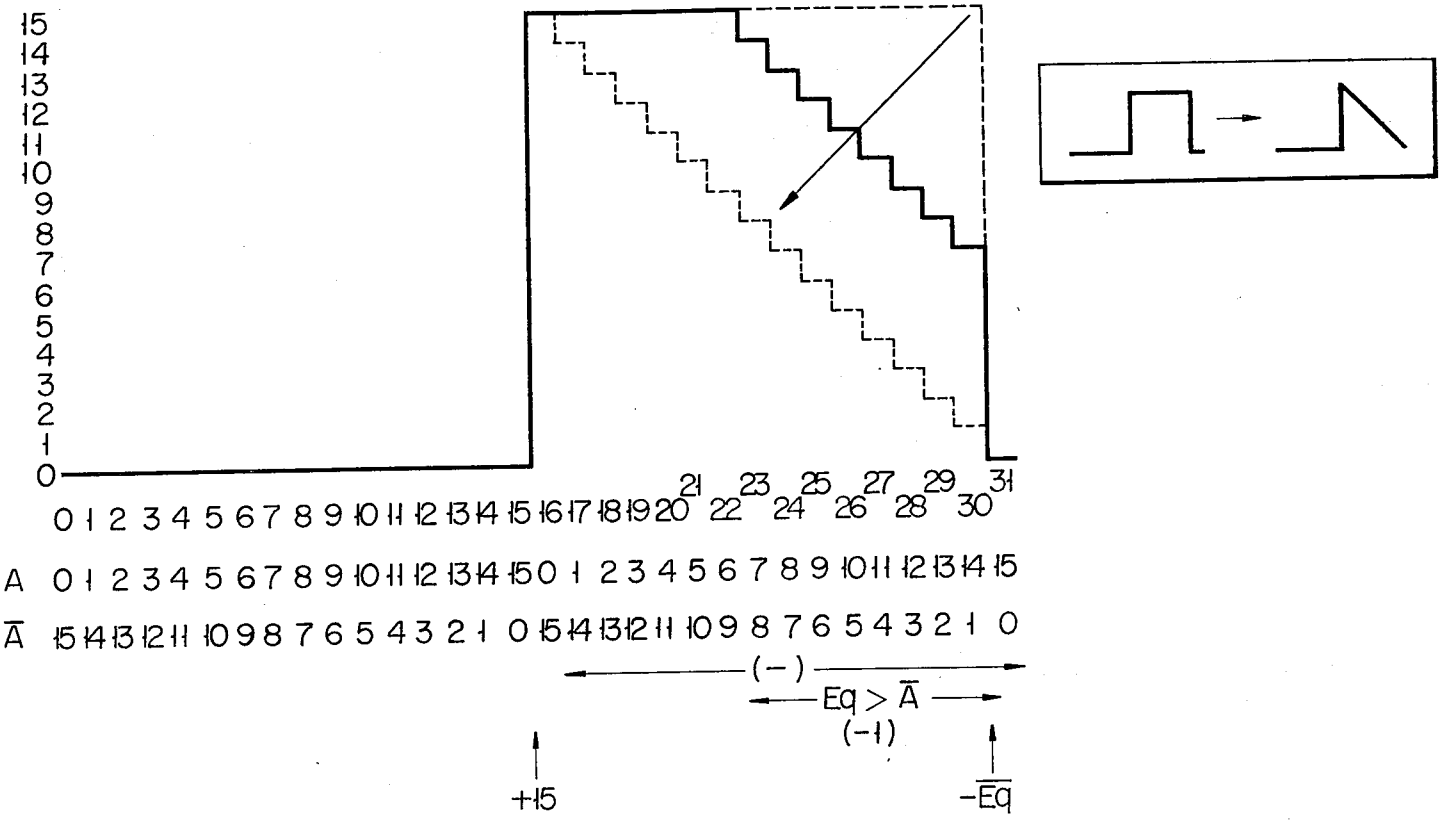
FIG. 14 shows the process by which a rectangular wave is changed into a sawtooth wave during the transform period of FIGS. 10A and 10B.

(refer to a solid line waveform shown in FIG. 14)

Where a counted amplitude value indicates [E=9], and the address counter 30*a* counts a step number of [0] to [15], then no output signal is generated from any of the AND gates 35-13, 35-20, 35-21. Where the address counter 30*a* counts a step number of [16], then period detection circuit 35-1 sends forth a signal denoting the detection of the address A[16]. A signal instructing the addition of [15] is conducted from the AND gate 35-13 to the OR gates 36-9 to 36-12. Output signals from all the OR gates having a logic code of "1" are supplied as an addition value of [15] coded as "1111" to the addition-subtraction circuit 37-1 through the adder 36-13. Where the address counter 30*a* counts a step number of [17] to [31], then the addition-subtraction circuit 37-1 is supplied with a subtraction-instruction. While, however, the address counter 30*a* counts a step number of [17] to [22], the comparator 39-5 does not supply the result of comparison to the AND gate 35-20. During this period, an addition value of [15] is held. Where the address counter 30*a* counts a step number of [23], then the comparator 39-5 produces a signal showing the result of comparison $[E>\overline{A}']$, which in turn is delivered to the AND gate 35-20. As seen from the description of a counted step number given in FIG. 14, a step number of [23] counted by the address counter 30*a* means the following fact. The address counter 30*a* counts a number of [7] with respect to A' expressed by the 4-bit codes of $A_1$, $A_2$, $A_4$, $A_8$. Since, however, the OR gate 35-24 sends forth a signal having a logic code of "1", the number of [A'=7] is supplied to the comparator 19-5 in the form of $[\overline{A}'=8]$, namely, the number of A' complementary to [15] which has been inverted by the EX OR gates 39-1 to 39-4. The supply of said complementary number of $[\overline{A}'=8]$ satisfies the prescribed result of comparison, that is, $[E>\overline{A}']$ with respect to [E=9]. Accordingly, the AND gate 35-20 is opened, causing an output signal from the OR gate 35-25 which instructs the addition of [1] to be supplied to the addition-subtraction circuit 37-1 through the adder 36-13. At this time, a subtraction instruction is issued from the period detection circuit 35-1. Where, therefore, the address counter 30*a* counts a step number of [23], then an addition value of [15] is subtracted by [1]. While later the address counter counts a step number of [24] to [31], the requisite condition of $E>\overline{A}'$ is fully met. Consequently, a subtraction of [1] is made, each time a step number is counted. Where the address counter 30*a* counts a step number of [31], then the period detection circuit 35-1 generates a signal showing the detection of the address A[31]. As a result, the AND gate 35-21 is opened, causing an [E]-instructing signal to be issued through the OR gate 35-26 and an [E]-instructing signal to be sent forth through the OR gate 35-27. Accordingly, a number of 6 (coded as "0110") complimentary to [15], a counted amplitude value of [E=9 (coded as "1001")] is sent forth through the EX OR gates 36-1 to 36-4 and supplied to the addition-subtraction circuit 37-1 through the AND gates 36-5 to 36-8, OR gates 36-9 to 36-12 and adder 36-13. Where the address counter 30*a* counts a step number of [31], then the AND gate 35-20 is opened, causing numbers of [6] and [1] to be added by the adder 36-13. Therefore a subtraction of [6] and [1], that is, a value of $[\overline{E}_9]$ and [1] is carried out in the addition-subtraction circuit 37-1, thus producing the solid line waveform to be produced from the addition-subtraction circuit 37-1.

<D-2> (E=15)

(the process of producing the dotted line sawtooth wave of FIG. 14)

The same operation as described under the item of <D-1< is continued until the address counter 30*a* counts a step number of [0] to [16]. Where a step number of [17] is counted, then the requisite condition of $[E>\overline{A}']$ is met. Consequently the comparator 39-5 issues a signal showing the detection of $[E>\overline{A}']$, which in turn is delivered to the AND gate 35-20. Therefore, a counted step number of [17] is decreased by [1] for each step in the addition-subtraction circuit 37-1. Where the address counter counts a step number of [31], then the AND gate 10-17 is opened. Since, however, a number complementary to an amplitude value of [E=15] is zero, the operation of the addition-subtraction circuit 37-1 is not affected, thus providing a sawtooth wave in the case of [E=15].

<D-3>

The foregoing description referred to the cases of [E=9] and [E=15]. However, the same waveform-changing process as previously described is carried out with respect to other amplitude values such as E=1, 2 .... As a counted amplitude value increases, the rectangular wave of FIG. 14 is gradually changed in the direction of the indicated arrow during the transform period until said rectangular wave is converted into a sawtooth wave in the final stage of the transform period.

FIG. 15 is a simplified illustration of changes occurring in the forms of the fundamental waves as well as those later described while the period is shifted from the increase period to the transform period.

<E>

There will now be described by reference to FIG. 16 the process of changing a triangular wave in the initial stage of the transform period into a sawtooth wave in the final stage thereof.

In the case, the $C_2$, $C_4$, $C_8$ and $C_{16}$-storing sections of the memory circuit 12 for storing the coded signals of the tone elements are supplied, as seen from FIG. 9A and Table 2, with a waveform-specifying code expressed as "0100", whose bits have weights of 2, 4, 8, 16 respectively. Therefore, two output signals are sent forth from the output terminals (8), (11) of the matrix circuit 35-5. An output signal from the output terminal (8) is always supplied as a gate signal to the AND gates 35-17, 35-18 through the OR gate 35-16. An output signal from the output terminal (11) is always supplied as a gate signal to the AND gate 35-23 through the OR gate 35-22. An output signal from the OR gate 35-16 is delivered to the EX OR gates 39-1 to 39-4 through the OR gate 35-24 as an instruction to read out a signal denoting [$\overline{A'}$] from said EX OR gates. Where, in the case of the waveform-specifying code "0100", the amplitude counter 34*a* counts a maximum amplitude value of [15] during the increase period, then a down-counting instruction is supplied to said counter 34*a*. As a result, said maximum amplitude value of [15] is progressively down counted by [1] as [14]→[13]. . . →[1]→[0], each time a transform clock pulses $\phi$t is received.

<E-1> (E=9)

Figure 16:
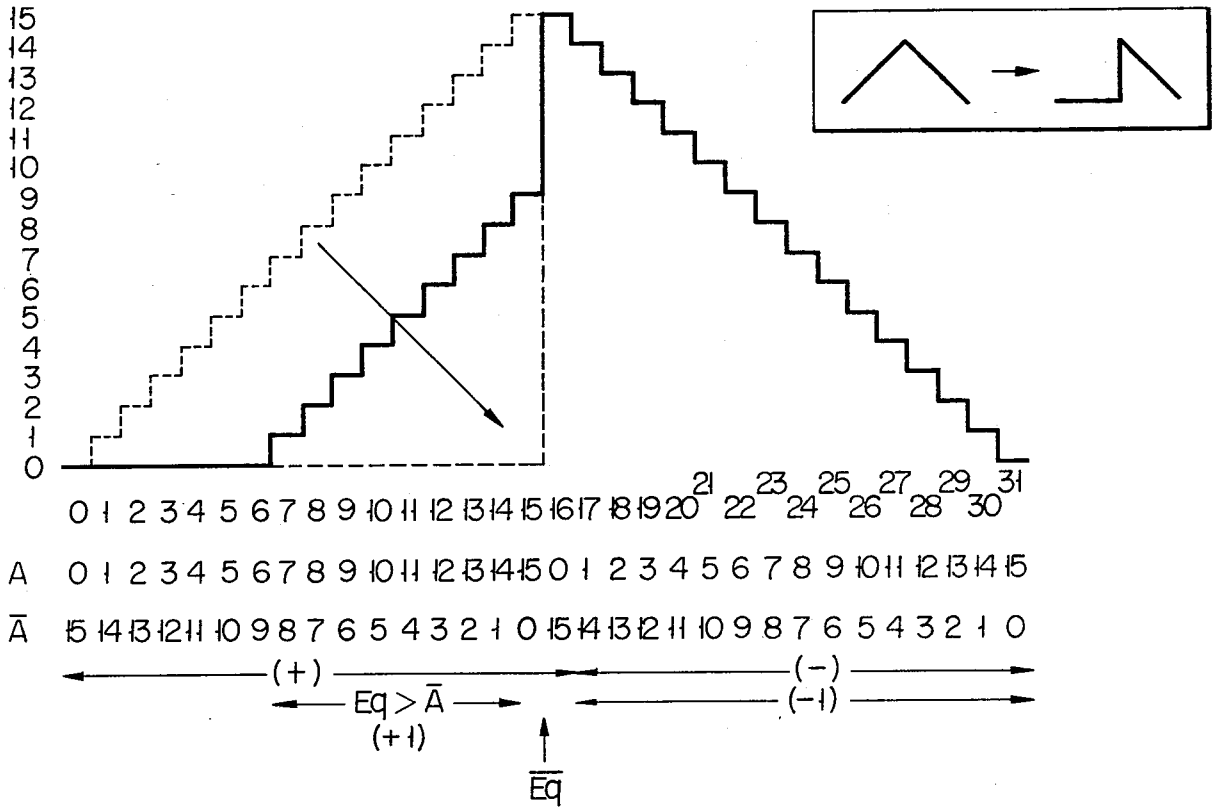
FIGS. 16 to 20 respectively illustrate the processes by which changes take place in the waveforms of signals as from the triangular to the sawtooth, from the sawtooth to the rectangular, from the triangular to the rectangular, from the sawtooth to the triangular and from the rectangular to the triangular.

(refer to the solid line waveform of FIG. 16)

Where, in the case of a counted amplitude value of [E=9], the address counter 30*a* counts a step number of [0] to [6], then the AND gates 35-17, 35-18, 35-23 are all closed, and no output addition value is produced therefrom. Where the address counter 30*a* counts a step number of [7], then the comparator 39-5 issues a signal denoting the result of comparison, that is, [E>$\overline{A'}$]. At this time the AND gate 35-17 is opened, causing a signal instructing the addition of [1] to be sent forth from the OR gate 35-25 to the addition-subtraction circuit 37-1 through the adder 36-13. The required result of comparison expressed as [E>$\overline{A'}$] is met until the address counter 30*a* counts a step number of [7] to [15]. During this step-counting period, the addition-subtraction circuit 37-1 is supplied with a signal instructing the addition of [1]. A count made by the address counter 30*a* is increased by [1], each time a step is counted. Where the address counter 30*a* counts a step number of [16], then the period detection circuit 35-1 produces a signal showing the detection of the address A[16], causing the AND gate 35-18 to be opened. As a result, an [E] instructing signal is delivered through the OR gate 35-26. An [$\overline{E}$]-instructing signal is issued through the OR gate 35-27. Both instructions are supplied to the AND gates 36-5 to 36-8 and EX OR gates 36-1 to 36-4. As a result, a number of [6] coded as "0110" complementary to a number of [15] denoting [E=9, coded as "1001"] is supplied to the addition-subtraction circuit 37-1 as a value to be added. Accordingly, this circuit 37-1 is supplied with an addition value of [15]. While the address counter counts a step number of [17] to [31], the AND gate 35-23 is opened. Thus, the addition value of [15] obtained when the step number [16] was counted is decreased by [1] for each step, eventually producing the solid line sawtooth wave of FIG. 16.

<E-2> (E=0)

(refer to the dotted line sawtooth wave of FIG. 16)

While the address counter 30*a* counts a step number of [0] to [15], the comparator 39-5 does not generate a signal showing a result of comparison. Where the address counter 30*a* counts a step number corresponding to the address A[16], then the AND gate 35-18 is opened. An [E]-instructing signal delivered through the OR gate 35-26 and an [$\overline{E}$]-instructing signal conducted through the OR gate 35-27 are supplied as gate signals to the EX OR gates 36-1 to 36-4. Consequently, a number of [15] (coded as "1111") complementary to a number denoting [E=0] is issued from the EX OR gates 36-1 to 36-4. Said complementary number of [15] passes through the AND gates 36-5 to 36-8, OR gates 36-9 to 36-12 and adder 36-13 to be stored as an addition value of [15] in the addition-subtraction circuit 37-1. Where the address counter 30*a* counts step numbers corresponding to the addresses 17 to 31, then the AND gate 35-23 is opened. As a result, a subtraction of [1] is made, each time a step is counted, eventually providing the dotted line sawtooth wave of FIG. 16.

<E-3>

In this case, the amplitude counter 34*a* down-counts a maximum amplitude value of [15] toward [0]. Therefore, a waveform is progressively changed in the direction of the arrow indicated in FIG. 16 from a triangular to a sawtooth wave.

<F>

There will now be described by reference to FIG. 17 the process of changing a sawtooth wave in the initial stage of the transform period into a rectangular wave in the final stage of said transform period.

In this case, the $C_2$, $C_4$, $C_8$ and $C_{16}$-storing sections of the memory circuit 12 for storing the coded signals of the tone elements are supplied, as seen from FIG. 9A and Table 2, with a waveform-specifying code coded as "0010" whose bits have weights of 2, 4, 8, 16 respectively. Therefore, output signals are sent forth from two output terminals (3), (9) of the matrix circuit 35-5. An output signal from the output terminal (3) is always supplied as a gate signal to the AND gate 35-13 through the OR gate 35-12. An output signal from the output terminal (9) is always supplied as a gate signal to the AND gates 35-20, 35-21 through the OR gate 35-19. An output signal from the OR gate 35-19 is supplied to the EX OR gates 39-1 to 39-4 through the OR gate 35-24.

Where, in the case of a waveform-specifying code of "0010", the amplitude counter 34*a* counts a maximum amplitude value of [15], then said counter 34*a* is supplied with a down-counting instruction. Accordingly, the maximum amplitude value of [15] is counted down as [15]→[14]→[13]. . . →[1]→[0] upon receipt of a transform clock pulse $\phi$t.

<F-1> (E=9)

Figure 17:
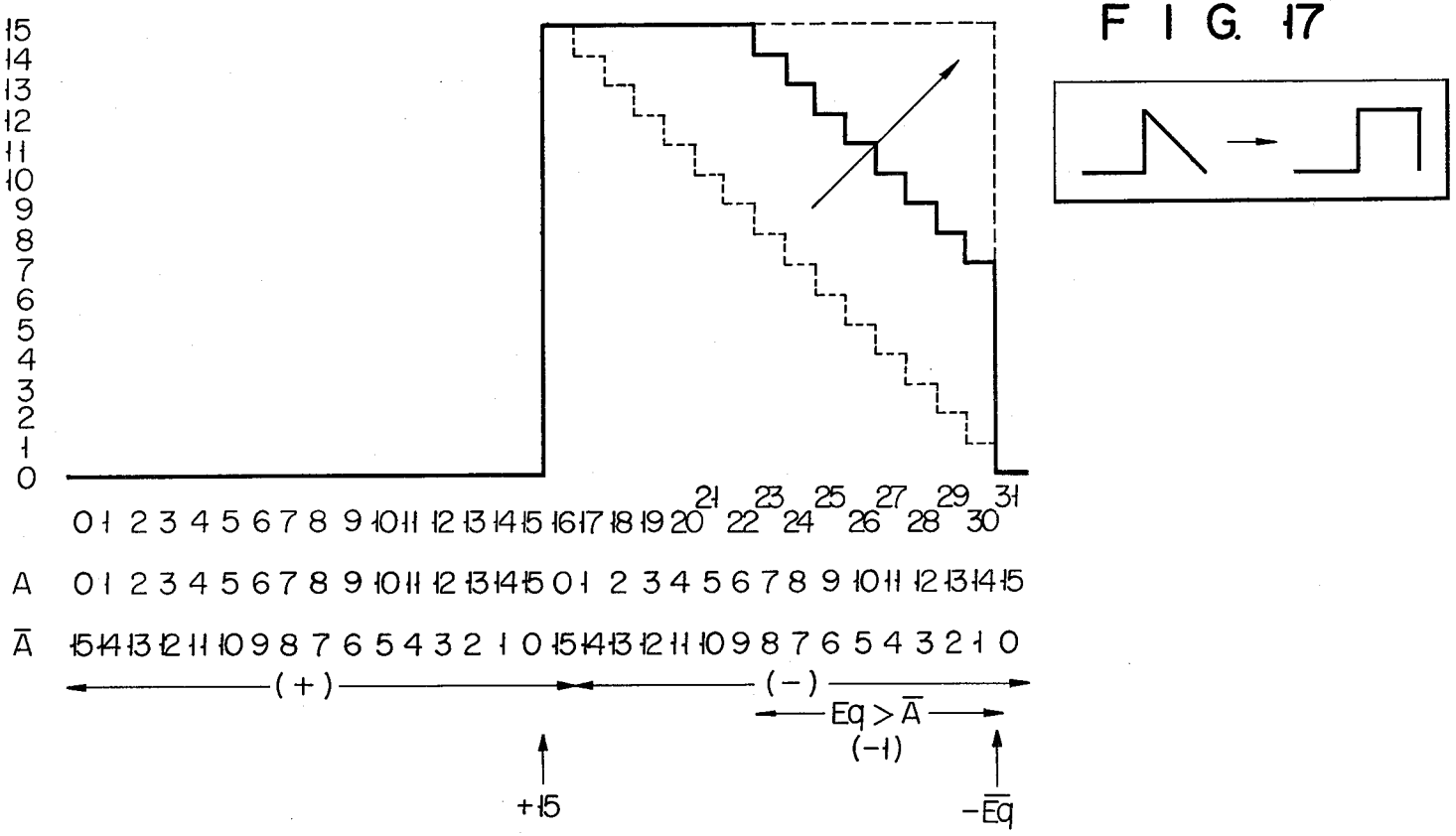

(refer to the solid line waveform of FIG. 17)

While the address counter 30*a* counts a step number of [0] to [15] with the amplitude value set to [E=9], then the AND gates 35-13, 35-20 are all closed. Where the address counter 30*a* counts a step number corresponding the address A[16], then the AND gate 35-13 is opened, causing a signal instructing the addition of [15] to be conducted to the OR gate 36-9 to 36-12. Thus an addition value of [15] is supplied to the addition-subtraction circuit 37-1. Where the address counter 30*a* counts a step number corresponding to the address A23 and the requisite condition of [E>$\overline{A'}$] is met as a result of comparison made by the comparator 39-5, then the AND gate 35-20 is opened, causing a signal instructing the addition of [1] to be issued through the OR gate 35-25. As a result, subtraction of [1] is made for each step. Where the address counter 30*a* counts a step number corresponding to the address A[16], then an addition value of [15] is supplied to the addition-subtraction circuit 37-1 as in the case of the item <F-1>. At this time, the requisite comparison result of [E>$\overline{A'}$] is not met. Where the address counter 30*a* counts a step number corresponding to the address $A_{31}$, then an output signal from the AND gate 35-21 is supplied to the OR gates 35-26, 35-27 which issue an [E]-instructing signal and an [$\overline{E}$]-instructing signal respectively. As a result, the addition-substraction circuit 37-1 is supplied with a number of [−15] complementary to a number of [15] corresponding to [E=0]. Since, at this time, a subtraction instruction is given to the addition-subtraction circuit 37-1, the addition value [15] is reduced to [0].

<F-3>

A waveform is grown in the direction of the arrow indicated in FIG. 17, each time a maximum amplitude value counted by the amplitude counter 34*a* is down-counted, finally producing a rectangular wave.

<G>

There will now be described by reference to FIG. 18 the process of changing a triangular wave in the initial stage of the transform period into a rectangular wave in the final stage thereof.

In this case, the $C_2$, $C_4$, $C_8$ and $C_{16}$-storing sections of the memory circuit 12 for storing the coded signals of the tone elements are supplied with a waveform-specifying code of "0110" whose bits have weights of 2, 4, 8, 16 respectively, as seen from FIG. 9B and Table 2. Accordingly, two output signals are read out of the output terminals (8), (9) of the matrix circuit 35-5. An output signal from the output terminal (8) is always supplied as a gate signal to the AND gates 35-17, 35-18 through the OR gate 35-16. An output signal from the output terminal (9) is always supplied as a gate signal to the AND gates 35-20, 35-21 through the OR gate 35-19. Output signals from the OR gates 35-16, 35-19 are supplied to one of the input terminals of the EX OR gates 39-1 to 39-4 through the OR gate 35-24. In the case of the waveform-specifying code of "0110", too, the amplitude counter 34*a* is supplied with a down-counting instruction during the transform period. The maximum amplitude value of [15] is counted down as [15]→[14] . . . →[1]→[0].

<G-1> (E=9)

Figure 18:
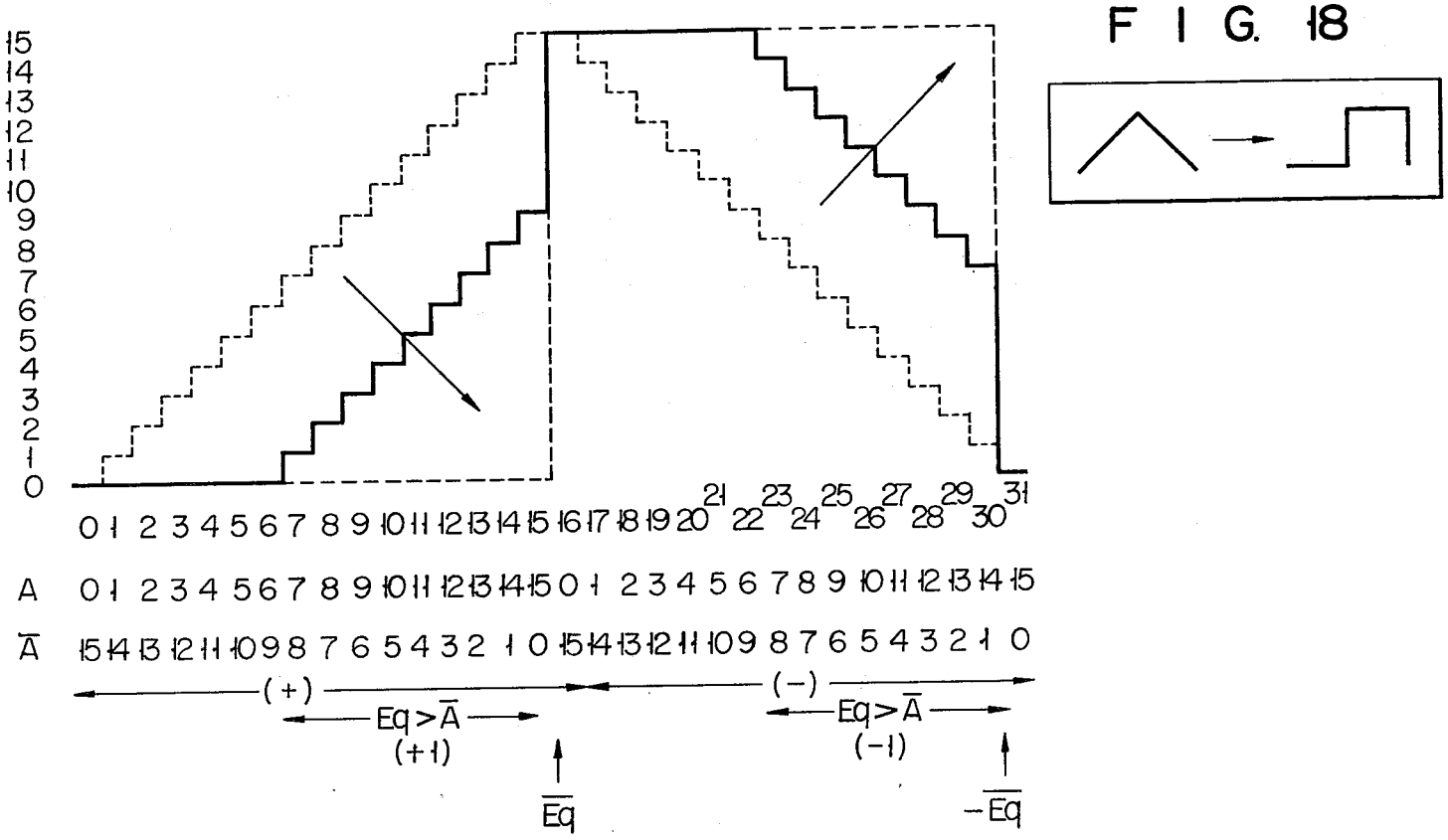

(refer to the solid line waveform of FIG. 18)

While the address counter 30*a* counts a step number of [0] to [6] with the amplitude value set to E=9, then no addition output is produced. Where the address counter 30*a* counts a step number of [7], then the comparator 39-5 issues a signal denoting the detection of the requisite comparison result of [E>$\overline{A}$′]. As a result, the AND gate 35-17 is opened, causing a signal instructing the addition of [1] which is delivered through the OR gate 35-25 to be supplied to the addition-subtraction circuit 37-1 through the adder 36-13. Where the address counter 30*a* counts a step number of [7] to [15] and the requisite comparison condition of [E>$\overline{A}$′] is met, then a count made by the addition-subtraction circuit 37-1 is increased by [1] for each step. Where the address counter 30*a* counts a step number of [16], then the period detection circuit 35-1 issues a signal denoting the detection of the address A[16], and the AND gate 35-18 is opened. Accordingly, an [E]-instructing signal is sent forth through the OR gate 35-26 and [$\overline{E}$]-instructing signal is delivered through the OR gate 35-27. Both [$\overline{E}$]-instructing signals are supplied to the AND gates 36-5 to 36-8 and EX OR gates 36-1 to 36-4. A number of [6] (coded as "0110") complementary to a number of [15] denoting the amplitude value of [E=9] is supplied as an addition value of [+6] to the addition-subtraction circuit 37-1, which is consequently supplied with a number of [15] as a result of addition. Where the address counter 30*a* counts a step number of [17] to [22], then the requisite comparison result of [E>$\overline{A}$′] is not met, causing the addition value to be held. Where the address counter 30*a* counts a step number of [23], then the requisite comparison result of [E>$\overline{A}$′] is met, and the AND gate 35-20 is opened, causing a signal instructing the subtraction of [1] to be issued through the OR gate 35-25. Thus, the addition value of [15] is decreased by [1] for each step. Where the address counter 30*a* counts a step number of [31], then a count stored in the addition-subtraction circuit 37-1 is reduced to [0] by subtraction of a number corresponding to [$\overline{E}_9$+1] as described under the item of <D-1>.

<G-2> (E=0)

(refer to the dotted line rectangular wave of FIG. 18)

While the address counter 30*a* counts a step number of [0] to [15], no addition value is produced. Where the address counter 30*a* counts a step number of [16], then an addition value of [15] is supplied to the addition-subtraction circuit 37-1. At this time, the requisite comparison result of [E>$\overline{A}$′] is not met. Where the address counter 30*a* counts a step number corresponding to the address $A_{31}$, then an output signal from the AND gate 35-21 is supplied to the OR gates 35-26, 35-27, which in turn send forth an [$\overline{E}$]-instructing signal and an [E]-instructing signal respectively. As a result, a complementary value of [−15] is reduced to [0] in the addition-subtraction circuit 37-1 which is supplied with a subtraction instruction.

<G-3>

A waveform is grown in the direction of the arrow indicated in FIG. 18, each time the maximum amplitude value counted by the amplitude counter 34*a* is down-counted by [1] for each step, eventually producing a rectangular wave.

<H>

There will now be described by reference to FIG. 19 the process of changing a sawtooth wave in the initial stage of the transform period into a triangular wave in the final stage thereof.

In this case, the $C_2$, $C_4$, $C_8$, $C_{16}$-storing sections of the memory circuit 12 for storing the coded signals of the tone elements are supplied, as seen from FIG. 9B, with a waveform-specifying code of "0001" whose bits have weights of 2, 4, 8, 16, respectively. Two output signals are generated from the output terminals (7), (12) of the matrix circuit 35-5. An output signal from the output terminal (7) is always supplied as a gate signal to the AND gates 35-17, 35-18 through the OR gate 35-16. An output signal from the output terminal (12) is always supplied as a gate signal to the AND gate 35-23 through the OR gate 35-22. An output signal from the OR gate 35-16 is conducted to one of the input terminals of the EX OR gates 39-1 to 39-4 through the OR gate 35-24. In the case of the above-mentioned waveform-specifying code of "0001", the maximum amplitude value of [15] counted by the amplitude counter 34*a* is reduced to [0] during the increase period. During the transform period, an amplitude value counted by the amplitude counter 34*a* is increased by [1] for each step as [0]→[1] . . . →[14]→[15].

<H-1> (E=9)

Figure 19:
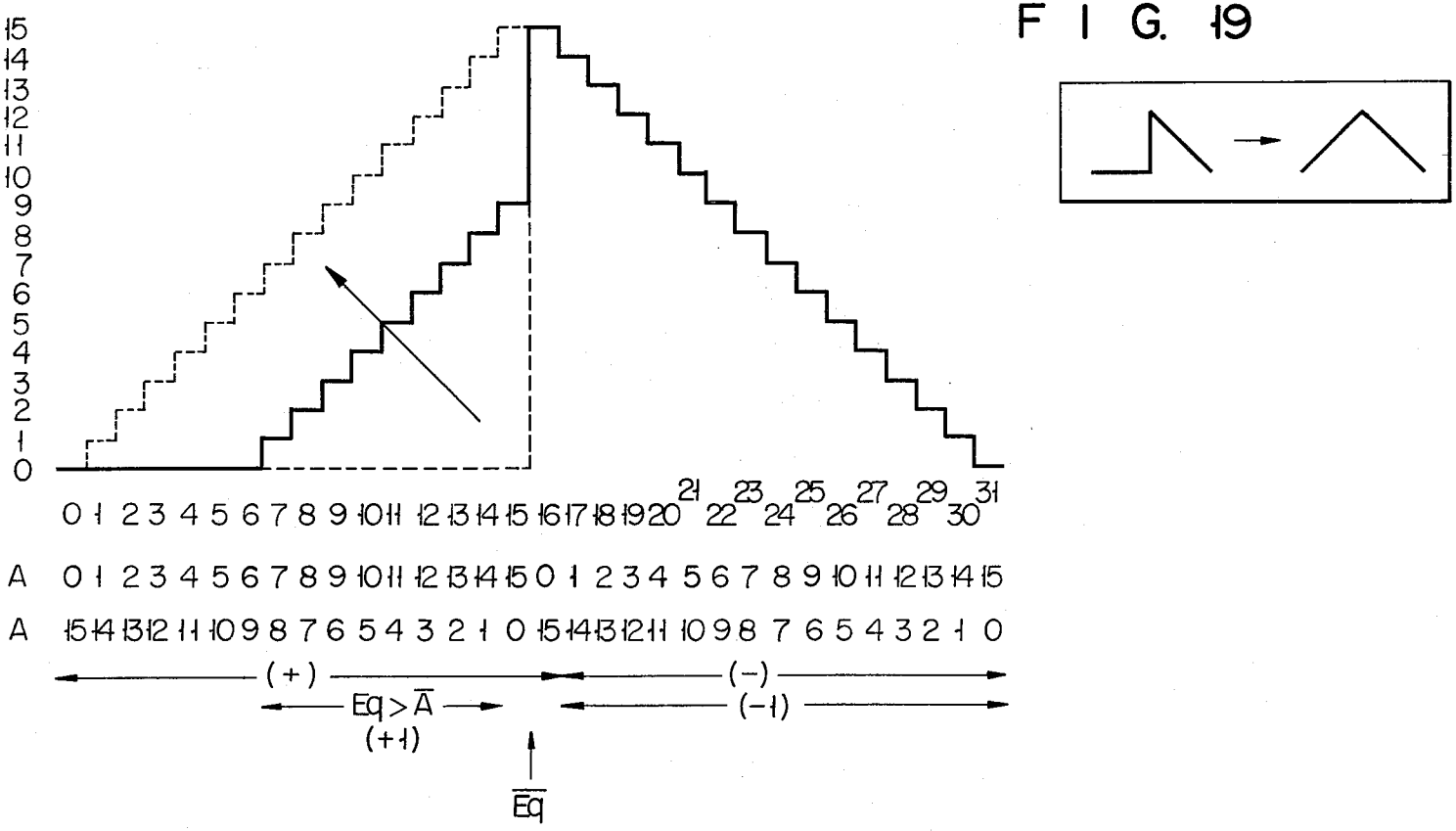

(refer to the solid line waveform of FIG. 19)

Where the address counter 30*a* counts a step number of [0] to [6], with the amplitude counted to be [E=9], then no addition value is produced. When the address counter 30*a* counts a step number of [7], then the comparator 39-5 produces a signal denoting the detection that the requisite comparison result of [E>$\overline{A}$'] has been met. At this time, the AND gate 35-17 is opened, causing a signal instructing the addition of [1] to be sent forth through the OR gate 35-25. Where the address counter 30*a* counts a step number of [7] to [15], and the requisite comparison result of [E>$\overline{A}$'] is met, then a count stored in the addition-subtraction circuit 37-1 is increased by [1] for each step. Where the address counter 30*a* counts a step number of [16], then the period detection circuit 35-1 issues a step number corresponding to the address $A_{16}$. At this time, the AND gate 35-18 is opened, causing an [$\overline{E}$]-instructing signal to be delivered through the OR gate 35-26 and an [E]-instructing signal to be sent forth through the OR gate 35-27. As a result, a number of [6] (coded as "0110") complementary to a number of [15] denoting the amplitude value of [E=9] (coded as "1001") is supplied as an addition value of [+6] to the addition-subtraction circuit 37-1. Where the address counter 30*a* counts a step number of [17] to [31], then the AND gate 35-23 is opened, causing a signal instructing the subtraction of [1] to be issued through the OR gate 35-25. Since, at this time, the addition-subtraction circuit 37-1 is supplied with a subtraction instruction, the addition value of [15] is decreased by [1] for each step.

<H-2> (E=15)

(refer to the dotted line triangular wave of FIG. 19)

Where the address counter 30*a* counts a step number of [1], then the requisite comparison result of [E>$\overline{A}$'] is met. Accordingly, the AND gate 35-17 is opened, causing a signal instructing the addition of [1] to be delivered through the OR gate 35-25. Where the address counter 30*a* counts a step number of [1] to [15], then a count stored in the addition-subtraction circuit 37-1 is increased by [1] for each step. Where the address counter 30*a* counts a step number of [16], the required comparison result of [E>$\overline{A}$'] is not met. Since, at this time, the AND gate 35-17 is not opened, a signal instructing the subtraction of [1] is not issued. Where the address counter 30*a* counts a step number of [17] to [31], then subtraction of [1] is made for each step upon receipt of a subtraction instruction as described above.

<H-3>

A waveform is gradually grown in the direction of an arrow indicated in FIG. 19, each time the address counter 30*a* counts a step number from a minimum [0] to a maximum [15], finally producing a triangular wave.

<I>

There will now be described by reference to FIG. 20 the process of changing a rectangular waveform in the initial stage of the transform period into a triangular wave in the final stage thereof.

In the case, the $C_2$, $C_4$, $C_8$, $C_{16}$-storing sections of the memory circuit 12 for storing the coded signals of the tone elements are supplied with a waveform-specifying code of "1001" whose bits have weights of 2, 4, 8, 16 respectively. Two output signals are generated from the output terminals of (7), (10) of the matrix circuit 35-5. An output signal from the output terminal (7) is always supplied as a gate signal to the AND gates 35-17, 35-18 through the OR gate 35-16. An output signal from the output terminal (10) is always supplied as a gate signal to the AND gates 35-20, 35-21 through the OR gate 35-19. Output signals from the OR gates 35-16, 35-19 are conducted to one of the input terminals of the EX OR gates 39-1 to 39-4 through the OR gate 35-24.

<I-1> (E=9)

Figure 20:
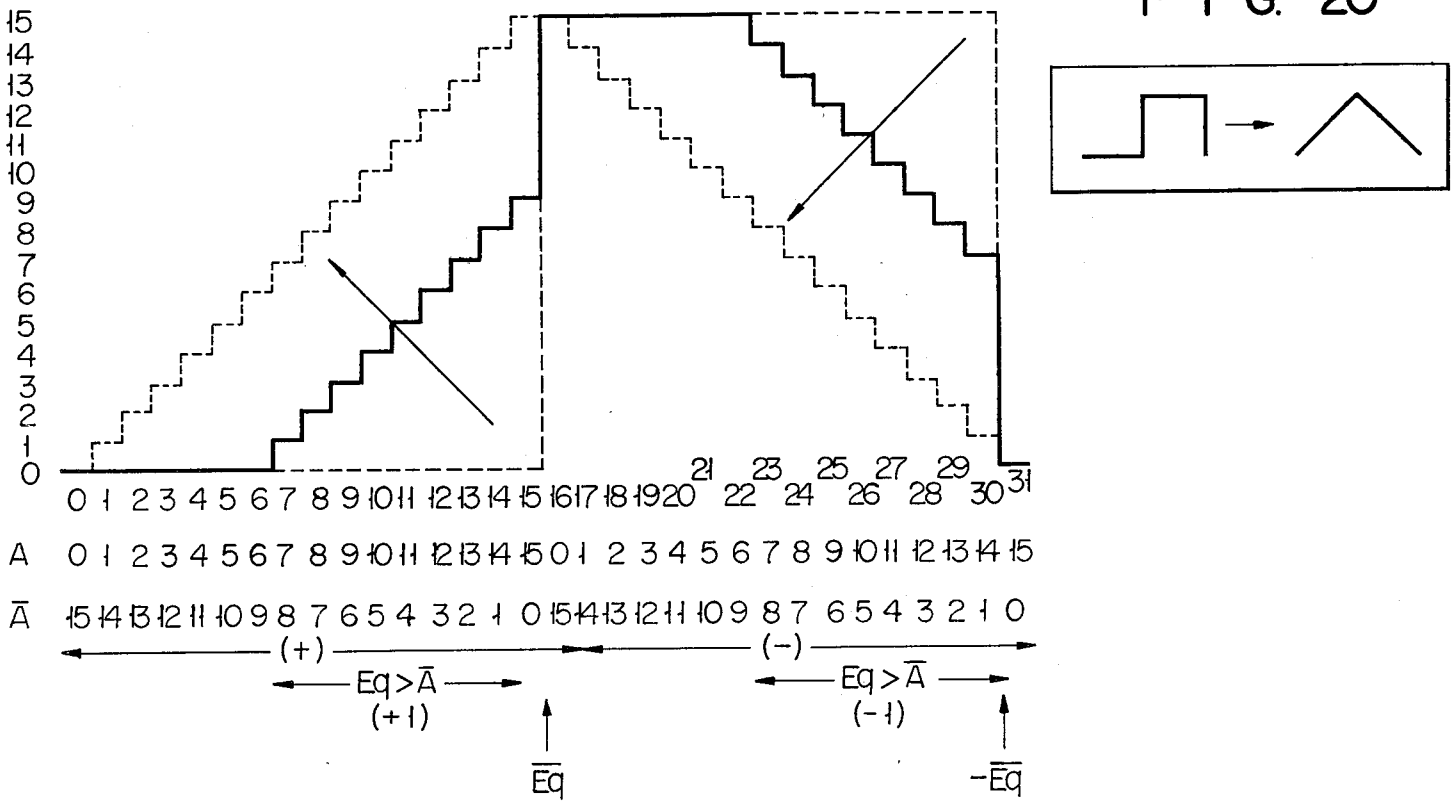

(refer to the solid line waveform of FIG. 20)

<I-2> (E=15)

(refer to the dotted line triangular waveform)

The waveform-changing process of the items <I-1>, <I-2> is easily understood by reference to the description of FIGS. 19 and 14, details thereof being omitted.

<I-3>

A waveform is gradually grown in the direction of an arrow shown in FIG. 20, each time the amplitude counter 34*a* counts a amplitude value from the minimum [0] to a maximum [15], finally producing a triangular wave.

Figure 21A:
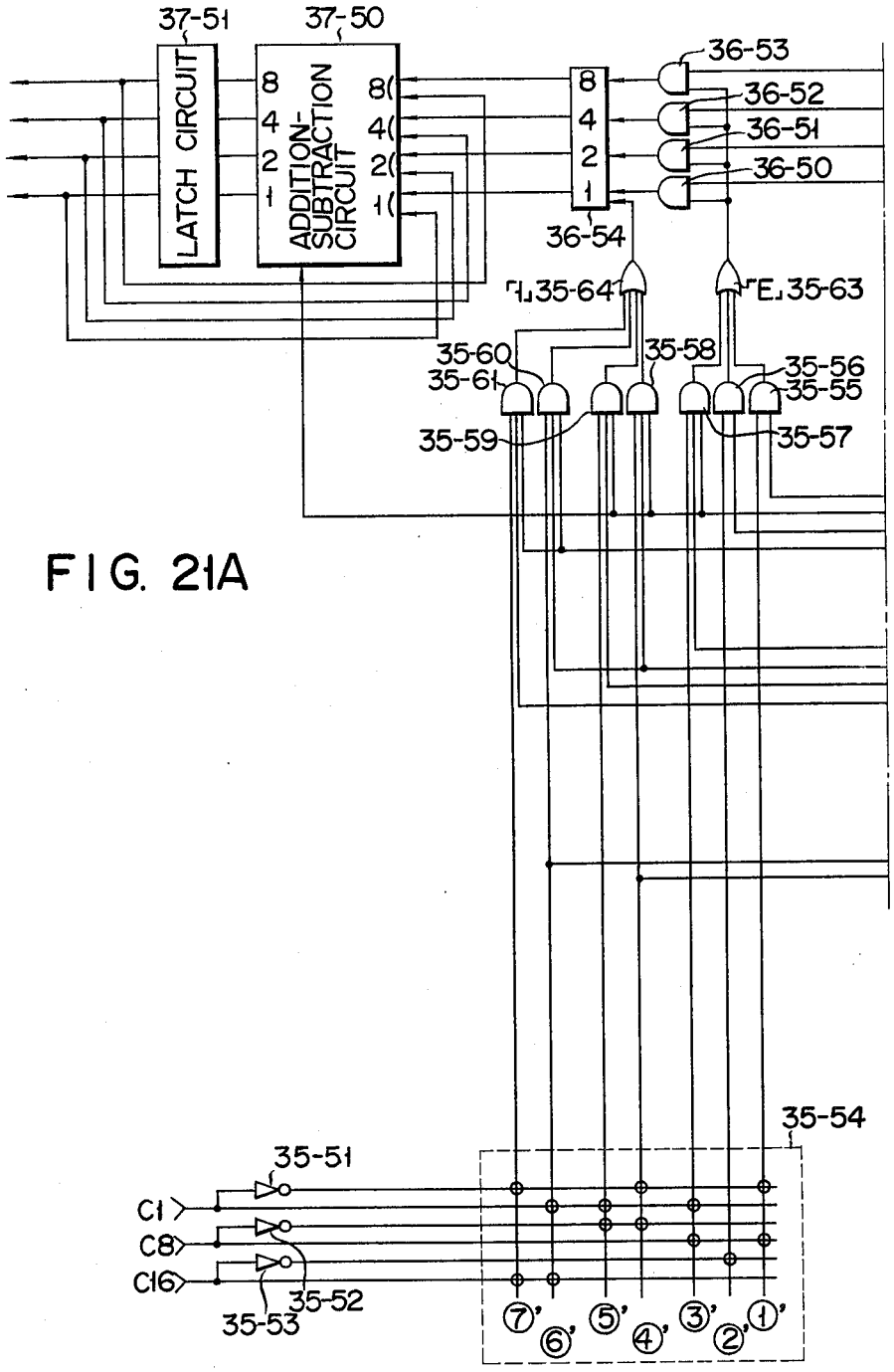
FIGS. 21A and 21B show the arrangement of a fundamental circuit for shifting the waveforms of signals during the decrease period of FIGS. 9A and 9B respectively.
Figure 21B:
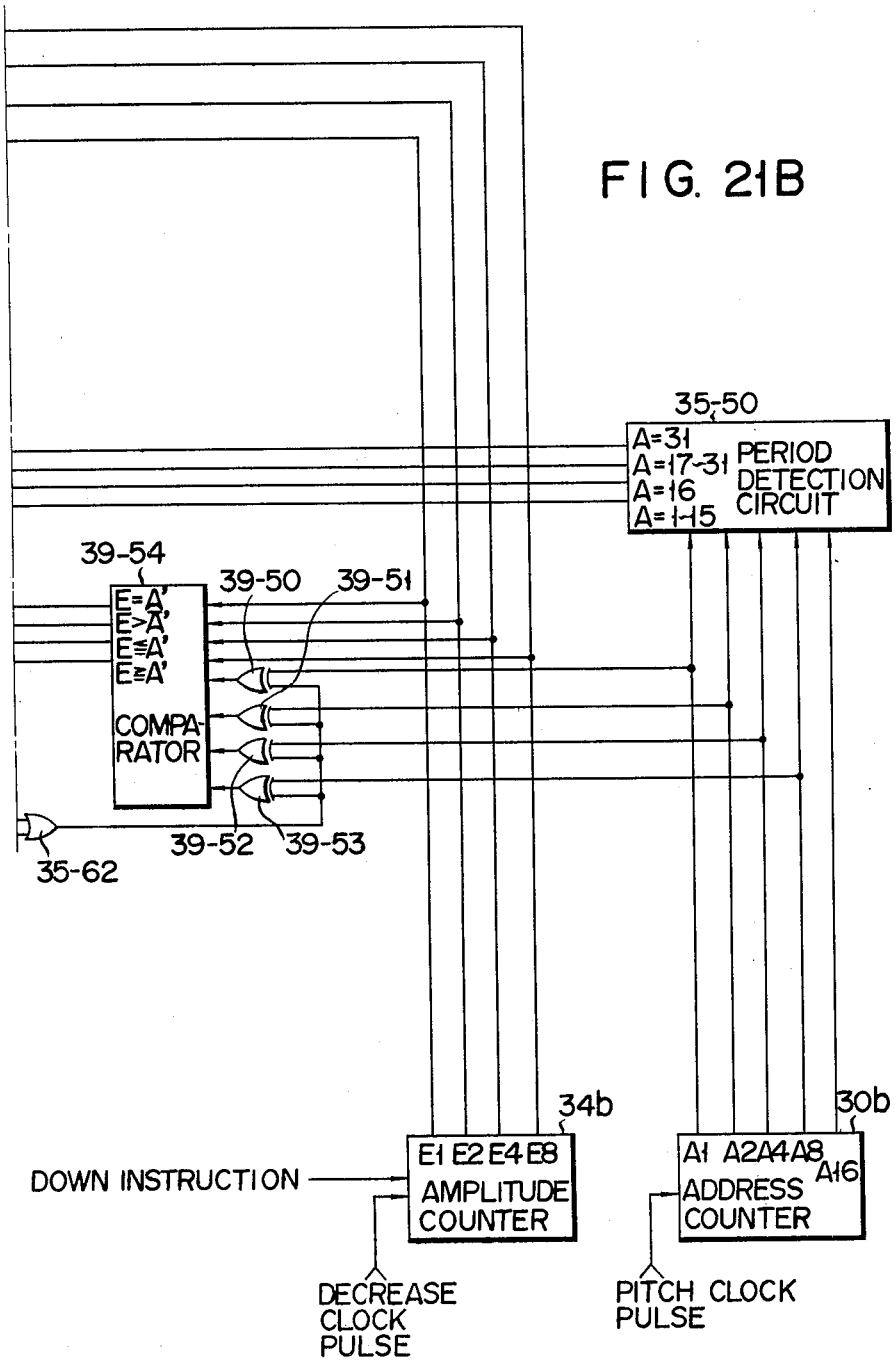

FIGS. 21A and 21B show a fundamental circuit arrangement by which waveforms are changed during the decrease period. A reference numeral 30*b* denotes an address counter which is supplied with a pitch clock pulse issued from the pitch clock pulse generator 29 of FIG. 1B. This address counter 30*b* has substantially the same arrangement as that of FIG. 10. A 5-bit output signal is supplied to a period detection circuit 35-50, which, like the period detection circuit 35-1 of FIGS. 10A and 10B, produces signals showing the detection of the addresses A31, A17 to 31, A16, A1 to 15. The $C_1$-storing section of the memory circuit 12 for storing the coded signals of the tone elements is supplied with the floating or fixed mode of waveform change appearing during the decrease period. Data stored in said memory 12 which has a logic code of "0" represents the fixed mode of waveform change. Data stored therein which has a logic code of "1" denotes the floating mode of waveform change. The $C_8$, $C_{16}$-storing section of the memory circuit 12 are stored with a code specifying a waveform appearing in the initial stage of the decrease period. Logic codes corresponding to the prescribed waveforms are shown in Table 1. Output signals from the $C_1$, $C_8$, $C_{16}$-storing sections of the memory circuit 12 for storing the coded signals of the tone elements are delivered to an AND-functioning matrix circuit 35-54 directly or through inverters 35-51, 35-52, 35-53. An output signal from the output terminal (1)' of the matrix circuit 35-54 is conducted to an AND gate 35-55; an output signal from the output terminal (2)' to an AND gate 35-56; an output signal from the output terminal (3)' to an AND gate 35-57; an output signal from the output terminal (4)' to an AND gate 35-58; an output signal from the output terminal (5)' to an AND gate 35-59; an output signal from the output terminal (6)' to an AND gate 35-60; and an output signal from the output terminal (7)' to an AND gate 35-6. An output signal from the period detection circuit 35-50 which denotes the detection of the address A31 is supplied to the AND gate 35-55; a signal denoting the detection of the address A[17] to [31] to the AND gates 35-57, 35-58, 35-59; a signal showing the detection of the address A[16] to the AND gate 35-56; and a signal indicating the detection of the address A[1] to [15] to the AND gates 35-60, 35-61. Output signals from the output terminals (4)', (6)' of the matrix circuit 35-54 are conducted to one of the input terminals of the EX OR gates 39-50 to 39-53 through an OR gate 35-62. The other input terminals of said EX OR gates 39-50 to 39-53 are supplied with output signals having bit weights of $A_1$, $A_2$, $A_4$, $A_8$ which are delivered from the address counter **30*b*. Output signals from said EX OR gates 39-50 to 39-53 are conducted to the comparator 39-54. This comparator 39-54 is also supplied with 4-bit output signals $E_1$, $E_2$, $E_4$, $E_8$ from the amplitude counter 34*b*. Thus the comparator 39-54 issues signals showing the results of comparison such as [E=A'], [E>$\overline{A}$'], [E≦A'], [E≧A']. A signal denoting the comparison result of [E=A'] is supplied to the AND gate 35-57; a signal indicating [E>$\overline{A}$'] to the AND gate 35-58; a signal showing [E≦A'] to the AND gate 35-59; a signal denoting [E>$\overline{A}$'] also to the AND gate 35-60; and a signal representing [E>A'] to the AND gate 35-61. Output signals from the AND gates 35-55 to 35-57 are supplied as [E] instructing signals to one of the input terminals of the AND gates 36-50 to 36-53 through an OR gate 35-63. Output bit signals from the amplitude counter 34*b* which have weights of $E_1$, $E_2$, $E_4$, $E_8$ are supplied to the "1" weight stage of the adder 36-5. Output signals from the AND gates 36-51 to 36-53 are respectively conducted to the "2", "4" and "8" weight stages of said adder 36-5. The output terminals of the adder 36-54 are connected to the respective weight bit stages of the addition-subtraction circuit 37-50. Output signals from the AND gates 35-58 to 35-61 are supplied as signals instructing the addition of [1] to the OR gate 36-54 through the OR gate 35-64. An output signal from the period detection circuit 35-50 which shows the detection of the address 17 to 31 is supplied as a subtraction instruction to the addition-subtraction circuit 37-50. The respective bit output signals therefrom are fed back to the corresponding bit weight stages thereof through a latch circuit 37-51. An output signal from the latch circuit 37-51 is sent forth to the D/A converter 40 of FIG. 1A**.

Where the period is changed from the transform to the decrease, then the amplitude counter **34*b*** is supplied with a down counting-instructing signal coded as "1".

There will now be described by reference to FIGS. 2A and 2B the process of changing waveforms during the decrease period. Reference is first made to the waveforms of FIGS. 9A and 9B numbered as [01], [03], [05], [11], [13], [15], [21], [23], [25] whose fundamental waveforms are reduced in the floating mode in accordance with an amplitude value counted by the amplitude counter **34*b***.

<J>

There will now be described by reference to FIG. 22 the process of changing a sawtooth wave appearing in the initial stage of the decrease period in the floating mode.

In this case, the $C_1$-storing section of the memory circuit 12 for storing the coded signals of the tone elements is supplied with a signal instructing the floating mode waveform change which has a logic code of "1". The $C_8$, $C_{16}$-storing sections of said memory circuit 12 are respectively supplied with a signal instructing the floating mode waveform change which has a logic code of "0". Accordingly, the output terminals (2)', (5)' of the matrix circuit 35-54 are made ready to produce an output signal. The AND gates 35-56, 35-59 are always supplied with a gate signal.

Figure 22:
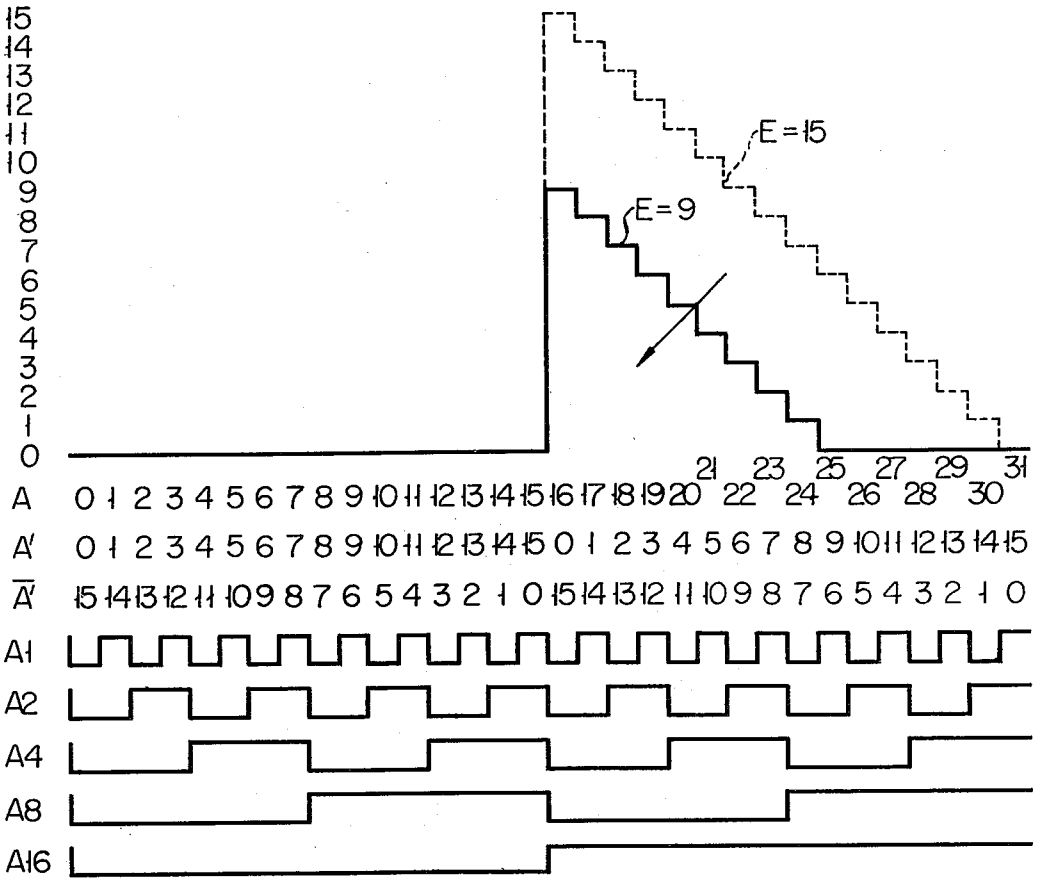
FIGS. 22 to 24 indicate the processes by which changes take place during the decrease period of FIGS. 9A and 9B in the sawtooth, triangular and rectangular waveforms respectively.

Now let it be assumed that the amplitude counter **8*b* counts a maximum amplitude value of [15], and a waveform appearing in the initial stage of the decrease period has a fundamental sawtooth wave indicated in dotted lines in FIG. 22. Further let it be supposed that the amplitude counter 34*b* is supplied with a down-counting instruction, and an amplitude value counted by said amplitude counter 34*b* is down-counted by [1] each time a decrease clock pulse $\phi d$ (comprehensibly representing the decrease clock pulses $\phi d_1$, $\phi d_2$, $\phi d_3$, $\phi d_4$ of FIGS. 6, 7 and 8**) is received, until a counted amplitude value of [9] (coded as "1001") is reached.

<J-1> (E=9)

(refer to the solid line waveform of FIG. 22)

Where the address counter **30*b* counts a step number of [0] to [15] with the amplitude value counted to be [E=9], then the AND gates 35-56, 35-59 are not opened, nor is produced an output signal from the addition-subtraction circuit 37-50. Where the address counter 30*b* counts a step number of [16], then the period detection circuit 35-50 issues a signal denoting the detection of the address $A_{16}$. Accordingly, the AND gate 35-56 is opened, causing an [E]-instructing signal to be delivered through the OR gate 35-63 to one of the input terminals of the AND gates 36-50 to 36-53. As a result, an output signal from the amplitude counter 34*b* which denotes an amplitude value of [E=9] passes through the AND gates 36-50 to 36-53. Output signals from these AND gates are supplied to the input terminals of the addition-subtraction circuit 37-50 which have the corresponding weights, thereby causing an addition value of [9] to be stored in the addition-subtraction circuit 37-50. Where the address counter 30*b* counts a step number of [17] to [25] in which the requisite comparison of [E≦A'] is met, then the AND gate 35-59 is opened, causing a signal instructing the addition of [1] to be sent forth through the OR gate 35-64 and supplied to the [1] weight stage of the addition-subtraction circuit 37-50 through the adder 36-54. Where the address counter counts a step number of [17] to [25], and the period detection circuit 35-50 sents forth a subtraction instruction to the addition-subtraction circuit 37-50, then the addition value of [9] is decreased by [1] for each step, until said number of [9] is reduced to [0] when a step number of [25] is counted. As a result, the solid line sawtooth wave of FIG. 22** is produced. Where, therefore, an amplitude value of [E=9 is counted, there is obtained a sawtooth wave similar to the fundamental sawtooth wave appearing when an amplitude value of [E=15] is counted, though proportionally smaller in size, that is, amplitude and width.

<J-2>

The above-mentioned similar change in a sawtooth wave also takes place, where the amplitude counter **34*b* counts other amplitude values. As the amplitude value is down-counted, a sawtooth wave is rendered similarly smaller in the direction of an arrow indicated in FIG. 22**, until the waveform finally disappears.

<K>

There will now be described by referenc to FIG. 23 the process of changing a triangular wave in the initial stage of the decrease period into a similar triangular wave in the floating mode.

In this case, the $C_1$-storing section of the memory circuit 12 for storing the coded signals of the tone elements is supplied with a floating mode-instructing signal having a logic code of "1". The $C_8$ and $C_{16}$-storing sections of said memory circuit 12 are respectively supplied with floating mode-instructing signals having logic codes of "0" and "1". Accordingly, the output terminals (5)', (6)' of the matrix circuit 35-54 are made ready to produce an output signal. Output signals from the output terminals (5)', (6)' are always supplied as gate signals to the AND gates 35-59, 35-60 respectively. An output signal from the output terminal (6)' is also supplied as a gate signal to the EX OR gates 39-50 to 39-53 through the OR gate 35-62. Now let it be assumed that the amplitude counter **34*b* counts a maximum amplitude value of [15] and the dotted line fundamental triangular wave of FIG. 23 appears in the initial stage of the decrease period. Further, let it be supposed that an amplitude value previously counted by the amplitude counter 34*b*** has been down-counted to an amplitude value of [9] coded as "1001".

<K-1> (E=9)

Figure 23:
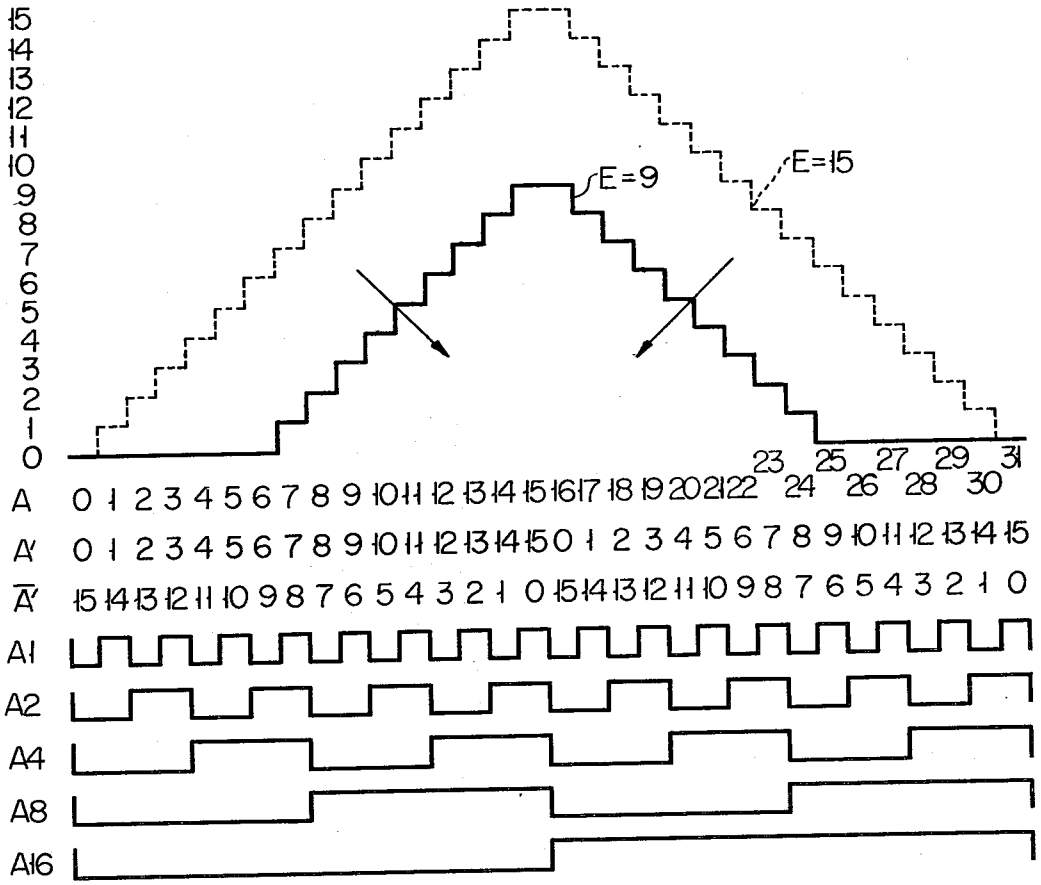

(refer to the solid line triangular wave of FIG. 23)

Where the address counter **30*b* counts a step number of [0] to [6] with the amplitude value counted to be [E=9], then a signal denoting the requisite comparison result is not produced from the comparator 39-54. Consequently, no output signal is issued from the AND gates 35-59, 35-60. Where the address counter 30*b* counts a step number of [7], then the comparator 39-54 sends forth a signal showing the detection of the requisite comparison result of [$E>\overline{A}'$]. Accordingly, the AND gate 35-60 is opened, causing a signal instructing the addition of [1] to be issued from the OR gate 35-64 to the "1" weight stage of the addition-subtraction circuit 37-50. The signal instructing the addition of [1] is continued to be issued, while the address counter 30*b* counts a step number of [0] to [15] in which the requisite comparison result of [$E>\overline{A}'$] is met. While, therefore, the address counter 30*b* counts a step number of [7] to [15], a count stored in the addition-subtraction circuit 37-50 is increased by [1] for each step. Where a step number of [15] is counted, a counted amplitude value stands at [9]. Where the address counter 30*b* counts a step number of [16], then the AND gates 35-59, 35-60 remain closed, causing the counted amplitude value of [9] to be held. Where the address counter counts a step number of [17] to [25], then the comparator 39-54 sends forth a signal showing the detection of the requisite comparison result of [$E\leqq A'$] to the AND gate 35-59. As a result, a signal instructing the subtraction of [1] is issued through the OR gate 35-64 to the "1" weight stage of the addition-subtraction circuit 37-50. At this time, the addition-subtraction circuit 37-50 is supplied with a subtraction instruction from the period detection circuit 35-50. Where, therefore, the address counter 30*b* counts a step number of [17] to [25], the above-mentioned counted amplitude value of [9] is decreased by [1] for each step, until said amplitude value is reduced to [0] when a step number of [25] is counted. As a result, the solid line triangular wave of FIG. 23** is produced. Where, therefore, an amplitude value of [E=9] is counted, there is produced a triangular wave similar to the fundamental triangular wave appearing when an amplitude value of [E=15] is counted, though proportionally smaller in size, that is, amplitude and width.

<K-2>

The above-mentioned similar change in the triangular wave also takes place where the amplitude counter **34*b* counts other amplitude values. As an amplitude value is down-counted, a triangular wave grows similarly smaller in the direction of arrows shown in FIG. 23**, until the triangular wave disappears.

<L>

There will now be described by reference to FIG. 24 the process of changing a rectangular wave appearing in the initial stage of the decrease period into a similar rectangular wave in the floating mode in the final stage of said decrease period.

In this case, the $C_1$-storing section of the memory circuit 12 for storing the coded signals of the tone elements is supplied with a signal instructing a floating mode waveform change which has a logic code of "1". The $C_8$ and $C_{16}$-storing sections of the memory circuit 12 are respectively supplied with signals instructing a floating mode waveform change which have logic codes of "1" and "0". Accordingly, the output terminals (2)', (3)' of the matrix circuit 35-54 are made ready to produce an output signal. Output signals from said output terminals (2)', (3)' are always supplied as gate signals to the AND gates 35-56, 35-57 respectively. Now let it be assumed that the amplitude counter **34*b* counts a maximum amplitude value of [15], and the dotted line fundamental rectangular wave of FIG. 24 appears in the initial stage of the decrease period. Further, let it be supposed that an amplitude value previously counted by the amplitude counter 34*b*** is down-counted to [9] coded as "1001".

<L-1> (E=9)

Figure 24:
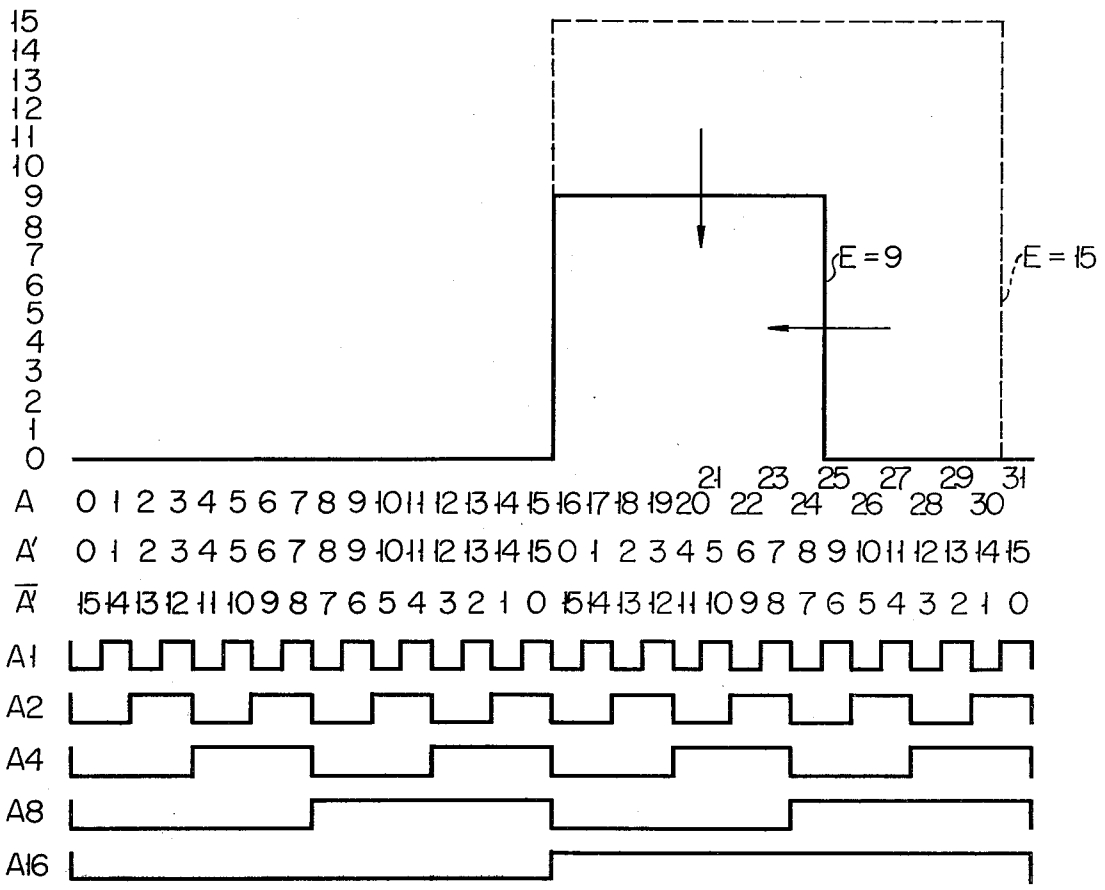

(refer to the solid line rectangular wave of FIG. 24)

Where the address counter **30*b* counts a step number of [0] to [15] with an amplitude value counted be [E=9], then the AND gates 35-56, 35-57 are not opened. Where the address counter 30*b* counts a step number of [16], then the period detection circuit 35-50 issues a signal denoting the detection of the address $A_{16}$. Accordingly, the AND gate 35-56 is opened, causing an [E]-instructing signal to be supplied to one of the input terminals of the AND gates 36-50 to 36-53 through the OR gate 35-63. As a result, an amplitude value of [9] (coded as "1001") counted by the amplitude counter 34*b* is supplied to the input terminal of the addition-subtraction circuit 37-50 which has the corresponding weight through any of the AND gates 36-50 to 36-53 and adder 36-54. Thus, an addition value of [9] is supplied to the addition-subtraction circuit 37-50. Where the address counter 30*b* counts a step number of [17] to [24], then neither of the AND gates 35-56, 35-57 is opened, causing the counted amplitude value of [9] to be held in the addition-subtraction circuit 37-50. Where the address counter 30*b* counts a step number of [25], then the comparator 39-54 sends forth a signal denoting the detection of the requisite comparison result of [E=A'] to the AND gate 35-57. As a result, this AND gate 35-57 is opened, causing an [E]-instructing signal to be conducted through the OR gate 35-63 to the AND gates 36-50 to 36-53. An amplitude value of [9] (coded as "1001") counted by the amplitude counter 34*b* is supplied through the AND gates 36-50 to 36-53 to the input terminal of the addition-subtraction circuit 37-50 which has the corresponding weight. Since, at this time, the addition-subtraction circuit 37-50 is supplied with a subtraction instruction, the amplitude value of [9] is reduced to [0], thus providing the solid line rectangular wave of FIG. 24**. Where, therefore, an amplitude value of [E=9] is counted, there is produced a rectangular wave similar to the fundamental rectangular wave appearing when an amplitude value of [E=15] is counted, though proportionally smaller in size, that is, amplitude and width.

<L-2>

Obviously, the above-mentioned similar change in the rectangular wave takes place with respect to other amplitude values counted by the amplitude counter **34*b*. As an amplitude value is counted down, a rectangular wave grows smaller in the direction of arrows indicated in FIG. 24**, until the rectangular wave finally disappears.

A process substantially the same as that which is used to effect the fixed mode waveform change during the increase period can be applied in carrying out the fixed mode change of a fundamental waveform appearing in the initial stage of the decrease period in accordance with an amplitude value counted by the amplitude counter **34*b*. With the cut-off top portion of the waveform kept unchanged (refer to the waveforms of FIGS. 9A and 9B which are numbered as [00], [02], [04], [10], [12], [14], [20], [22], [24]). The only difference between a waveform-changing process during the increase period and that during the decrease period is that a waveform is grown with an increase in a counted amplitude value so as to reduce the height of the cut-off top portion, finally providing a desired fundamental waveform, whereas, during the decrease period, a fundamental waveform is gradually reduced in size with a decline in a counted amplitude value so as to cut off the top portion to a greater extent, thereby causing the waveform finally to disappear. In other words, both processes carry out waveform change in exactly the opposite directions. During the decrease period, the output terminals (2)', (4)' of the matrix circuit 35-54** are made ready to send forth an output signal when a sawtooth wave appearing in the initial stage of the decrease period is changed in the fixed mode. The output terminals (4)', (7)' are ready for issue of an output signal when a triangular wave appearing in the initial stage of the decrease period is changed in the fixed mode. The output terminals (1)', (2)' get ready to generate an output signal when a rectangular wave produced in the initial stage of the decrease period is changed in the fixed mode. Detailed description of the above-mentioned waveform-changing processes during the decrease period is omitted.

The increase clock pulse $\phi i$, transform clock pulse $\phi t$ and decrease clock pulses $\phi d_1$, $\phi d_2$, $\phi d_3$, $\phi d_4$ have, as previously mentioned, a far longer period than a pitch clock pulse. While, therefore, a count made by the amplitude counter **34*a* or 34*b* is counted up or down by [1] for each step, the address counter 30*a* or 30*b* counts a plurality of cycles. As naturally expected, therefore, the same waveform is produced several times for each amplitude value. In this case, a synchronization control circuit (not shown in FIGS. 10A, 10B, 21A and 21B) is provided to prevent an amplitude value counted by the amplitude counter 30*a* or 30*b*** from being unnecessarily counted up or down during the growth of a waveform.

There will now be described the concrete embodiment of this invention by reference to FIGS. 25A-1 to 25D-2. The circuits shown in these drawings are arranged in such connected state as indicated in FIG. 26. Referential numeral 100 denotes an assembly of an address memory having eight parallel arranged shift registers $A_1$, $A_2$, $A_4$, $A_8$, $A_{16}$, $A_{32}$, $A_{64}$, $A_{128}$, each of which comprises eight series-arranged bits. These shift registers correspond to eight weight bit stages "1", "2", "4", "8", "16", "32", "64", "128", as counted from the left side of FIG. 25A. The respective rows constituted line memories $m_1$, $m_2$ . . . $m_7$, $m_8$. These line memories $m_1$ to $m_8$ have a capacity of independently storing a counter step address number. Even where, for example, eight performance keys at maximum are operated to produce a chord in proper time division, the line memories $m_1$ to $m_8$ can collectively store eight pitch data represented by the respective performance keys. Therefore, the line memories $m_1$ to $m_8$ independently control the operation of a musical instrument type-selecting system in accordance with the pitch data. Output signals from the respective bit stages of the foremost line memory $m_1$ are supplied to the bit input terminals of a counter 101 of FIG. 25B-2 (hereinafter referred to as "as address counter") which have the corresponding weights.

Address counter 101 counts the pitch clock pulses of the depressed pitch keys separately for the line memories $m_1$ to $m_8$. Pitch clock pulses successively added up are shifted as counted step numbers throughout the line memories $m_1$ to $m_8$ including an associated loop (not shown). Output signals from the "1", "2", "4", "8" and "16" weight stages of the foremost line memory $m_1$ are supplied to an AND-functioning period detection circuit 107 in the matrix array directly or through the corresponding inverters 102 to 106. The period detection circuit 107 detects step numbers corresponding to the addresses A[31], A[16], A[16 to 31] and A[0]. Output signals from the "1", "2", "4" and "8" weight stages of the foremost line memory $m_1$ are also supplied to one of the input terminals of the EX OR gates 108 to 111 respectively. Output signals from the "32", "64" and "128" weight stages of the foremost line memory $m_1$ are conducted through the corresponding inverters **112*a* to 112*c* of FIG. 25B-1 to an AND-functioning matrix octave detection circuit 113** which is supplied with an octave shift instruction. An octave shift instruction enables an octave to be shifted in three stages, that is, a low-, medium- and high-levels as shown in Table 3 below.

TABLE 3

| $D_1$-storing section | $D_2$-storing section | Type of specified octave |
|---|---|---|
| off | off | Low octave |
| off | on | Medium octave |
| off | off | High octave |

Output signals from the octave detection circuit 113 which specify a low-, medium- and high-octaves are sent forth through an OR output line 114 (FIG. 25B-1) as signals demanding the octave shift (hereinafter referred to as "mid-wave signals"). Said "mid-wave signals" corresponding to the octave type-specifying signals and output signals from the period detection circuit 107 (FIG. 25A-2) are produced in a timing indicated in the time chart of FIGS. 27A and 27B. As seen from FIGS. 27A and 27B, signals instructing a low-, medium- and high-octaves divide the corresponding mid-wave signals into halves in succession. In other words, the frequencies of the respective mid-wave signals are successively doubled. Where the pitch clock pulses corresponding to the 48 pitch keys of FIG. 3 specify a high octave, then the frequencies of pitch clock pulses corresponding to the pitch keys used in the medium octave are rendered to half the frequencies of clock pulses corresponding to the pitch keys used in the high octave. The frequencies of pitch clock pulses corresponding to the pitch keys used in the low octave are further reduced to half the frequencies of clock pulses corresponding to the pitch keys used in the medium octave. Thus, application of an octave shift instruction enables an electronic musical instrument to be played over a tone range broadened to six octaves at maximum.

Figure 27A:
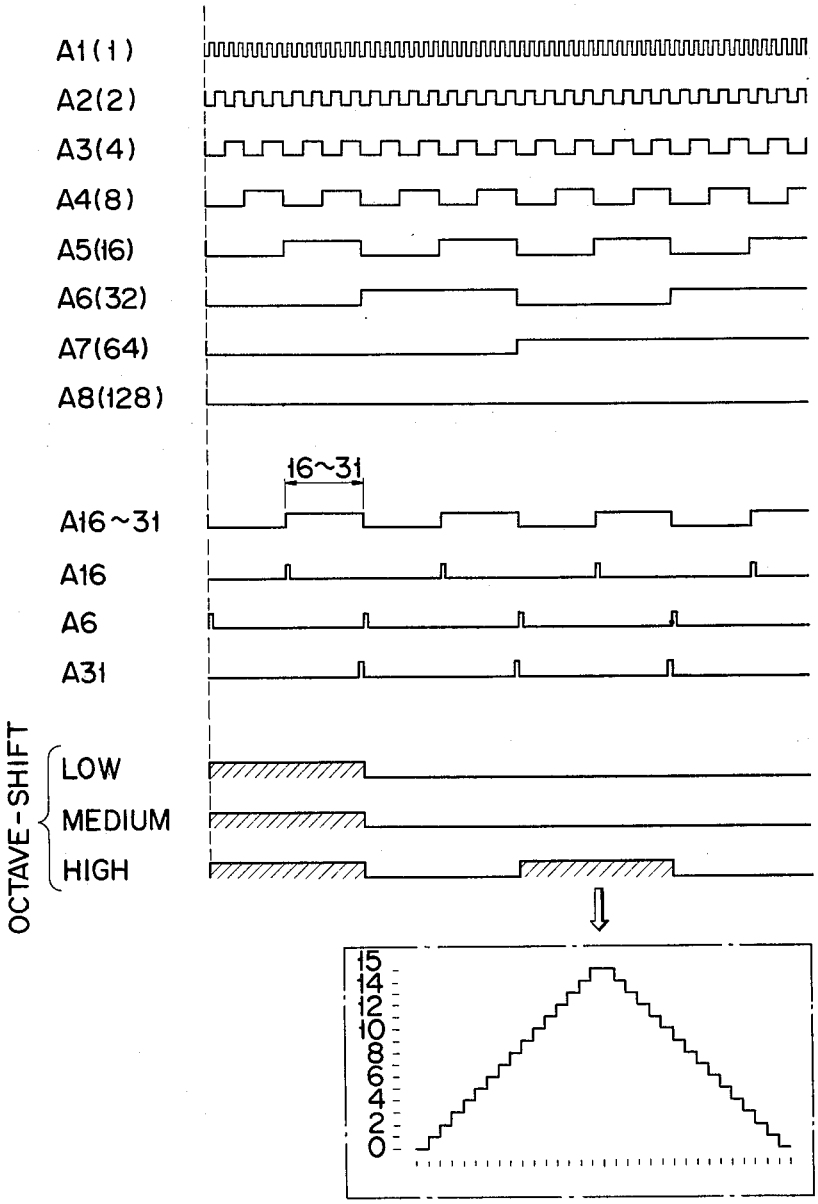
FIGS. 27A and 27B show the waveforms of signals related to the counting of step addresses in FIGS. 25A-1 to 25D-2.
Figure 27B:
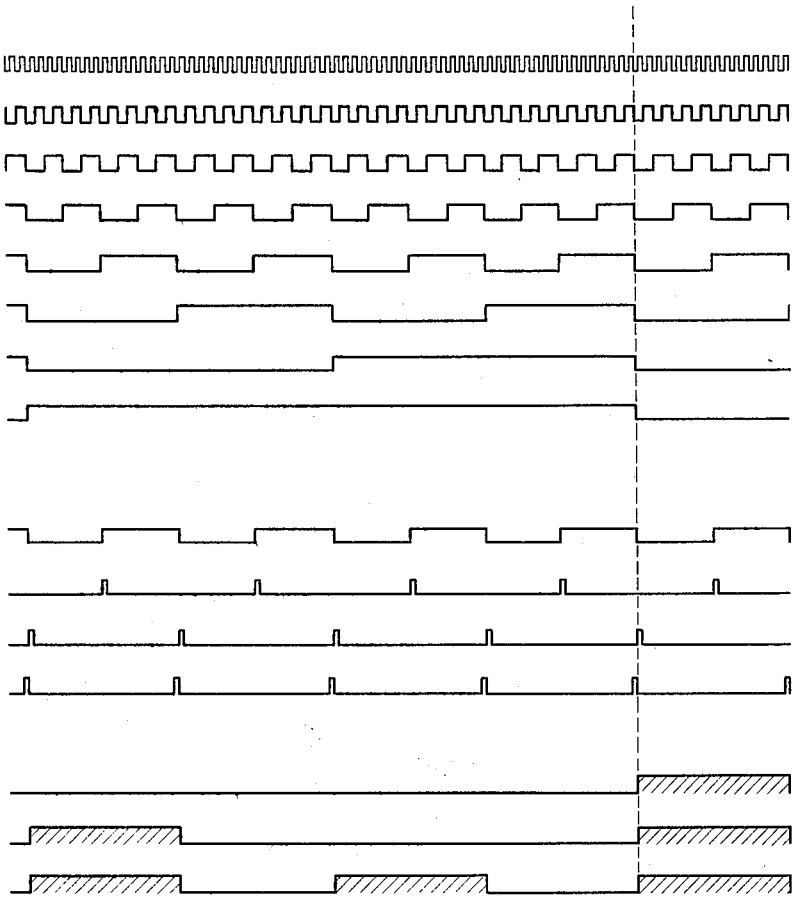

As later described, only the mid-wave signal represented by a hatched section shown in FIGS. 27A and 27B produces the triangular, sawtooth and rectangular waves (for convenience, FIGS. 27A and 27B illustrates a triangular wave).

Reference numeral 115 of FIG. 25A-2 denotes an amplitude value-specifying memory (hereinafter referred to as "an amplitude memory"). This memory 115 consists of four parallel arranged shift registers $m_1$ to $m_8$, each of which comprises eight series-arranged bit stages. The four parallel-arranged shift registers correspond to "1", "2", "4" and "8" weight bit stages $E_1$, $E_2$, $E_4$, $E_8$. The respective rows $m_1$ to $m_8$ correspond to the line memories $m_1$ to $m_8$ of the address memory 100. Output signals from the weight bit stages $E_1$, $E_2$, $E_4$, $E_8$ of the foremost line memory $m_1$ of the amplitude memory 115 are supplied to the corresponding weight bit stages $E_1$, $E_2$, $E_4$, $E_8$ of the amplitude counter 116 (FIG. 25B-2). Output signals from the weight bit stages $E_1$, $E_2$, $E_4$, $E_8$ of the amplitude counter 116 are shifted through the AND gates 117 to 120. This amplitude counter 116 has the same arrangement as the amplitude counter 34 of FIG. 1A, and can count a maximum amplitude value of [15]. Counting by said amplitude counter 116 is controlled upon receipt of a signal instructing the addition of [+3] during the increase period and a down-counting instruction and a signal instructing the addition or subtraction of [1] during the transform and decrease periods.

Figures 1, 25A:
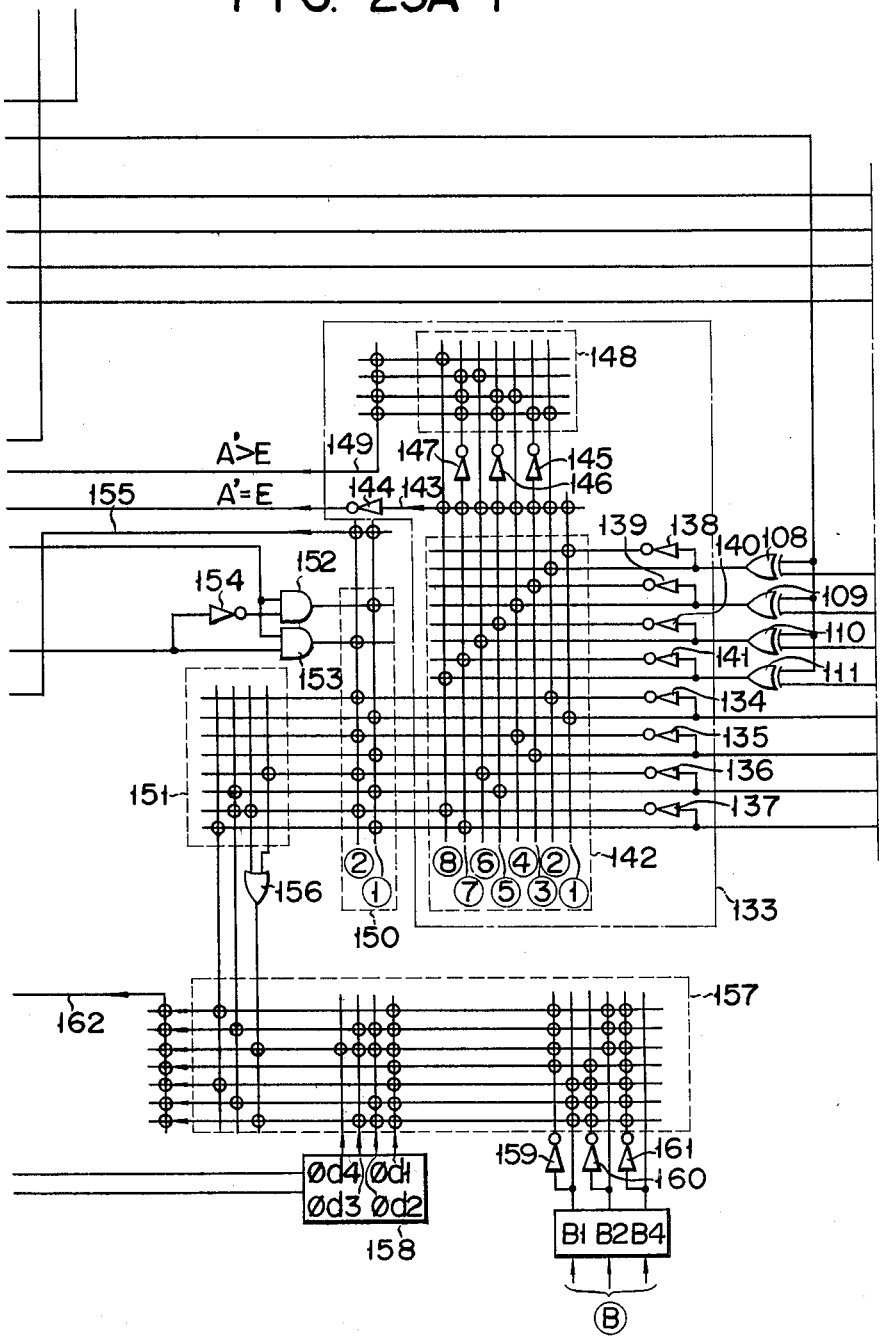
FIGS. 25A-1, 25A-2, 25B-1, 25B-2, 25C-1, 25C-2, 25D-1 and 25D-2 show the concrete arrangements of circuits used in this invention.
Figures 2, 25A:
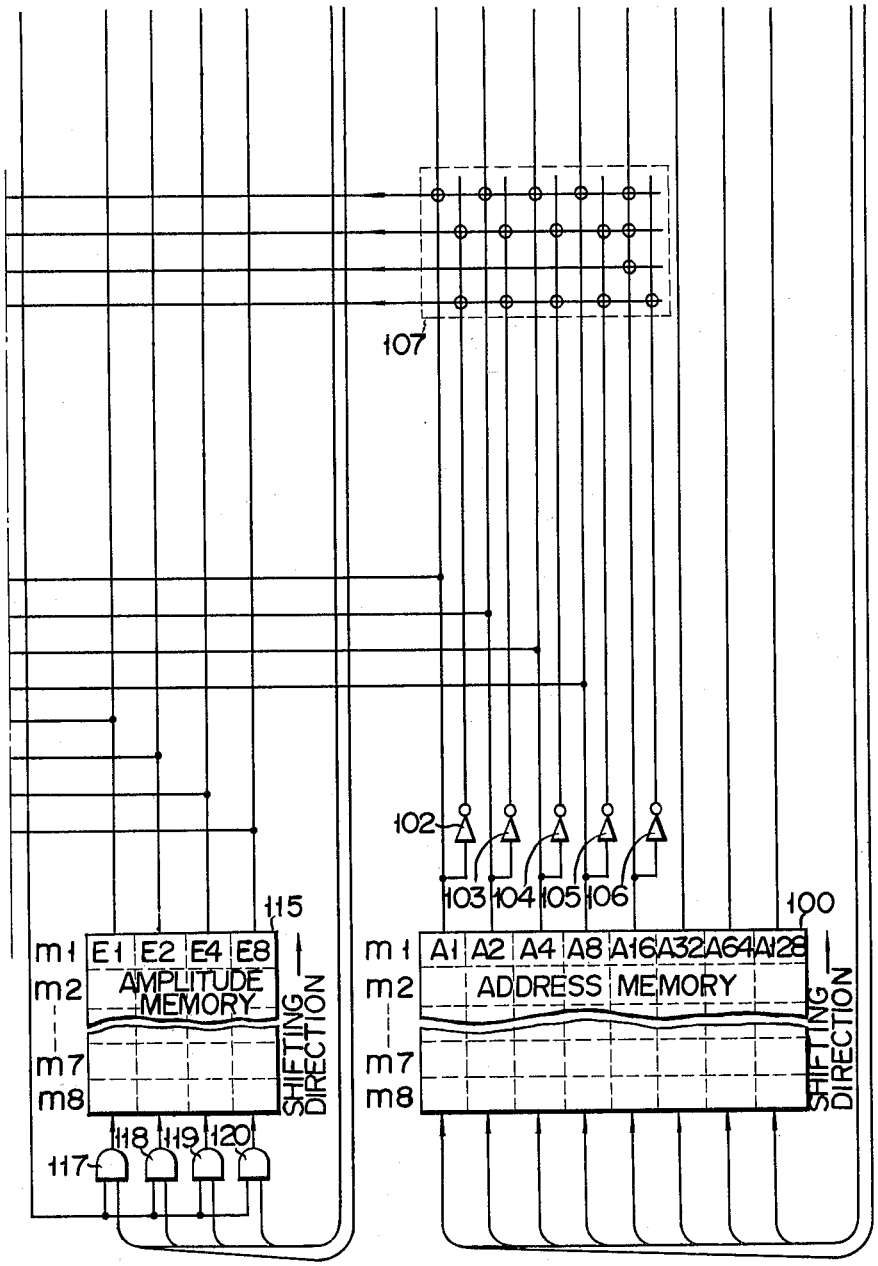
Figures 1, 25B:
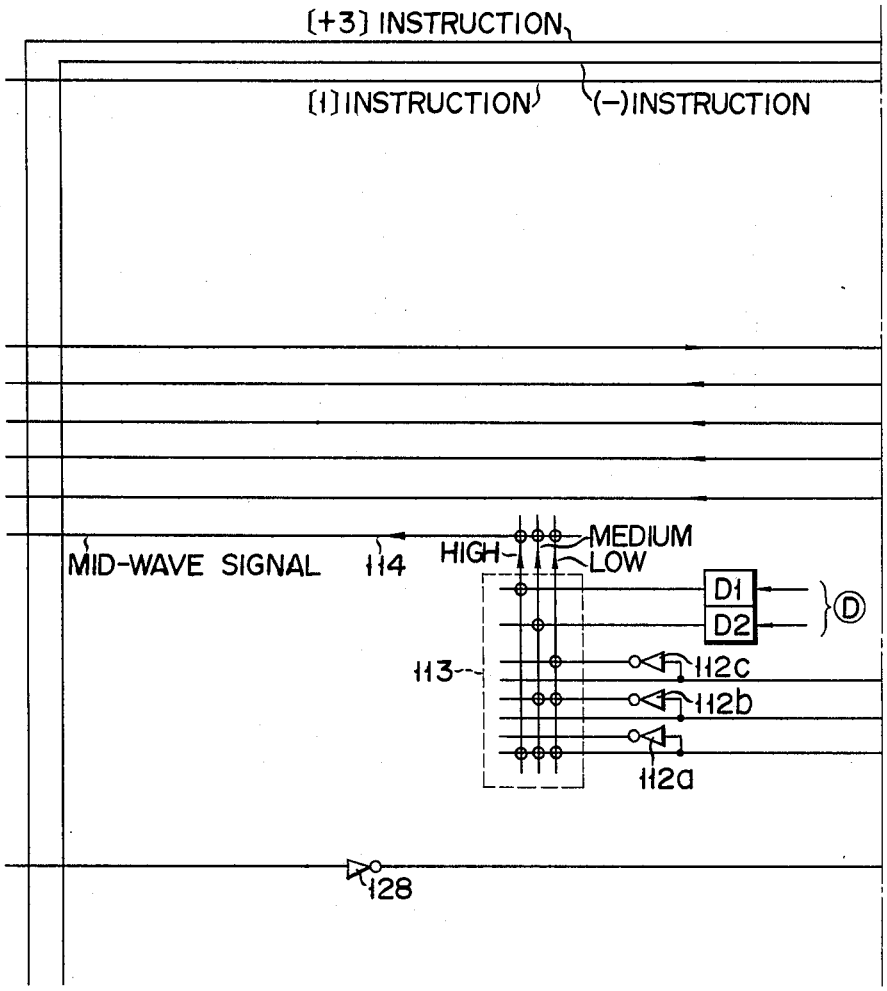
Figures 2, 25B:
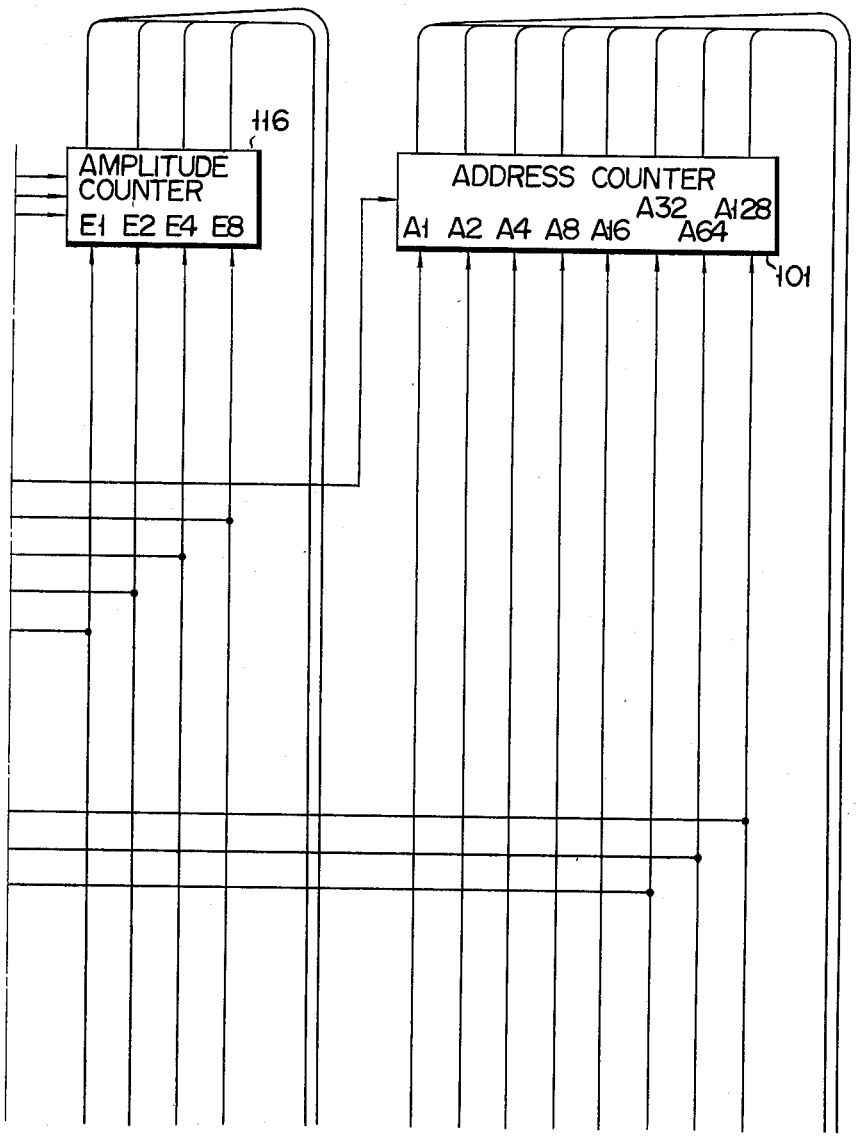
Figures 1, 25C:
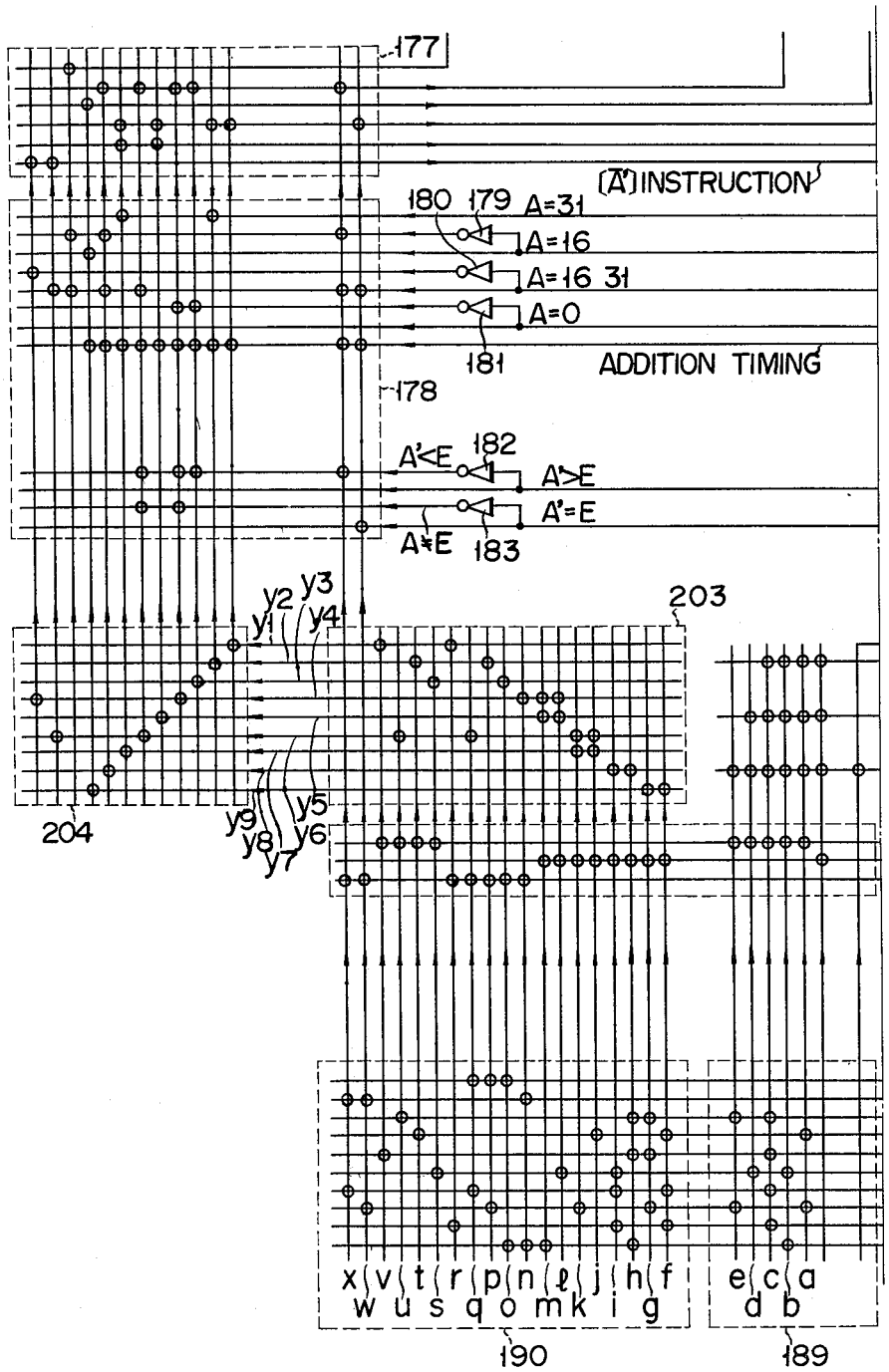
Figures 2, 25C:
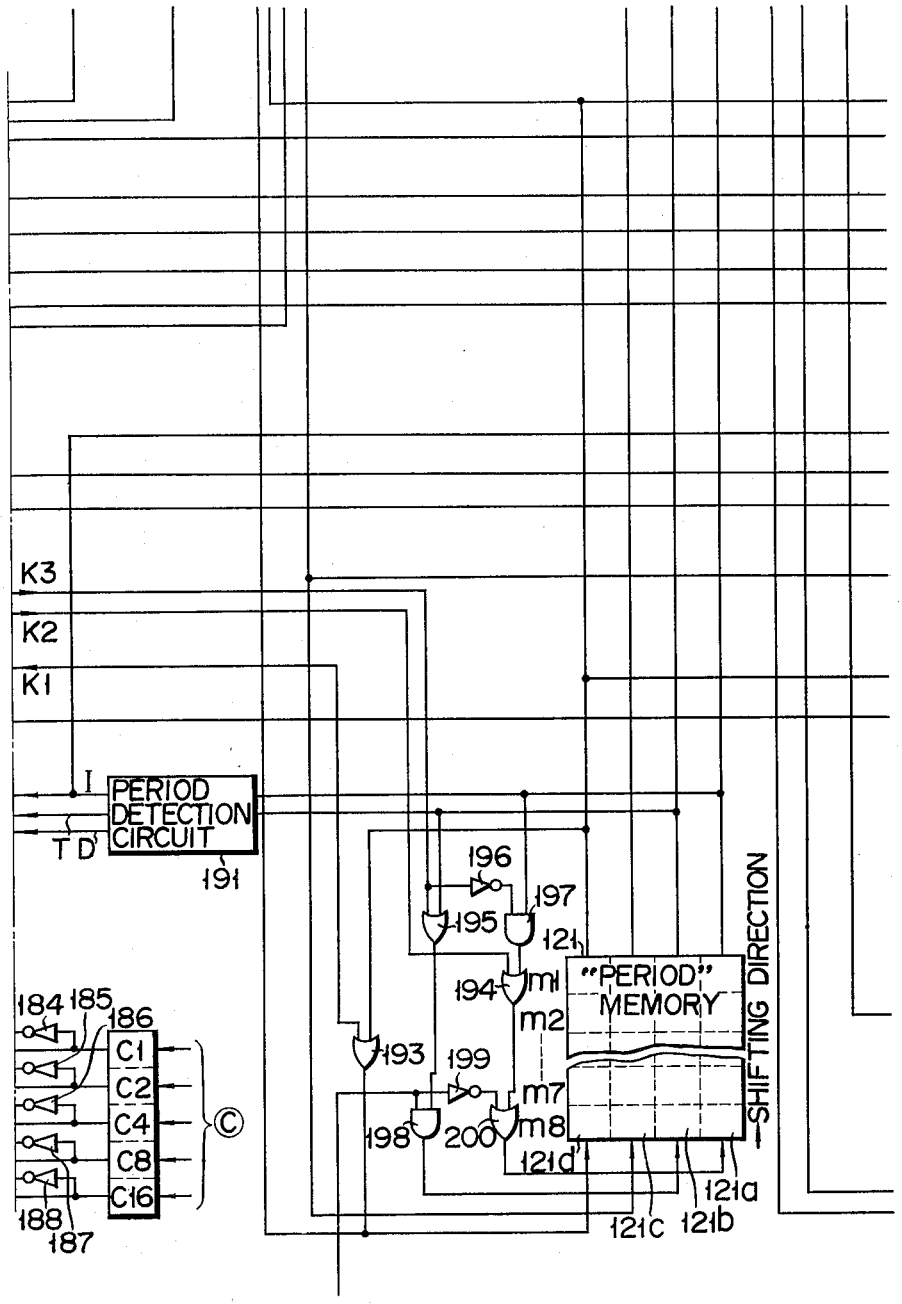

Reference numeral 121 of FIG. 25C-2 denotes a period memory for storing the respective controlled stages of waveforms. The eight line memories $m_1$ to $m_8$ of this period memory 121 correspond to those of the address memory 100 and amplitude memory 115. The storing sections **121*a*, 121*b* of the period memory 121** which are denoted by two bit codes of "0" and "1" specify the three periods of waveforms by combinations of said bit codes, as indicated in Table 4 below.

TABLE 4

| 121a | 121b | Stored data |
|---|---|---|
| 0 | 0 | Clear period |
| 1 | 0 | Increase period |
| 0 | 1 | Transform period |
| 1 | 1 | Decrease period |

The data stored in the line memories $m_1$ to $m_8$ of the address memory 100, amplitude memory 115 and period memory 121 are dynamically shifted in the direction of the indicated arrows upon receipt of shift clock pulses. Data read out of said line memories $m_1$ to $m_8$ are processed by the same control system in accordance with the contents of said data.

Figures 1, 25D:
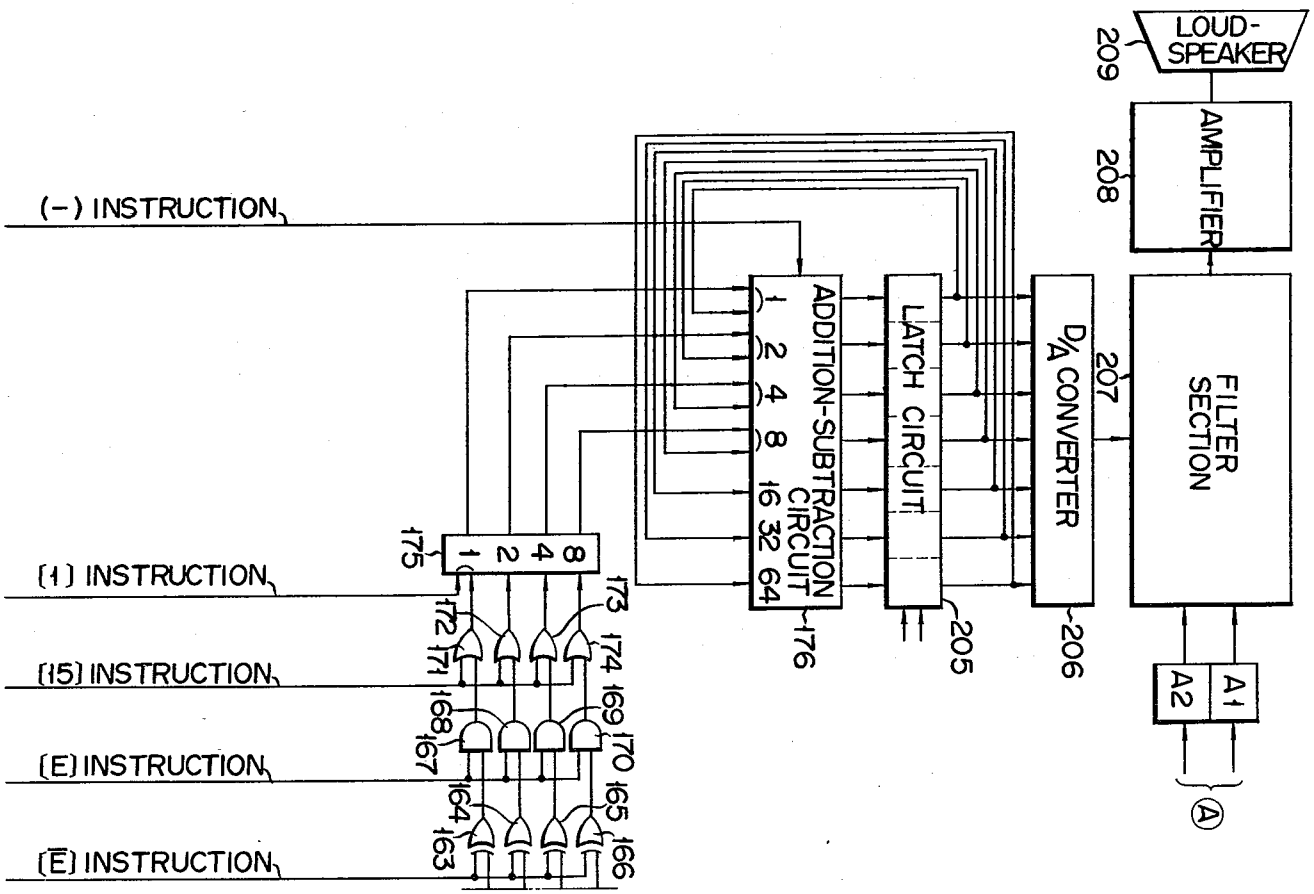
Figures 2, 25D:
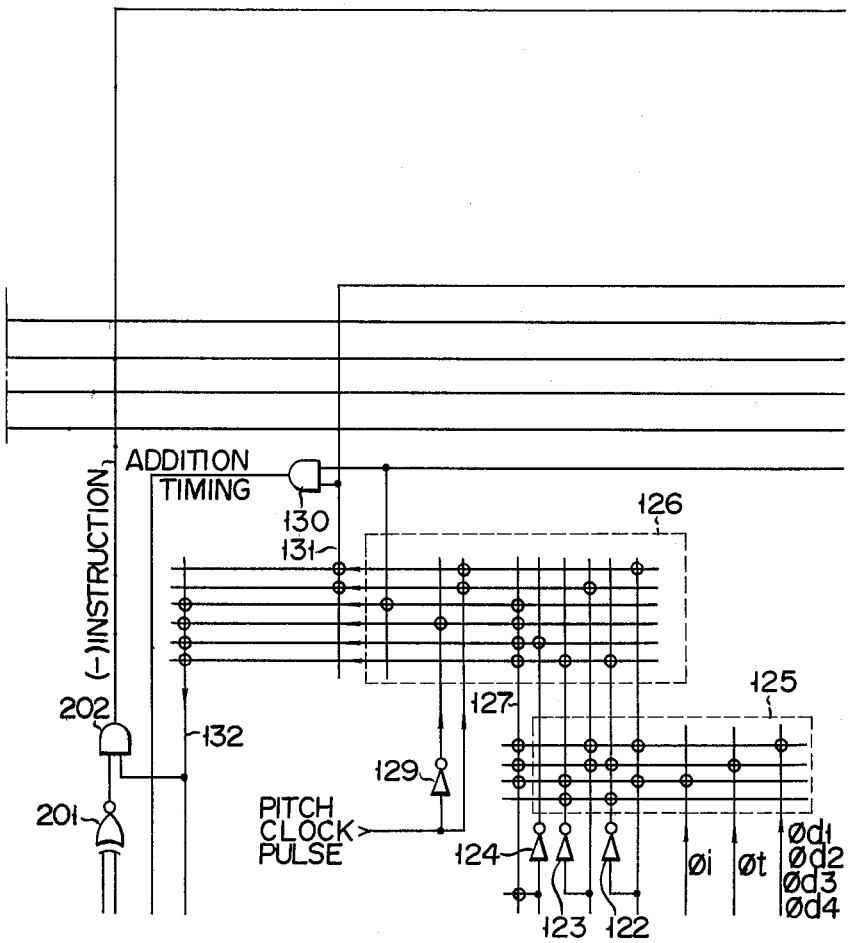

With the musical instrument type-selecting system of this invention comprising a plurality of line memories, the line memories are selectively specified for the performance keys depressed for a chord simultaneously or in proper time division. Thus, step numbers counted by the pitch clock pulses corresponding to the depressed performance keys are stored in the line memories $m_1$ to $m_8$ of the address memory 100. In other words, pitch clock pulses supplied to the address counter 101 of FIG. 25B-2 through the matrix circuit 126 of FIG. 25D-2 are sent forth through a control circuit (not shown) at frequencies corresponding to the depressed pitch keys from the separate line memories $m_1$ to $m_8$.

The storing section **121*c* (FIG. 25C-2) of the period memory 121 constitutes a synchronization memory. While the aforesaid mid-wave signal is generated, said storing section 121*c* is supplied with a signal having a logic code of "1" to prevent the amplitude counter 116 from carrying out counting during the growth of a waveform until said formation is brought to an end. The storing section 121*d* of the period memory 121 is supplied with a signal instructing the up- or down-counting of the amplitude counter 116. When supplied with a signal having a logic code of "1", the storing section 121*d* issues a down-counting instruction. Output signals from the storing sections 121*a*, 121*b* of the period memory 121 are conducted directly or through inverters 122, 123 to an AND-functioning matrix circuit 125. An output signal from the storing section 121*c* of the period memory 121 is supplied through an inverter 124 to an AND-functioning matrix circuit 126. The matrix circuit 125 is supplied with the later described increase clock pulse $\phi i$ and transform clock pulses $\phi t_1$, $\phi t_2$, $\phi t_3$, $\phi t_4$. The clock pulses of the increase and transform periods are read out of the matrix circuit 125. Output clock pulses from the matrix circuit 125 which correspond to the respective periods are conducted to the matrix circuit 126 through an OR output line 127, together with an output signal from the storing section 121*c* of the period memory 121. A signal coded as "00" for detection of the clear period (Table 4) which is detected by the matrix circuit 125 is supplied through an inverter 128 of FIG. 25B-1 to the AND gates 117 to 120 for controlling the supply of a signal to the amplitude memory 115, thereby stopping the shifting of data in the corresponding line memory of the amplitude memory 115** and clearing the data stored therein.

A pitch clock pulse is supplied directly and through an inverter 129 to the matrix circuit 126. A mid-wave signal being delivered to the output line 114 is also conducted to said matrix circuit 126. The mid-wave signal is further sent forth to one of the input terminals of the AND gate 130. Pitch clock pulses issued through the OR output line 131 from the matrix circuit 126 during the increase, transform and decrease periods are supplied to the other input terminal of said AND gate 130. Only where the mid-wave signal is issued, a pitch clock pulse is sent forth from the AND gate 130 as an addition timing signal. Where the OR output line 127 receives from the matrix circuit 125 a clear state detection signal coded as "00", synchronization signal, pitch clock pulse and mid-wave signal, then the output line 127 of the matrix circuit 125 sends forth a signal denoting a logic condition such as "00", synchronization, the issue of a pitch clock pulse, or the issue of a mid-wave signal. Then, a synchronization signal is supplied from the OR output line 132 to the synchronization memory 121*c*. In other words, while a mid-wave signal is generated, the amplitude counter 116 is prevented from counting.

The comparator 133 of FIG. 25A-1 makes a comparison between an amplitude value of [E] represented by a 4-bit output signal from the amplitude memory 115 and a value denoted by a 4-bit output signal issued from the EX OR gates 108 to 111, and generates an output signal showing the results of comparison such as [$\overline{A'}>E$] and [$A'=E$] (where $A'$ and $\overline{A'}$ mean the same things as described by reference to FIGS. 10A, 10B, 21A and 21B). Output four bit signals from the weight bit stages $E_1$, $E_2$, $E_4$, $E_8$ of the amplitude memory 115 are supplied to an AND-functioning matrix circuit 142 directly and through inverters 134 to 137. Output signals from the EX OR gates 108 to 111 are conducted to said matrix circuit 142 directly and through inverters 138 to 141. Output signals from the output terminals (1) to (8) of the matrix circuit 142 are combined in the OR logic mode and supplied to an inverter 144 through an output line 143. A coincidence signal representing [$A'=E$] is issued from the output terminal of said inverter 144. Output signals from the output terminals (2), (4), (6), (8) of the matrix circuit 142 are directly supplied to an AND-functioning matrix circuit 148. Output signals from the output terminals (3), (5), (7) of the matrix circuit 142 are conducted to said AND-functioning matrix circuit 148 through inverters 145 to 147. Four output signals from the matrix circuit 148 are combined in the OR logic mode, causing a signal showing the comparison result of [$A'>E$] to be produced through an output line 149. The other input terminals of the EX OR gates 108 to 111 are supplied with the later described signal instructing the comparison of [A'] with the amplitude value E. Where said comparison instruction is issued, then the output terminals of the EX OR gates 108 to 111 send forth a signal inverted from [A'], that is, a signal denoting a number complimentary to a counted number of [15] to the comparator 133. Four bit output signals from the weight bit stages $E_1$, $E_2$, $E_4$, $E_8$ of the amplitude memory 15 and output signals from the inverters 134 to 137 are also supplied to AND-functioning matrix circuits 150, 151. The matrix circuit 150 is further supplied with output signals from AND gates 152, 153. One of the input terminals of the AND gates 152, 153 is supplied with an output signal from the OR output line 132 of FIG. 25D-2. The other input terminal of the AND gate 152 is supplied with a signal inverted by an inverter 154 to instruct the up-counting of data of a logic code "0" which is read out of the storing section 121*d* of the period memory 121. The other input terminal of the AND gate 153 is supplied with a signal instructing the down-counting of data of a logic code "1" which is read out of said storing section 121*d*. The output terminal (1) of the matrix circuit 150 detects a number of [7] read out of the amplitude memory 115 during the down-counting of the amplitude counter 116. The output terminal (2) of the matrix circuit 150 detects a number of [15] read out of the amplitude memory 115 during the up-counting of said amplitude counter 116. The output terminal (3) of the matrix circuit 150 detects a number of [0] read out of the amplitude memory 115 during the down-counting of said amplitude counter 116. All the output signals from the output terminals (1), (2), (3) of the matrix circuit 150 are combined in the OR logic mode and supplied to an output line 155. An output detection signal from the output line 155 is referred to as "an amplitude division".

The output terminal (1) of the matrix circuit 151 detects a number of [10] to [15]; the output terminal (2) thereof detects a number of [12] to [15]; the output terminal (3) detects numbers of [0] to [3] and [8] to [11]; the output terminal (4) detects a number of [0] to [11]; the output terminal (5) detects or number of [4] to [7]; the output terminal (6) detects a number of [8] to [15]; all said numbers having been read out of the amplitude memory 115. Output signals from the output terminals (1), (2) of the matrix circuit 151 are supplied to a matrix circuit 157 through an OR gate 156. Output signals from the output terminals (3), (4) of said matrix circuit 151 are directly conducted to the matrix circuit 157. This matrix circuit 157 is supplied with decrease clock pulses $\phi d_1$, $\phi d_2$, $\phi d_3$, $\phi d_4$ delivered from a clock pulse generator 158 which issues clock pulses corresponding to the respective periods. The matrix circuit 157 is further supplied with output signals from the $B_1$, $B_2$ and $B_4$-storing sections of the memory circuit 12 of FIG. 1C for storing the coded signals of the tone elements directly and through inverters 159, 160, 161. The foregoing embodiment can specify three types of envelope illustrated in FIGS. 6, 7 and 8. A code of "100" read out of the $B_1$, $B_2$ and $B_4$ storing sections of the memory circuit 12 represents the envelope of FIG. 6. A code of "000" read out of said $B_1$, $B_2$ and $B_4$ storing sections denotes the envelope of FIG. 7. A code of "010" read out of said $B_1$, $B_2$ and $B_4$ storing sections indicates the envelope of FIG. 8. In the case of FIG. 6, a tone volume is controlled in such a manner that the amplitude counter 116 down-counts an amplitude value from [15] to [8] upon receipt of a decrease clock pulse $\phi d_1$, from [7] to [4] upon receipt of a decrease clock pulse $\phi d_2$, and from [9] to [0] upon receipt of a decrease clock pulse $\phi d_3$. In the case of FIG. 7, a tone volume is controlled by causing the amplitude counter 116 to carry out down-counting upon receipt of a decrease clock pulse $\phi d_1$. In the case of FIG. 8, a tone volume is controlled by causing the amplitude counter 116 to carry out down-counting upon receipt of a decrease clock pulse $\phi d_4$ instead of the decrease clock pulse $\phi d_3$ of FIG. 6. Decrease clock pulses $\phi d_1$, $\phi d_2$, $\phi d_3$, $\phi d_4$ issued from the matrix circuit 157 are combined in the OR mode and supplied to the matrix circuit 125 of FIG. 25D through an output line 162. The matrix circuit 125 also receives an increase clock pulse $\phi i$ and transform clock pulse $\phi t$ from a clock pulse generator 158. Output 4-bit signals from the amplitude memory 115 are supplied to one of the input terminals of the EX OR gates 164 to 166, whose output signals are conducted to the corresponding input terminals of OR gates 171 to 174 through the corresponding input terminals of AND gates 167 to 170. Output signals from the OR gates 171 to 174 are delivered to the weight input terminals of an adder 175, whose output signals are supplied in parallel to the corresponding bit input terminals of an addition-subtraction circuit 176. An OR-functioning matrix circuit 177 shown in FIG. 25C-1 supplies an [E]-instructing signal described by reference to FIGS. 10A, 10B, 21A and 21B to the other input terminals of the EX OR gates 163 to 166, an [E]-instructing signal to the other input terminals of the AND gates 167 to 170, a signal instructing the addition of [15] to the other input terminals of the OR gates 171 to 174, a signal instructing the addition of [1] to the adder 175, and a subtraction instruction to the addition-subtraction circuit 176.

A matrix circuit 178 shown in FIG. 25C-1 receives from the period detection circuit 107 of FIG. 25A-2 a signal denoting the detection of the address A[31] directly, a signal showing the detection of the address A[16] directly and through an inverter 179, a signal indicating the detection of the addresses A[16] to [31] directly and through an inverter 180, a signal denoting the detection of the address A[0] through an inverter 181, and a signal showing the detection of a comparison result of [A'=E] directly and through an inverter 183. The matrix circuit 178 is also supplied with an addition timing signal from the AND gate 130 of FIG. 25D-2. The inverter 179 sends forth an output signal when a step number other than that corresponding to the address A[16] is counted; the inverter 180 generates an output signal when a step number of [0] to [15] is counted; the inverter 181 produces an output signal when a step number of [1] to [31] is counted; the inverter 182 gives an output signal when a requisite comparison result of [E>A'] is met; and the inverter 183 issues an output signal when any other requisite comparison result than [A'=E] is met. The matrix circuit 178 is a control circuit for carrying out the eighteen waveform changes described by reference to FIGS. 9A and 9B, which correspond to the eighteen waveform numbers expressed by 5 bit codes $C_1$, $C_2$, $C_4$, $C_8$, $C_{16}$ respectively having weights of 1, 2, 4, 8, 16. Output signals from the $C_1$, $C_2$, $C_4$, $C_8$, $C_{16}$-storing sections of the memory circuit 12 for storing the coded signals of the tone elements are supplied directly and through inverters 184 to 188 to an AND-functioning matrix circuit 189 for controlling the 121*a*, 121*b*, 121*d* storing sections of the period memory 121 in accordance with a waveform-instructing signal and a matrix circuit 190 for issuing a waveform-instructing signal. Where the waveform numbers of FIGS. 9A and 9B are specified, the output terminals a, b, c, d, e of the matrix circuit 189 produce an output signal, as shown in Table 5 below.

TABLE 5

| Output terminals of the matrix circuit 189 | Waveform number | Contents |
|---|---|---|
| a | [12], [13] | Absence |
| b | [24], [25] | of transform |
| c | [00], [01] | period |
| d | [04], [05], [14], [15], [24], [25] | A triangular wave in the initial stage of the transform period |
| e | [10], [11], [14] [15] | Waveform changes during the transform period as triangular → rectangular and sawtooth → rectangular |

Output signals from the 121*a*, 121*b* storing sections from the period memory 121 are supplied to the period detection circuit 191, which detects the periods of the increase (I), the transform (T) and the decrease (D). Output signals from the period detection circuit 191 are supplied to a matrix circuit 192. Relationship between the respective periods and the codes of data read out of the 121*a*, 121*b* storing sections is indicated in Table 6 below.

TABLE 6

| Storing section 121a | Storing section 121b | Period | |
|---|---|---|---|
| 1 | 0 | Increase | (I) |
| 0 | 1 | Transform | (T) |
| 1 | 1 | Decrease | (D) |

The matrix circuit 189 is operated in the prescribed mode according as the increase (I), transform (T) or decrease (D) period is detected, and supplies an output signal selectively to an output line $K_1$, $K_2$ or $K_3$ in synchronization with a signal denoting an amplitude division which is sent forth from the OR output line 155 of FIG. 25A-1. An output signal from the output line $K_1$ is delivered as a down-counting instruction to the down count-storing section 121*d* through an OR gate 193. An output signal from the output line $K_2$ is supplied to one of the input terminals of an OR gate 194. An output signal from the output line $K_3$ is conducted to one of the input terminals of an AND gate 197 through an OR gate 195 and inverter 196. An output signal from the OR gate 195 is sent forth to one of the input terminals of an AND gate 198. An output signal from the AND gate 197 is carried to the other input terminal of the OR gate 194. Data read out of the 121*a*, 121*b* storing sections are supplied to the other input terminals of the AND gate 197 and OR gate 194. Where an amplitude division of [15] is detected during the increase period, then an output signal from the output line $K_3$ causes data having a logic code of "0" to be written in the 121*a* storing section and data having a logic code of "1" to be written in the 121*b* storing section, thereby providing the transform period. Where an unnecessary waveform appears during the transform period of FIGS. 9A and 9B, an output signal from the output line $K_3$ causes data having a logic code of "1" to be written in both 121*a*, 121*b* storing sections in synchronization with the detection of an amplitude division of [15], thereby setting the mode of the waveform change to the decrease period. Where a pitch key is operated, a signal having a logic code of "0" is supplied to an OR gate 200 through the AND gate 198 and inverter 199, thereby causing data having a logic code of "1" to be written in the 121*a* storing section and data having a logic code of "0" to be stored in the 121*b* storing section. These data of "1" and "0" are taken to denote the increase period. An output signal from the OR gate 193 is delivered to one of the input terminals of an EX NOR gate 201 of FIG. 25D-2, the other input terminal of which is supplied with an output signal from the 121*d* storing section of the period memory 121 of FIG. 25C-2. An output signal from the EX NOR gate 201 is supplied to an AND gate 202 which receives an output signal from the OR output line 132. An output signal from the AND gate 202 is delivered as a signal instructing the addition of [1] to the amplitude counter 116. Accordingly, said output signal from the AND gate 202 causes the amplitude counter 116 to stop counting once when counting a maximum amplitude value of [15] or a minimum amplitude value of [0].

The matrix circuit 190 controls waveform changes by waveform-specifying codes indicated in FIGS. 9A and 9B. Where a given waveform is specified, any of the output signals f to x (FIGS. 28A and 28B) from the matrix circuit 190 is issued as a control signal upon receipt of an output signal from the period detection circuit 191 which corresponds to the current period. A waveform change-controlling signal is issued from the output lines $y_1$ to $y_9$ of the matrix circuit 203 in accordance with FIGS. 28A and 28B. The output lines $y_1$ to $y_9$ of the matrix circuit 203 are selectively operated by a selection matrix 204, an output signal from which is supplied to the matrix circuit 178. A desired tone wave is produced by carrying out addition or subtraction in the addition-subtraction circuit 176 upon receipt of a waveform-controlling signal from the matrix circuit 177 in accordance with any specified one of the waveforms indicated in FIGS. 9A and 9B. Output bit signals from the addition-subtraction circuit 176 are supplied to a latch circuit 205 consisting of seven binary stages. Output seven bit signals from said latch circuit 205 are fed back to the corresponding bit input terminals of the addition-subtraction circuit 176. The respective bit output signals from the latch circuit 2-5 are conducted to a filter section 207 through a D-A converter 206. The filter section 207 is controlled to produce the characteristics of resonance, residual tones and transmission possessed by a wind instrument or a musical instrument provided with an acoustic effect upon receipt of a control signal from a filter-specifying section 219 in accordance with coded data stored in the $A_1$, $A_2$ storing sections of the memory circuit 12 for storing the coded signals of the tone elements. An output signal from the filter section 207 is conducted through an amplifier 208 to be sent forth from a loud-speaker 209.

With the foregoing embodiment, the tone elements were taken to include filter, envelope, waveform and octave shift. Obviously, the tone elements further include instructions for many other tone effects and functions such as vibrato, ensemble, and tremolo. The pitch keys well serve the purpose, if they specify at least one or more of the plural tone elements. For instance, the pitch keys are allowed to specify the waveform alone instead of the four tone elements used in the foregoing embodiment. Previously, the forty-eight pitch keys were all used to select a musical instrument type. It is of course possible to select a musical instrument type by a smaller number of pitch keys. With the foregoing embodiment, a single switch was used to broaden the range of selecting a musical instrument type. However, a plurality of such switches can be provided. If a counter having a scale larger than 3 is substituted for the aforesaid binary counter 14, then it is possible to increase a number of a musical instrument types over 48, for example, to 96, 144, or 192.

Any desired envelope shape can be used by combining the type defined by a plurality of increase clock pulses $\phi i$ or many different decrease clock pulses $\phi d$ and the so-called organ type in which an envelope is held at an optional level during the decrease period. With the foregoing embodiment, sample tones for specifying a musical instrument type were limited to the pitches of $C_4$, $C_4^{\#}$ and $D_4$. Instead, it is possible to prescribe any pitch. Further, three sample tones need not be restrictively used. The foregoing embodiment is simply an illustration of this invention. The invention is applicable to an electronic musical instrument provided with circuit arrangements and performance functions different from those used in the foregoing embodiment. Obviously, the invention can be applied in many modifications without departing from the object thereof.

What we claim is:

1. A musical tone designating system for an electronic musical instrument comprising:

performance keys for producing electronic coded signals when operated, each of the electronic coded signals corresponding to a respective one of the performance keys;

changeover means for switching the operation mode of said performance keys to first and second modes, in said first mode the performance keys designating selected ones of a plurality of different timbres and in a second mode the performance keys designating the pitch of the musical tones;

musical tone settable means including circuit means responsive to said electronic coded signals produced by an operation of said performance keys when said changeover means switches said operation mode to said first mode, for setting conditions corresponding to one of said plurality of different timbres; and musical tone producing means responsive to said electronic coded signals produced by an operation of said performance keys when said changeover means switches said operation mode to said second mode, for producing musical tones corresponding to the conditions set in said musical tone settable means and corresponding to the pitch designated by operation of said performance keys.

2. The musical tone designating system of claim 1, further comprising means for producing musical tones having a specific pitch and having said conditions corresponding to the electronic coded signals produced by the operation of said performance keys when said changeover means switches said operation mode to said first mode.

3. The musical tone designating system of claim 1 or 2, wherein said changeover means comprises changeover switch means.

4. The musical tone designating system of claim 1 or 2, wherein said musical tone settable means comprises means for setting at least the waveform of a musical tone.

5. The musical tone designating system of claim 1 or 2, wherein said musical tone settable means comprises means for setting at least the envelope shape of a musical tone.

6. The musical tone designating systm of claims 1 or 2, wherein said musical tone settable means comprises means for setting at least the filter characteristic of a musical tone.

7. The musical tone designating system of claim 1 or 2, wherein at least some of said performance keys designate the conditions of the timbres.

8. The musical tone designating system of claim 1 or 2, wherein said changeover means includes means for selecting one of a plurality of kinds of conditions of timbres responsive to one selectively operated performance key by means of a switching operation of said changeover means.

* * * * *